US008397651B2

(12) United States Patent
Levy et al.

(10) Patent No.: US 8,397,651 B2
(45) Date of Patent: Mar. 19, 2013

(54) CONFIGURABLE TABLE AND METHODS OF USE

(76) Inventors: Davida Levy, Aventura, FL (US); Carole Posner, Boca Raton, FL (US)

( * ) Notice: Subject to any disclaimer, the term of this patent is extended or adjusted under 35 U.S.C. 154(b) by 0 days.

(21) Appl. No.: 13/307,422

(22) Filed: Nov. 30, 2011

(65) Prior Publication Data

US 2012/0073477 A1 Mar. 29, 2012

Related U.S. Application Data

(63) Continuation-in-part of application No. 12/248,446, filed on Oct. 9, 2008, now Pat. No. 8,087,365.

(60) Provisional application No. 61/473,240, filed on Apr. 8, 2011, provisional application No. 61/478,708, filed on Apr. 25, 2011.

(51) Int. Cl.
*A47B 1/00* (2006.01)

(52) U.S. Cl. ..... 108/64; 108/166

(58) Field of Classification Search ..... 108/64, 108/65, 12, 19, 157.17, 153.1, 185, 90, 67, 108/162, 166, 167, 171, 176; 312/107, 108, 312/111; 248/436, 173, 440.1
See application file for complete search history.

(56) References Cited

U.S. PATENT DOCUMENTS

| | | | | | |
|---|---|---|---|---|---|
| 1,014,815 | A | * | 1/1912 | Cushman | 108/88 |
| 1,086,941 | A | | 2/1914 | Sarkoze | |
| 1,227,681 | A | | 5/1917 | Simms | |
| 1,881,475 | A | | 10/1932 | Gibson | |
| 2,343,493 | A | * | 3/1944 | Beckett | 312/237 |
| 2,354,106 | A | * | 7/1944 | Cooper | 108/63 |
| D143,454 | S | | 1/1946 | White | |
| D159,539 | S | | 8/1950 | Schier | |
| 2,875,008 | A | * | 2/1959 | Grodsky | 108/62 |
| 2,924,830 | A | | 2/1960 | De Long | |
| 3,512,857 | A | * | 5/1970 | Butera | 312/107 |
| 3,731,639 | A | * | 5/1973 | Schliemann et al. | 108/157.17 |
| 3,742,869 | A | | 7/1973 | Polsky et al. | |
| D236,054 | S | | 7/1975 | Ginat | |
| 3,955,850 | A | * | 5/1976 | Toso | 297/440.14 |
| 4,345,758 | A | | 8/1982 | Kempf | |
| D284,340 | S | | 6/1986 | Berry | |
| D284,431 | S | | 7/1986 | Berry | |
| D295,815 | S | | 5/1988 | Beall | |
| 4,922,835 | A | * | 5/1990 | Van Vliet et al. | 108/185 |
| D343,072 | S | | 1/1994 | Schulman | |
| 5,341,750 | A | | 8/1994 | Fuchs | |

(Continued)

FOREIGN PATENT DOCUMENTS

| | | |
|---|---|---|
| CH | 562586 | 6/1975 |
| WO | 02/01986 | 1/2002 |

*Primary Examiner* — Janet M Wilkens
(74) *Attorney, Agent, or Firm* — Mayback & Hoffman, P.A.; Gregory L. Mayback; Thomas Bethea

(57) ABSTRACT

A configurable table assembly comprises two table-base sub-assemblies shaped to removably connect together and two table-surface sub-assemblies, each supported by one of the two table-base sub-assemblies. Each table-surface sub-assembly has first and second surface portions, the second surface portion being operable to rest upon the first surface portion and selectively unfold therefrom. The table-base and the table-surface sub-assemblies, together, have a single-table configuration and a double-table configuration. In the single-table configuration, the table-base and the table-surface sub-assemblies are separably mated together to form an integrated table base and an integrated table surface. In the double-table configuration, the table-base sub-assemblies are separated from one another to form two separate tables, each supporting thereon a respective one of the table-surface sub-assemblies. Each of the table-surface sub-assemblies has the second surface portion unfolded away from the first surface portion and onto a portion of one of the table-base sub-assemblies.

17 Claims, 43 Drawing Sheets

U.S. PATENT DOCUMENTS

| | | | | | |
|---|---|---|---|---|---|
| 5,485,795 | A | | 1/1996 | Williams | |
| 5,564,345 | A | | 10/1996 | Crawford et al. | |
| 5,595,126 | A | | 1/1997 | Yeh | |
| D386,020 | S | | 11/1997 | Grabowski | |
| 5,711,229 | A | * | 1/1998 | Piretti | 108/67 |
| 5,754,995 | A | | 5/1998 | Behrendt | |
| D401,438 | S | | 11/1998 | Acinapura | |
| D401,790 | S | | 12/1998 | Buell | |
| 6,000,343 | A | * | 12/1999 | Laney | 108/12 |
| D447,891 | S | | 9/2001 | Wood | |
| D525,806 | S | | 8/2006 | Lai | |
| 7,107,914 | B2 | | 9/2006 | Sherman | |
| 7,373,889 | B2 | | 5/2008 | Nye et al. | |

* cited by examiner

FIG. 29
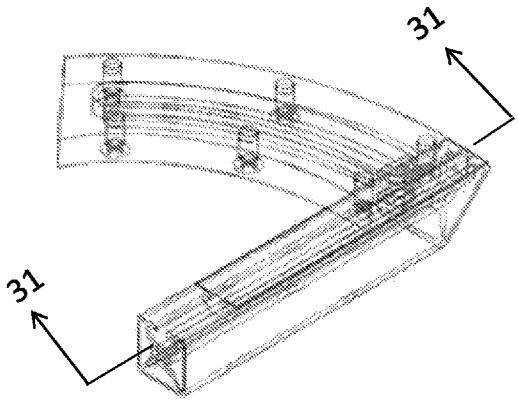
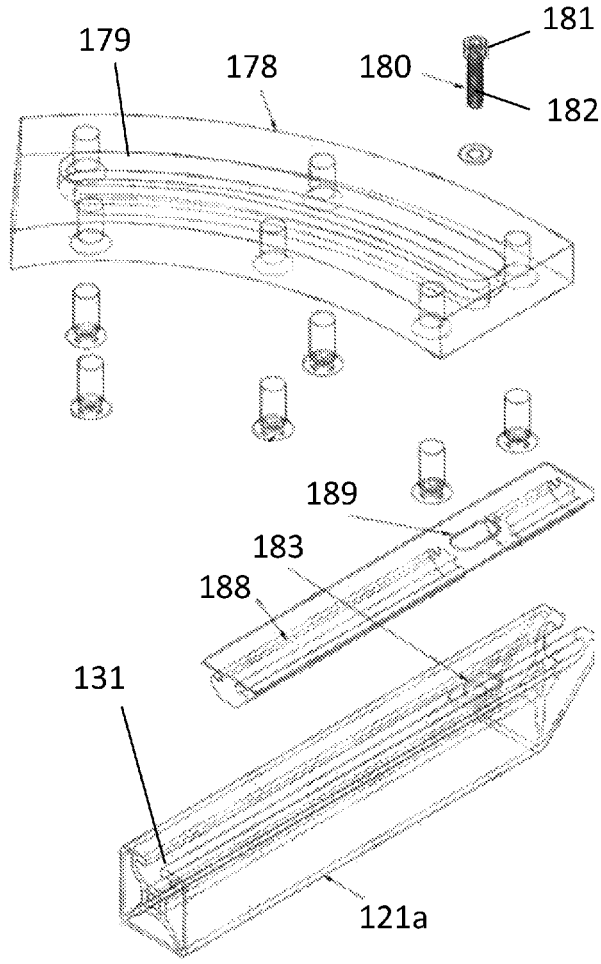
FIG. 30
FIG. 31
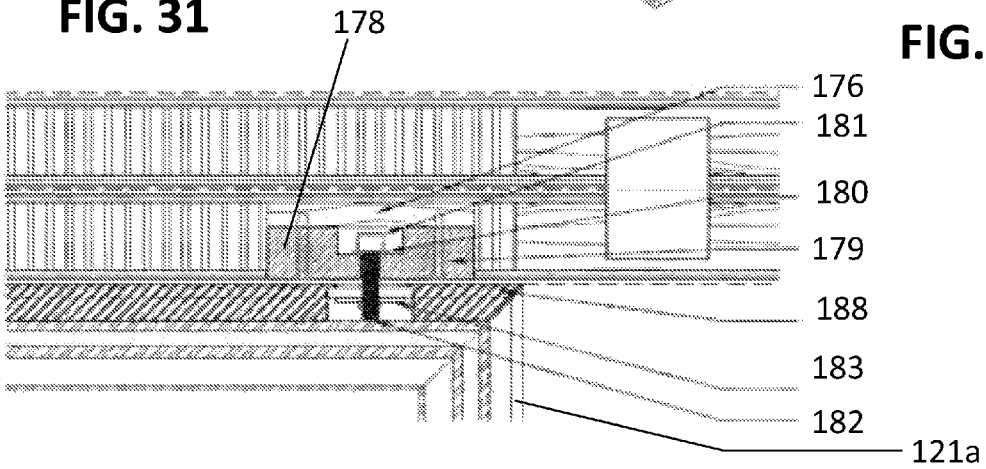

CONFIGURABLE TABLE AND METHODS OF USE

CROSS-REFERENCE TO RELATED APPLICATIONS

This application:

is a continuation-in-part of U.S. patent application Ser. No. 12/248,446, filed on Oct. 9, 2008 (which application claims priority to U.S. Provisional Patent Application Ser. No. 60/978,805, filed on Oct. 10, 2007); and claims priority to U.S. Provisional Patent Application Ser. No. 61/473,240, filed on Apr. 8, 2011, and U.S. Provisional Patent Application Ser. No. 61/478,708, filed on Apr. 25, 2011, the entire disclosures of which are hereby incorporated herein by reference in their entireties.

STATEMENT REGARDING FEDERALLY SPONSORED RESEARCH OR DEVELOPMENT

Not Applicable

FIELD OF THE INVENTION

The present invention lies in the field of furniture. The present disclosure relates to a configurable table.

BACKGROUND OF THE INVENTION

Conventional expandable tables generally require the addition of a separate leaf, which are cumbersome and usually need to be stored away. Alternatively, conventional tables may have foldable portions in order to expand the size of the table. Tables that utilize one or more foldable sides, for example, can generally only increase the size of the table a relatively small amount. Additionally, because the sides are foldable, the edges of the non-foldable portion that adjoin with the foldable portions generally cannot have decorative carvings, moldings, or other configurations. Therefore, these types of tables can be aesthetically unpleasing when in the folded configuration.

Thus, a need exists to overcome the problems with the prior art systems, designs, and processes as discussed above.

SUMMARY OF THE INVENTION

The invention provides a configurable table and methods of its use that overcome the hereinafore-mentioned disadvantages of the heretofore-known devices and methods of this general type and that provide such features with a configurable table assembly having two separate table-base sub-assemblies and two separate table-surface sub-assemblies. The table-base sub-assemblies are shaped to removably connect together. The table-surface sub-assemblies are each supported by a respective one of the two table-base sub-assemblies, each having first and second surface portions, the second surface portion being operable to rest upon the first surface portion and selectively unfold away from the first surface portion. The table-base sub-assemblies and the table-surface sub-assemblies together have at least a single-table configuration and a double-table configuration.

In the single-table configuration, the two table-base sub-assemblies are mated together separably to form an integrated table base; and the two table-surface sub-assemblies are mated together separably to form an integrated table surface having a substantially planar upper table surface. In the double-table configuration, the two table-base sub-assemblies are separated from one another to form two separate tables, each supporting thereon a respective one of the table-surface sub-assemblies. Also in the double-table configuration, each of the table-surface sub-assemblies has the second surface portion unfolded away from the first surface portion and onto at least a portion of the respective one of the table-base sub-assemblies; and each pair of first and second surface portions form, together, a substantially planar upper table surface.

In accordance with another feature of the invention, the two separate table-base sub-assemblies are shaped to removable nest together as one table base in the single-table configuration.

In accordance with a further feature of the invention, in the double-table configuration, each of the table-surface sub-assemblies defines an adjoining edge. The two tables are spaced from one another to position each adjoining edge adjacent one another such that the substantially planar upper table surface of each of the two tables are at the same height and, together, form a single, adjoining, substantially planar upper table surface.

In accordance with an added feature of the invention, when the second surface portion is folded over the first surface portion, the first and second surface portions define a fold edge. Each fold edge is operable to removably mate with the other fold edge to removably join the two table-base sub-assemblies and the two table-surface sub-assemblies together.

In accordance with an additional feature of the invention, the integrated table base comprises one of: two generally cylindrical bases nested together, each having a curved outer surface correspondingly shaped to mate with each other; and two sets of table leg members, each set having at least one table leg member movable relative to the other table leg members.

With the objects of the invention in view, there is also provided configurable table assembly having a single-table configuration including an integrated table base and an integrated table surface supported by the integrated table base. The integrated table base is comprised of two table bases mated together and separable from one another. The integrated table surface is comprised of two table surfaces mated together and separable from one another. Each of the two table surfaces has a first surface portion and a second surface portion folded over the first surface portion defining a fold edge. The two table surfaces are mated together at the fold edges. The configurable table assembly also has a double-table configuration, including two separate table portions. Each of the separate table portions is comprised of one of the two table surfaces supported by one of the two table bases, wherein the second surface portion of each table surface is unfolded from the first surface portion.

In accordance with yet another feature of the invention, the integrated table surface of the single-table configuration defines a first table length. Each of the two table surfaces includes a side edge. The side edges are operable to engage one another to join the two separate table portions in a side-by-side arrangement in the double-table configuration to define a second table length longer than the first table length.

In accordance with again another feature of the invention, there are also provided masking surface inserts. Each of the fold edges includes at least one hinge and at least one pocket. The at least one pocket is operable to receive therein the at least one hinge of an opposing fold edge to mate the two table surfaces together in the single-table configuration; and further operable to receive therein one of the masking surface inserts in the double-table configuration.

In accordance with again a further feature of the invention, each of the table bases includes a first base portion and a second base portion rotatable relative to the first base portion. The first and second surface portions of each table surface overlap in the single-table configuration and are both substantially supported by both the first and second base portions of one of the table bases in the single-table configuration. The first and second surface portions do not overlap in the double-table configuration. Rather, in the double configuration, each surface portion is substantially supported by only one of the base portions.

In accordance with again an added feature of the invention, one of the first and second surface portions of each table surface is rotatable relative to one of the table bases.

In accordance with again an additional feature of the invention, the integrated table base comprises one of: two generally cylindrical bases nested together, each having a curved outer surface correspondingly shaped to mate with each other; and two sets of table legs members, each set having at least one table leg member movable relative to the other table leg members.

With the objects of the invention in view, there is further provided a configurable table, including a first table portion and a second table portion movably associated with the first table portion to define a single-table configuration and a double-table configuration. Each of the first and second table portions includes a table base and a table surface supported on the table base and movable between a folded state and an unfolded state. The table surfaces are operable to mate with one another in the folded state to provide an integrated table surface in the single-table configuration. The table surfaces are further operable to separate from one another to provide the first and second separate table portions in the double-table configuration.

In accordance with an additional feature of the invention, the table bases are operable to mate with one another to provide an integrated table base in the single configuration and separate from one another in the double-table configuration.

In accordance with yet another feature of the invention, the integrated table surface in the single-table configuration defines a first length. The first table portion comprises a first table surface having a first side edge, and the second table portion comprises a second table surface having a second side edge. The second side edge is operable to engage the first side edge to join the first and second table portions side-by-side in the double-table configuration that defines a combined second length longer than the first length.

In accordance with still another feature of the invention, each of the table surfaces is operable to fold along a fold line thereof to define a fold edge in the folded state. The fold edges are operable to mate with one another in the single-table configuration.

In accordance with still a further feature of the invention, each of the fold edges comprises at least one hinge and at least one pocket operable to receive therein the at least one hinge of an opposing fold edge to mate the first and second table surfaces together in the single-table configuration.

In accordance with still an added feature of the invention, there are also provided masking surface inserts, the at least one pocket being operable to receive therein one of the masking surface inserts in the double-table configuration.

In accordance with still an additional feature of the invention, each table surface comprises a first surface half and a second surface half. Each table base comprises a first base portion and a second base portion movable relative to the first base portion. The first and second surface halves of each table surface overlap each other and are both supported by the first and second base portions of one of the table bases in the single-table configuration. Each of the first and second surface halves of each table surface is substantially only supported by one of the first and second base portions of one of the table bases in the double configuration.

In accordance with again an added feature of the invention, the table bases are generally cylindrical and each includes a curved outer surface correspondingly shaped to mate with each other such that the integrated table base is generally comprised of two adjacent generally cylindrical table bases nested together.

In accordance with again an additional feature of the invention, each table base is comprised of a plurality of table leg members, at least one table leg member being movable relative to the other table leg members.

In accordance with a concomitant feature of the invention, there are provided rotation assemblies, each respectively rotatably coupling the table surfaces to the table bases.

Although the invention is illustrated and described herein as embodied in a configurable table and methods of its use, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Additional advantages and other features characteristic of the present invention will be set forth in the detailed description that follows and may be apparent from the detailed description or may be learned by practice of exemplary embodiments of the invention. Still other advantages of the invention may be realized by any of the instrumentalities, methods, or combinations particularly pointed out in the claims.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the present invention. Advantages of embodiments of the present invention will be apparent from the following detailed description of the exemplary embodiments thereof, which description should be considered in conjunction with the accompanying drawings in which:

FIG. 29 is a perspective and hidden view of another part of the table rotation assembly of the configurable table of FIG. 12;

FIG. 30 is an exploded view of the other part of FIG. 29;

FIG. 31 is a fragmentary, cross-sectional view of other part of FIG. 29 taken along section line 31-31 in FIG. 29;

DETAILED DESCRIPTION OF THE INVENTION

Figure 1:
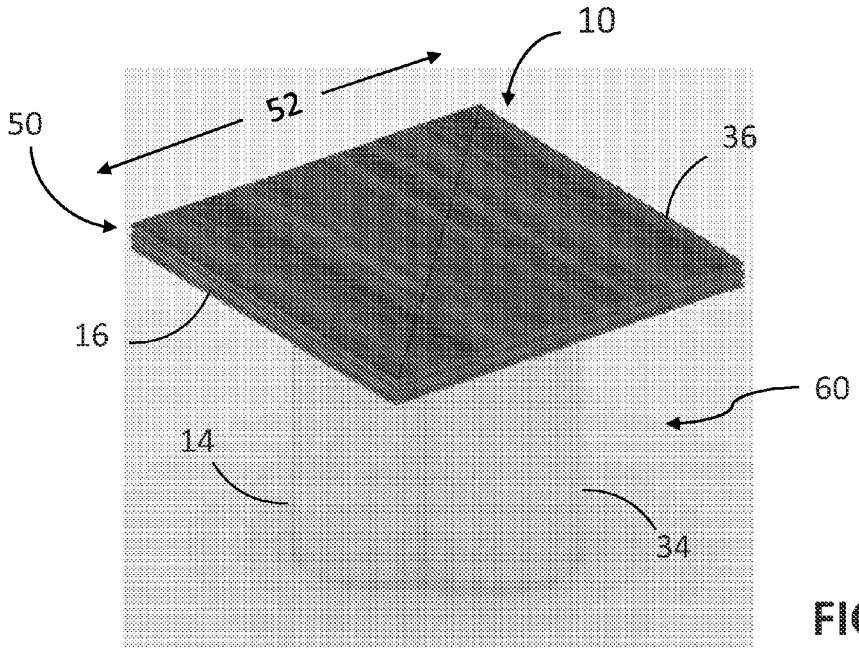
FIG. 1 is a perspective view of a configurable table in a single-table configuration, according to an exemplary embodiment of the present invention.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. The terms "a" or "an", as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Relational terms such as first and second, top and bottom, and the like may be used solely to distinguish one entity or action from another entity or action without necessarily requiring or implying any actual such relationship or order between such entities or actions. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the present invention are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Figure 2:
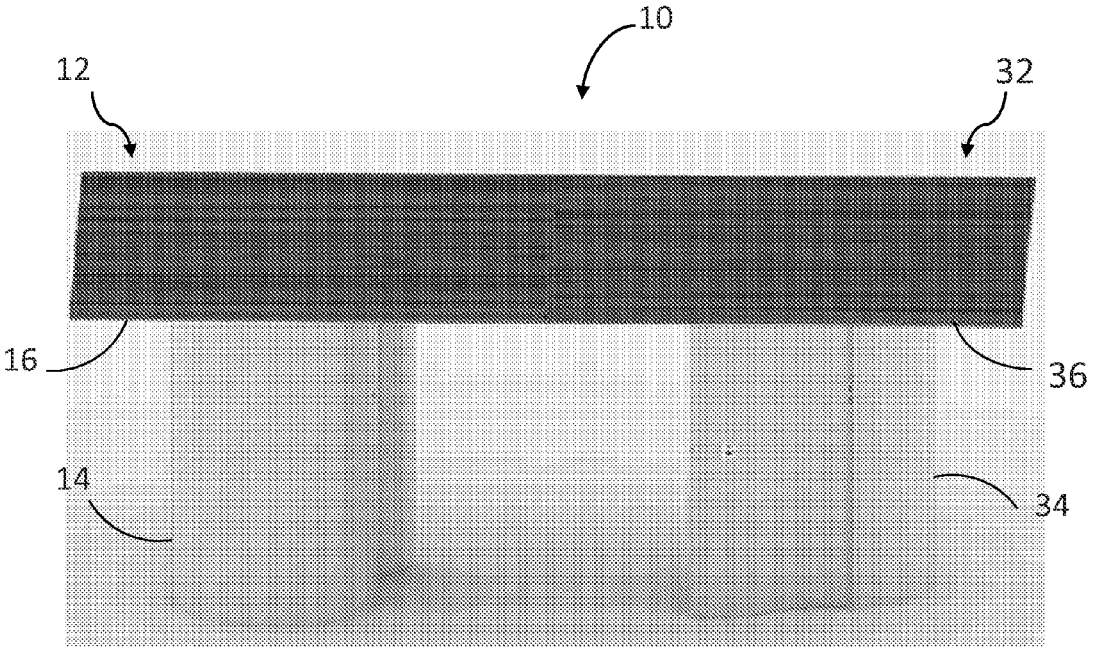
FIG. 2 is a perspective view of the configurable table of FIG. 1 in a double-table configuration.
Figure 3:
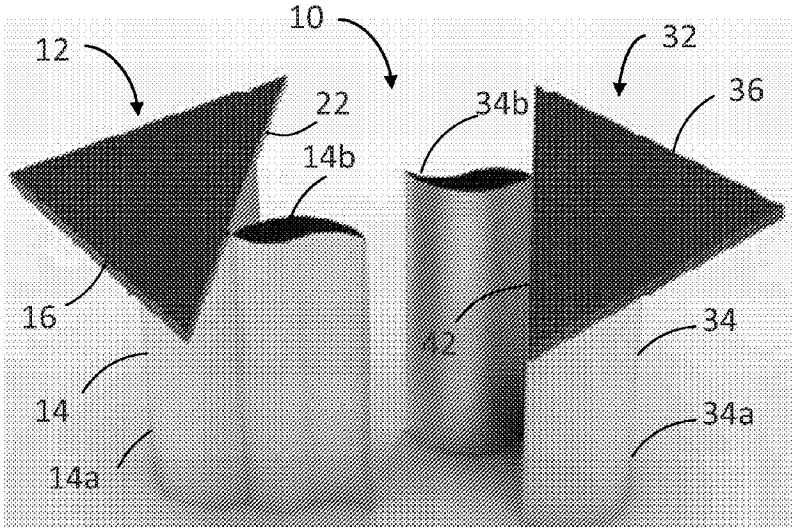
FIGS. 3 to 5 are perspective views of the configurable table of FIG. 1, each depicting a different stage in the configuration of the table between the single and double-table configurations.

Described now are exemplary embodiments of the present invention. Referring now to the figures of the drawings in detail and first, particularly to FIGS. 1 and 2, there is shown a first exemplary embodiment of a configurable table 10 movable between a single-table configuration (FIG. 1) and a double-table configuration (FIG. 2). In the single-table configuration of FIG. 1, the configurable table 10 includes an integrated table surface 50 supported by an integrated table base 60. The table surface and base 50, 60 are referred to herein as "integrated" because, in this configuration, the integrated table base 60 includes two table bases 14 and 34 mated (or integrated) together and the integrated table surface 50 includes two table surfaces 16 and 36 mated together. In the double-table configuration of FIG. 2, the configurable table 10 includes two separate (i.e., non-integrated) table portions 12 and 32. The separation of the integrated table surface 50 (i.e., the two table surfaces 16 and 36) and the integrated table base 60 (i.e., the two table bases 14 and 34) into the two separate table portions 12 and 32, is illustrated in FIGS. 3 to 5 and is described in greater detail below.

Figure 4:
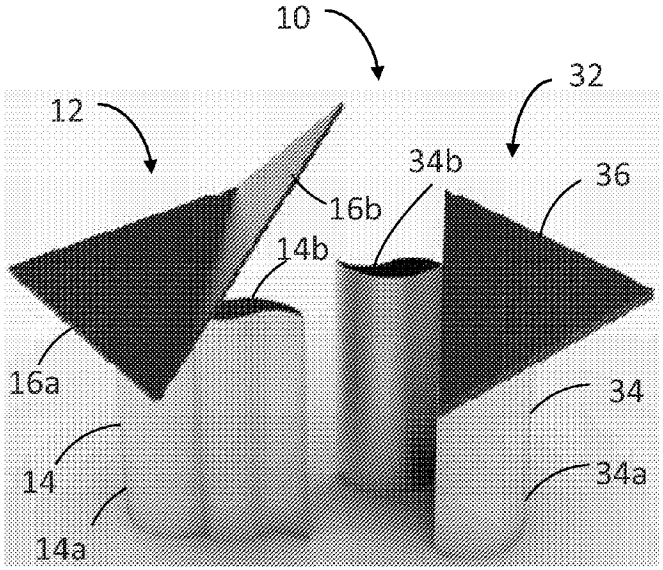
Figure 5:
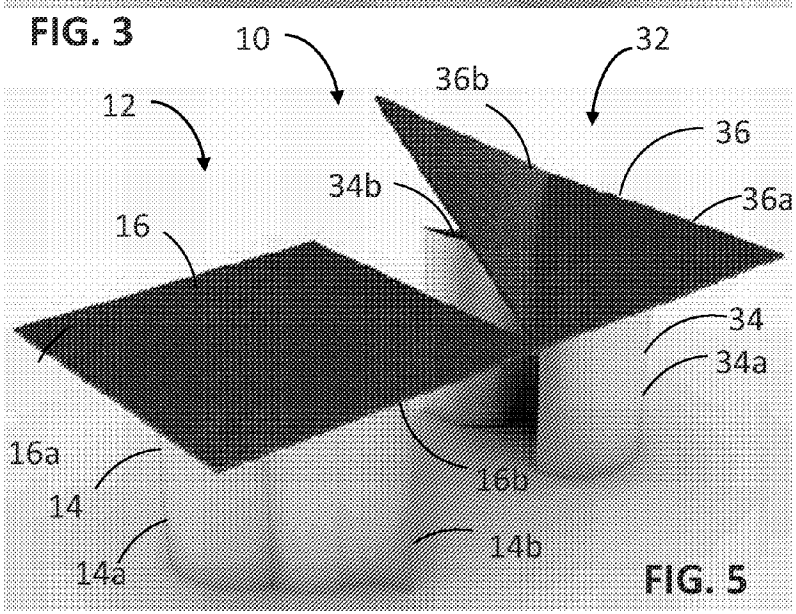
Figure 6:
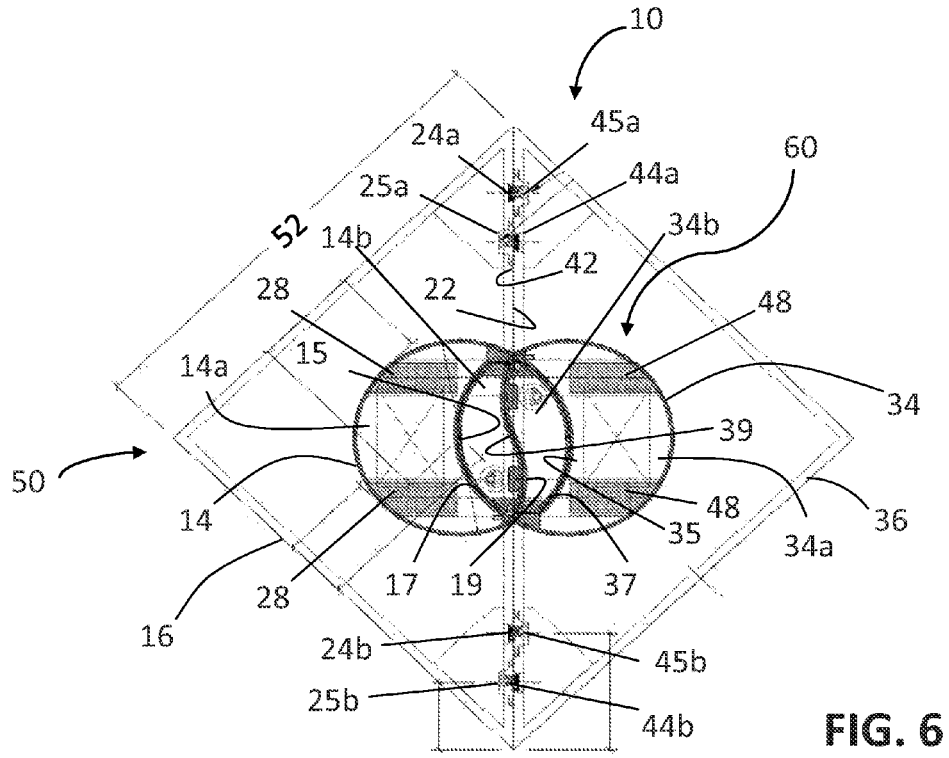
FIG. 6 is a top plan and hidden view of the configurable table of FIG. 1 in the single-table configuration.

As shown in FIGS. 4 and 5, the table surfaces 16 and 36 are movable between a folded state (in the single-table configuration) and an unfolded state (in the double-table configuration). Each table surface 16, 36 includes a first surface portion 16*a*, 36*a* and a second surface portion 16*b*, 36*b* connected thereto and foldable thereon. The table surfaces 16 and 36 are foldable along respective fold lines 20 and 40 to define respective fold edges 22 and 42 (FIGS. 3 and 6). In this embodiment, the second surface portions 16*b*, 36*b* are foldable onto the first surface portions 16*a*, 36*a* by at least one folding sub-assembly 24*a*, 24*b*, 44*a*, 44*b* (e.g., a hinge) disposed at the respective table surface fold edge 22, 42. As depicted in FIG. 6, each table surface 16, 36 has two hinges 24*a*, 24*b* and 44*a*, 44*b* foldably connecting the respective first 16*a*, 36*a* and second 16*b*, 36*b* surface portions to one another. However, such connectivity is merely exemplary and is not intended to be limiting. Other embodiments may include one, two, three or more hinges. Additionally, other embodiments may incorporate alternative mechanical connectors known or contemplated by one of ordinary skill in the art, other than hinges, which allow the table surface portions 16*b* and 36*b* to fold relative to the respective opposing table surface portions 16*a* and 36*a*.

Figure 10:
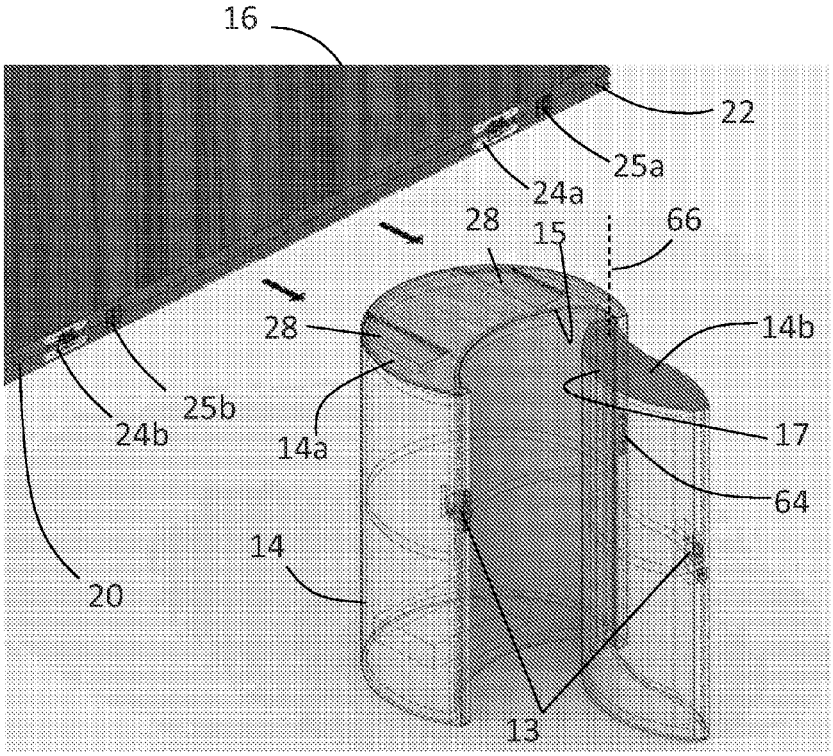
FIG. 10 is a fragmentary, partially transparent, perspective view of the configurable table of FIG. 1 with the table surface removed therefrom.

In the single-table configuration (FIGS. 1 and 6), the table surfaces 16 and 36 are in the folded state and are mated together to form the integrated table surface 50. As shown, the table surfaces 16 and 36 include pockets 25*a*, 25*b* and 45*a*, 45*b* formed within respective fold edges 22 and 42 for respectively receiving therein the hinges 44*a*, 44*b* and 24*a*, 24*b* of the opposing fold edges 22 and 42. For example, as best illustrated in FIGS. 6 and 10, the pockets 25*a* and 25*b* of the first table surface 16 respectively receive therein the hinges 44*a* and 44*b* of the opposing table surface 36. Similarly, the pockets 45*a* and 45*b* of the second table surface 36 respectively receive therein the hinges 24*a* and 24*b* of the opposing table surface 16. The pockets 25*a*, 25*b*, 45*a*, and 45*b* are shaped to form a secure fit with respective opposing hinges 44*a*, 44*b*, 24*a*, and 24*b* to mate the folded table surfaces 16 and 36 together in the single-table configuration. The number of pockets 25*a*, 25*b*, 45*a*, 45*b* is determined by the number of hinges 24*a*, 24*b*, 44*a*, 44*b* in this exemplary configuration.

Figure 9:
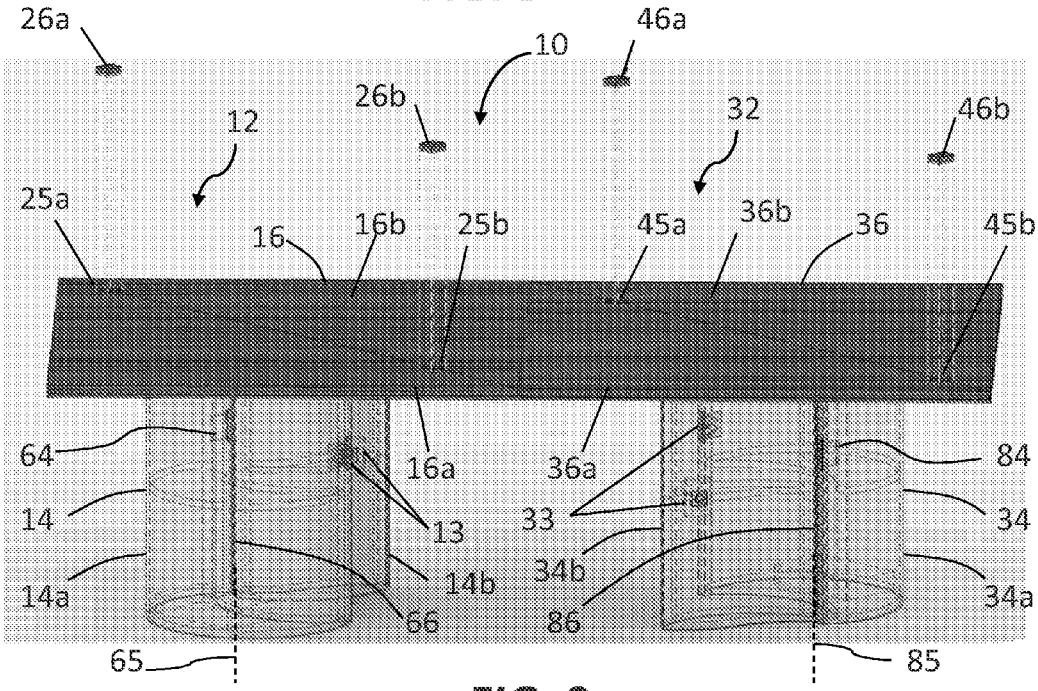
FIG. 9 is a partially transparent and partially exploded, perspective view of the configurable table of FIG. 2.

As shown in FIG. 9, the pockets 25*a*, 25*b*, 45*a*, and 45*b* are shaped to receive therein masking, table-surface inserts 26*a*, 26*b*, 46*a*, and 46*b*, respectively, when the table 10 is in the double-table configuration. The inserts are 26*a*, 26*b*, 46*a*, and 46*b* are, preferably, solid blocks made of the same material as the table surfaces 16 and 36 so that, when inserted, the pockets 25*a*, 25*b*, 45*a*, and 45*b* are disguised and the table surfaces 16 and 36 have a flush, continuous surface. These inserts 26*a*, 26*b*, 46*a*, and 46*b* may be stored separately or, alternatively, a storage unit may be formed within one of the base portions 14*a*, 14*b*, 34*a*, 34*b* to hold the inserts therein when the table 10 is in the single-table configuration.

In this embodiment, the table bases 14 and 34 are movable between a nested arrangement (in the single-table configuration) and a non-nested arrangement (in the double-table configuration). As depicted in FIGS. 6 to 9, each table base 14, 34 includes a respective first base portion 14*a*, 34*a* and a respective second base portion 14*b*, 34*b* connected thereto. The second base portions 14*b* and 34*b* are connected and movable relative to the first base portions 14*a* and 34*a* by respective rotating sub-assemblies 64 and 84, for example, hinges. The second base portions 14*b* and 34*b* are rotatable about respective pivot axes 65 and 85 extending along edges 66 and 86 of the respective first base portions 14*a* and 34*a*. Each table base 14, 34 in this exemplary embodiment includes a respective closure mechanism 13, 33 (FIG. 9) to secure the respective base portions 14*a*, 14*b* and 34*a*, 34*b* together in the nested arrangement. The closure mechanism 13, 33 may include any suitable mechanical closure mechanism known in the art.

Figure 11:
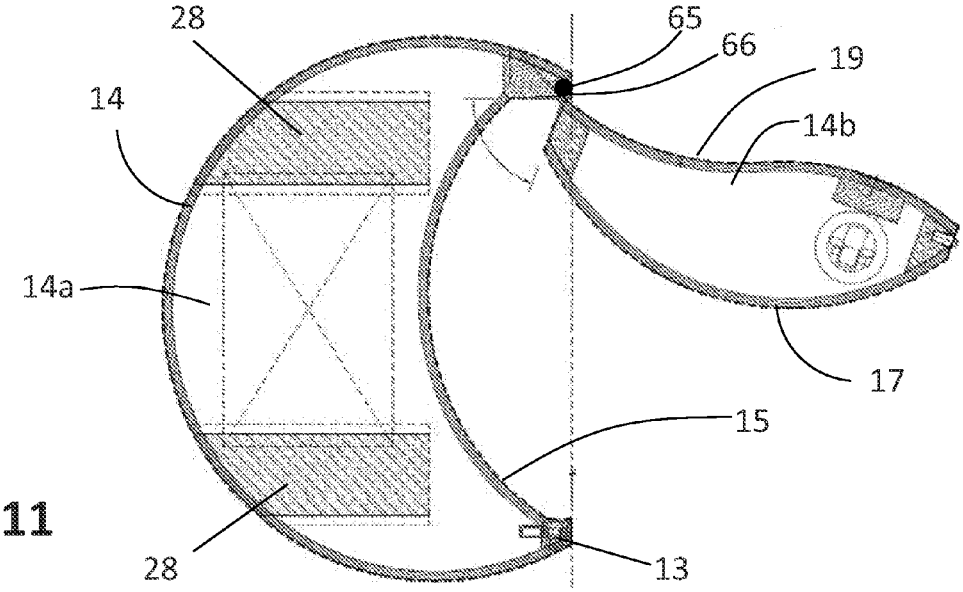
FIG. 11 is a top plan and partially hidden view of a table base of the configurable table of FIG. 1 in an opened orientation.

In the nested arrangement, both base portions 14*a*, 14*b* and 34*a*, 34*b* of respective table bases 14, 34 support both surface portions 16*a*, 16*b* and 36*a*, 36*b* of respective folded table surfaces 16, 36. Whereas, in the non-nested arrangement, the second base portions 14*b*, 34*b* rotate about the respective pivot axis 65, 85 away from the first base portions 14*a* and 34*a* to a position that supports the second surface portions 16*b*, 36*b* of respective unfolded table surfaces 16, 36. The table surfaces 16, 36 are attached to respective table bases 14, 34 through any suitable mechanical attachment mechanism known by one of ordinary skill in the art that connects the first surface portions 16*a*, 36*a* to the first base portions 14*a*, 34*a*. For example, as shown in FIGS. 6 and 10 to 11, the first base portions 14*a*, 34*a* include respective channels 28, 48 formed in a top surface thereof for receiving a correspondingly shaped connector block (not shown) disposed on a bottom surface of the respective first surface portions 16*a*, 36*a*.

In an exemplary embodiment, the first base portions 14*a*, 34*a* have a generally moon- or crescent-shaped cross-section and the second base portions 14*b*, 34*b* have a generally leaf-shaped cross-section. FIG. 6 shows each of the table bases 14, 34 in the nested arrangement, in which the inside concave surface 15, 35 of the respective crescent-shaped base portion 14*a*, 34*a* receives the inside convex surface 17, 37 of the respective leaf-shaped base portion 14*b*, 34*b*. Also in FIG. 6, the nested table bases 14, 34 are mated together to form the integrated table base 60. In this embodiment, the second base portions 14*b*, 34*b* include curved outer surfaces 19, 39 correspondingly shaped to mate with the nested first and second table bases 14, 34 to form the integrated table base 60 in the single-table configuration.

The moon-shaped 14*a*, 34*a* and leaf-shaped 14*b*, 34*b* base portions are merely exemplary shapes. The first 14*a*, 34*a* and second 14*b*, 34*b* base portions may have other shapes without falling beyond the scope of the present invention, in which each is sufficiently sized to support at least one table surface portion 16*a*, 16*b* and 36*a*, 36*b* of the respective table surfaces 16, 36 and shaped to mate with the other to form the integrated table base 60 in the single-table configuration. "Mate" as used in this instance can be a physical structural mating but can also be a visually aesthetic mating that does not require physical, structural contact.

Referring back to FIGS. 3 to 5, a method of configuring the table 10 between a single-table configuration and a double-table configuration is described hereinbelow. If the table 10 is initially in the single-table configuration (FIG. 1), and configuring the table 10 into the double configuration (FIG. 2) is desired, the integrated table surface 50 and the integrated table base 60 are separated into two table portions 12, 32. The integrated table surface 50 is separated by pulling the individual table surfaces 16, 36, and thus the table bases 14, 34, apart from one another. The hinges 24*a*, 24*b* and 44*a*, 44*b* are thereby removed from within the respective pockets 45*a*, 45*b* and 25*a*, 25*b*. Initially, the table surfaces 16, 36 of the separated table portions 12, 32 are in a folded state (see, e.g., FIG. 3) and the table bases 14, 34 are in the nested arrangement. The table bases 14, 34 are moved from the nested arrangement to the non-nested arrangement (see, e.g., FIGS. 2 to 5 and 7) and the second base portions 14*b*, 34*b* are rotated away from the respective first base portions 14*a*, 34*b* either automatically or manually, as depicted in FIG. 3. The table surfaces 16, 36 are then moved from the folded state to the unfolded state, as depicted in the progression of FIGS. 3 to 4 to 5, by unfolding the second surface portions 16*b*, 36*b* from the respective first surface portions 16*a*, 36*a*.

Figure 7:
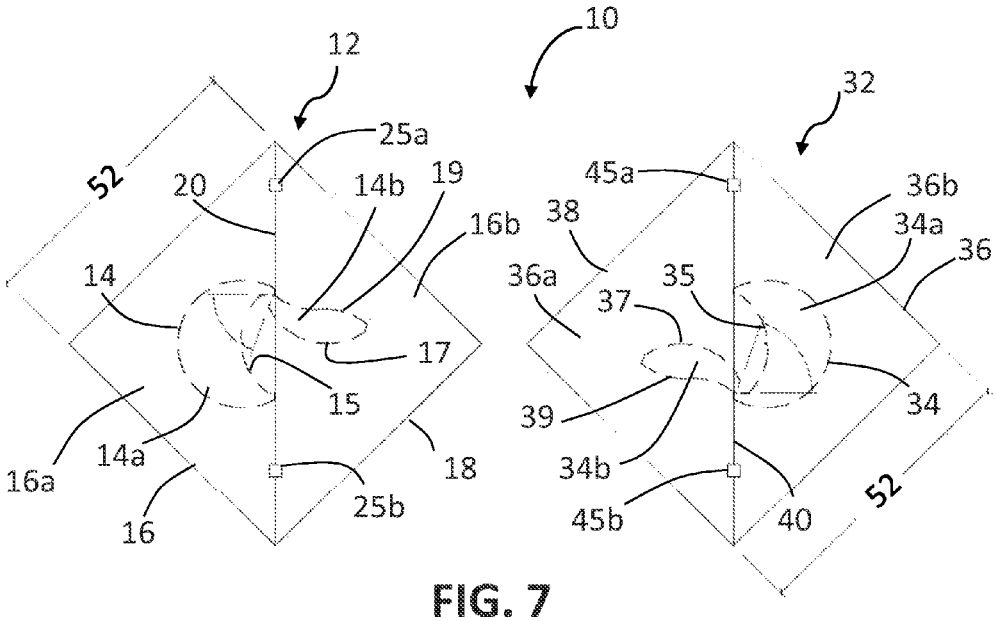
FIG. 7 is a top plan and hidden view of the configurable table of FIG. 1 in another double-table configuration.
Figure 8:
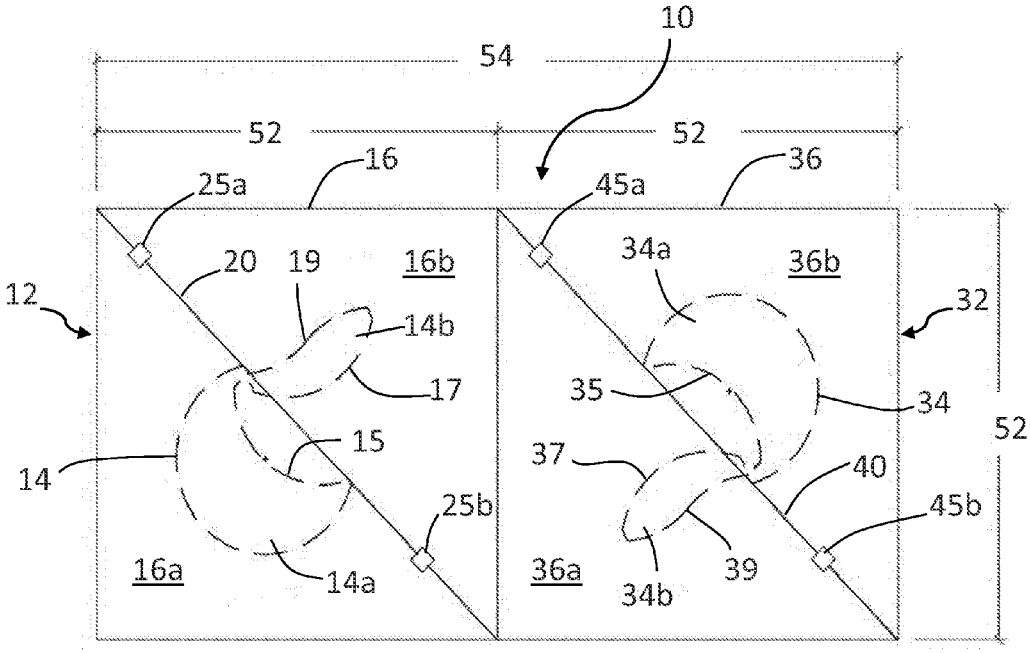
FIG. 8 is a top plan and hidden view of the configurable table of FIG. 1 in the double-table configuration.

FIGS. 2 and 7 to 9 depict the table 10 in the double-table configuration, in which the separate table portions 12, 32 include unfolded table surfaces 16, 36 supported by respective non-nested table bases 14, 34. The table portions 12, 32 may be positioned separately, for example, as depicted in FIG. 7, for individual use. Alternatively, as shown in FIGS. 2, 8, and 9, the table portions 12, 32 may be positioned in a side-by-side configuration, where a side edge 18 of the first table surface 16 is positioned immediately adjacent to and engages a side edge 38 of the second table surface 36.

In this embodiment, the table 10 has a first length 52 in the single-table configuration (FIG. 1) and a second length 54 in the side-by-side double-table configuration (FIG. 8). The first length 52 is defined by the length of the integrated table surface 50 in the single-table configuration, whereas the second length 54 is defined by the combined lengths 52 of the table surfaces 16, 36 of each respective table portion 12, 32. In this particular embodiment, the length 52 of each table surface 16, 36 is the same as the first length 52 of the integrated table surface 50. This is because the table surfaces 16, 36 are square-shaped (the respective fold lines 20, 40 being the lines of symmetry for each square table surface 16, 36) and have substantially the same dimensions. This is not necessarily the case for table surfaces 16, 36 having different shapes and dimensions. For example, the table surfaces 16, 36 may be circular, ovular, rectangular, or triangular in shape. The table surfaces 16, 36 may take on other alternative shapes, but preferably one that is substantially symmetrical (wherein the fold line is the line of symmetry of the table surface) to provide ease in configuring the table surfaces 16, 36 between the folded and unfolded states, i.e., between the single and double-table configurations.

To configure the table 10 from the double-table configuration back into the single-table configuration, the table surfaces 16, 36 are returned to their folded states by folding the second surface portions 16*b*, 36*b* back upon the respective first surface portions 16*a*, 36*a*. The table bases 14, 34 are, then, moved from the non-nested arrangement to the nested arrangement by rotating the second base portions 14*b*, 34*b* back towards the respective first base portions 14*a*, 34*a* to align and engage the inside convex surfaces 17, 37 of the respective leaf-shaped base portions 14*b*, 34*b* with the inside concave surfaces 15, 35 of the respective crescent-shaped base portions 14*a*, 34*a*. The first and second table portions 12, 32 are, then, with the table bases 14, 34 in the nested arrangement and the table surfaces 16, 36 in the folded state, moved toward one another to align the opposing fold edges 22, 42 of respective table surfaces 16, 36 and the curved outer surfaces 19, 39 of respective table bases 14, 34. The hinges 24*a*, 24*b* and 44*a*, 44*b* of the table surfaces 16, 36 are respectively received within the pockets 25*a*, 25*b* and 45*a*, 45*b* of the opposing table surface 16, 36 to mate the first and second table portions 12, 32 together to form the integrated table base 60 and the integrated table surface 50.

Figure 12:
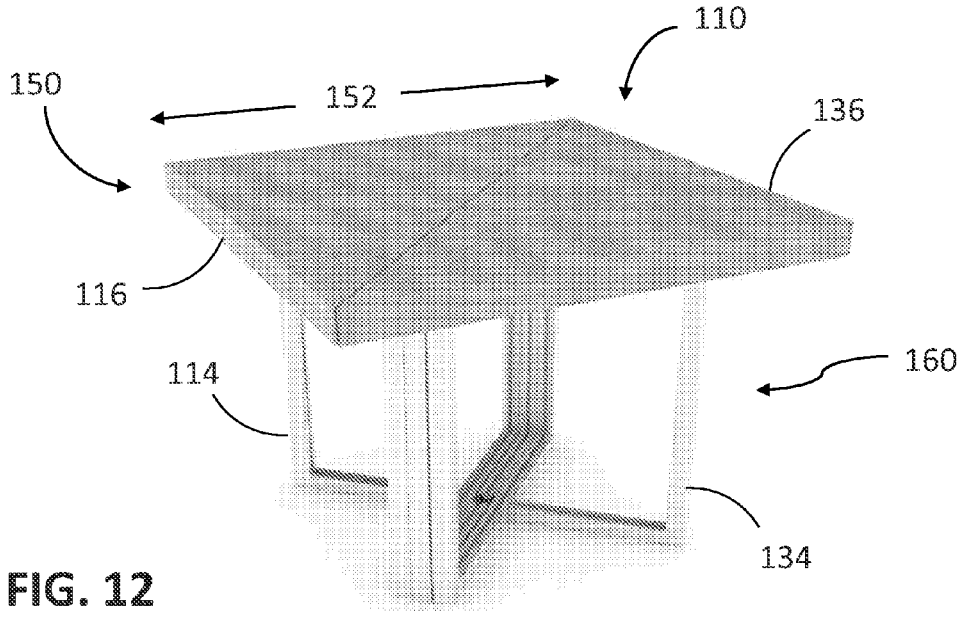
FIG. 12 is a perspective view of a configurable table in a single-table configuration, according to another exemplary embodiment of the present invention.
Figure 13:
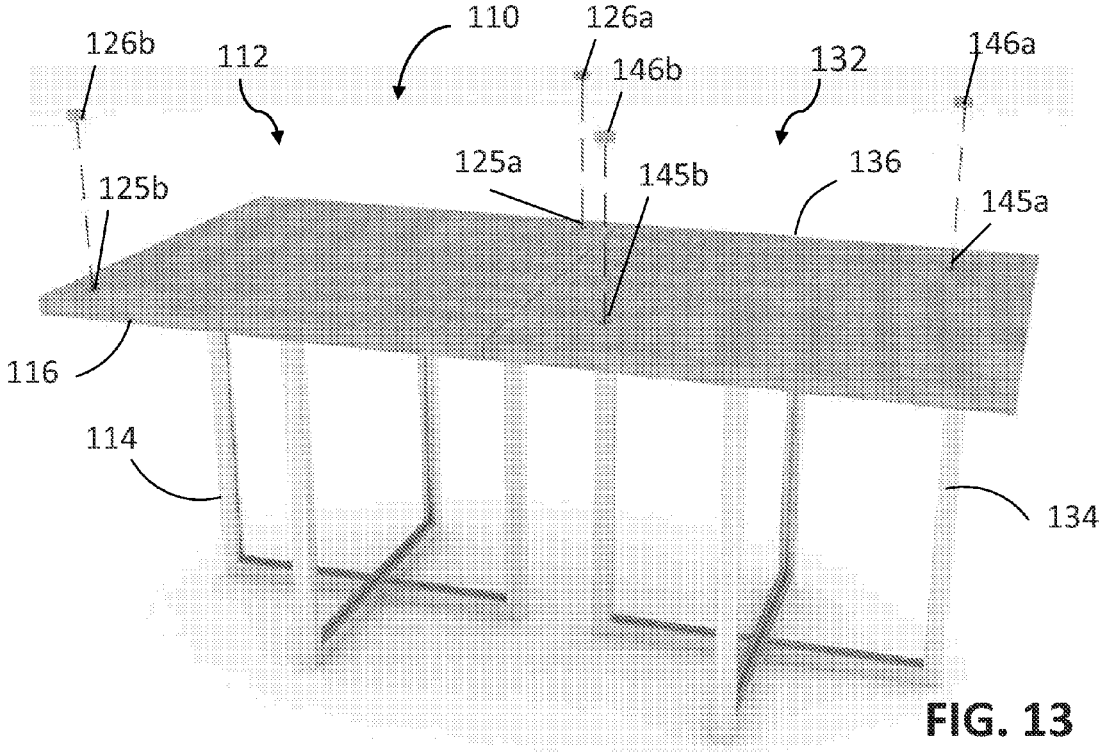
FIG. 13 is a perspective and partially exploded view of the configurable table of FIG. 12 in a double-table configuration.

Referring now to FIGS. 12 and 13, there is shown another exemplary embodiment of a configurable table 110 movable between a single-table configuration (FIG. 12) and a double-table configuration (FIG. 13). In the single-table configuration of FIG. 12, the configurable table 120 includes an integrated table surface 150 supported by an integrated table base 160. The integrated table base 160 includes two table bases 114, 134 mated together and the integrated table surface 150 includes two table surfaces 116, 136 mated together. In the double-table configuration of FIG. 13, the configurable table 110 includes two separate table portions 112, 132. The separation of the integrated table surface 150 (i.e., the two table surfaces 116, 136) and the integrated table base 160 (i.e., the two table bases 114, 134) into the two separate table portions 112, 132, is illustrated in the progression from FIGS. 14 to 17 and described in greater detail below.

Figure 14:
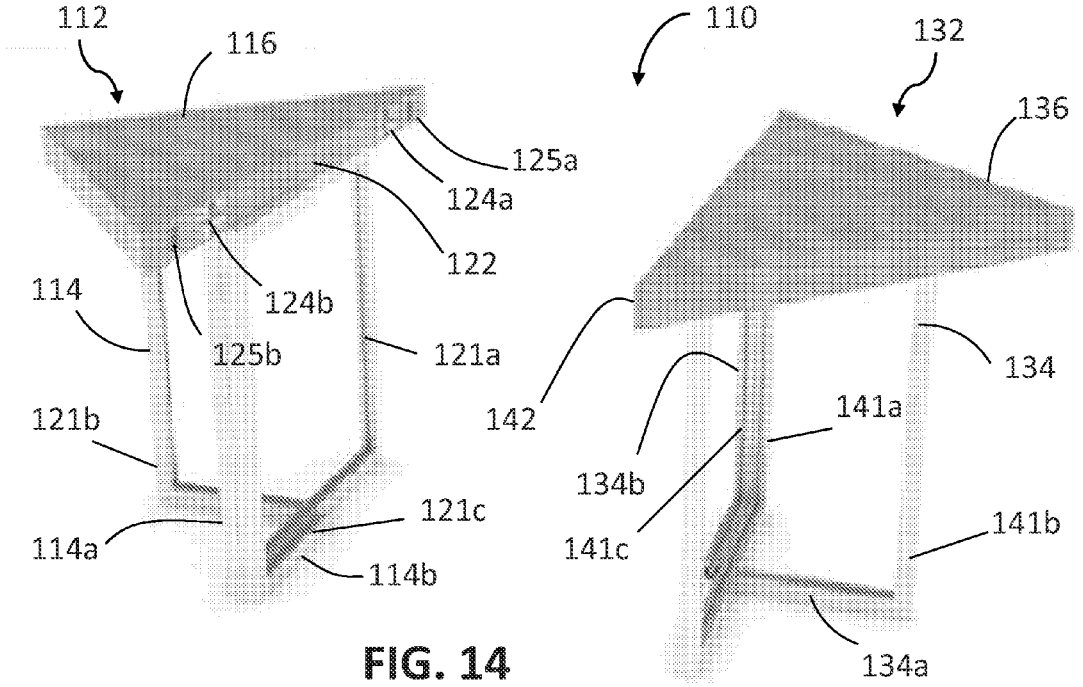
FIGS. 14 to 17 are perspective views of the configurable table of FIG. 12, each depicting a different stage in the configuration of the table between the single and double-table configurations.
Figure 15:
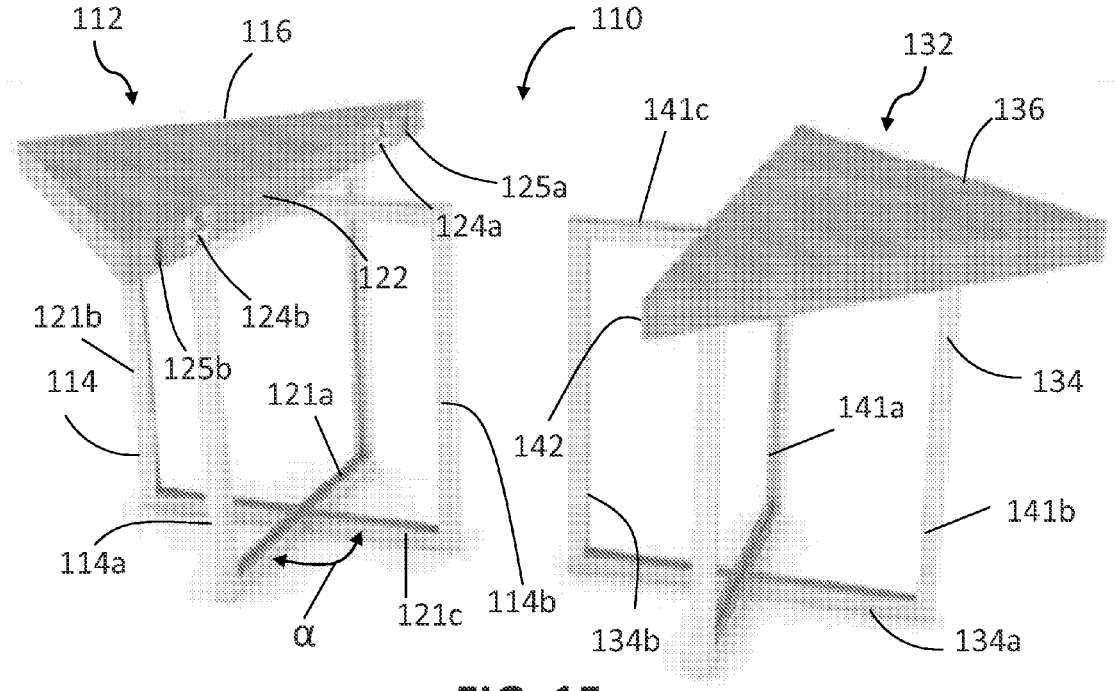

As shown in FIGS. 14 to 17, the table surfaces 116, 136 are movable between a folded state (in the single-table configuration) and an unfolded state (in the double-table configuration). Each table surface 116, 136 includes a first surface portion 116*a*, 136*a* and a second surface portion 116*b*, 136*b* connected thereto and foldable thereon. The table surfaces 116, 136 are foldable along respective fold lines 120, 140 (FIGS. 24 to 25) to define respective fold edges 122, 142 (FIGS. 14 to 15). In this exemplary embodiment, the second surface portions 116*b*, 136*b* are foldable onto the first surface portions 116*a*, 136*a* by at least one hinge 124*a*, 124*b*, 144*a*, 144*b* disposed at the respective table surface fold edge 122, 142. As depicted in FIG. 18, each table surface 116, 136 has two hinges 124*a*, 124*b* and 144*a*, 144*b* foldably connecting the respective first 116*a*, 136*a* and second 116*b*, 136*b* surface portions. However, this configuration is merely exemplary and is not intended to be limiting. Other embodiments may include one, two, three, or more hinges. Additionally, other embodiments may incorporate alternative mechanical connectors known or contemplated by one of ordinary skill in the art, other than hinges, which allow the table surface portions 116*b*, 136*b* to fold relative to the respective opposing table surface portions 116*a*, 136*a*.

In the single-table configuration (FIGS. 12 and 18), the table surfaces 116, 136 are in the folded state and mated together to form the integrated table surface 150. As shown, the table surfaces 116, 136 include respective pockets 125*a*, 125*b* and 145*a*, 145*b* formed within respective fold edges 122, 142 for respectively receiving therein the hinges 144*a*, 144*b* and 124*a*, 124*b* of the opposing fold edges 122, 142. For example, as best illustrated in FIG. 18, the pockets 125*a*, 125*b* of the first table surface 116 respectively receive therein the hinges 144*a*, 144*b* of the opposing table surface 136. Similarly, the pockets 145*a*, 145*b* of the second table surface 136 respectively receive therein the hinges 124*a*, 124*b* of the opposing table surface 116. The pockets 125*a*, 125*b* and 145*a*, 145*b* are shaped to form a secure fit with respective opposing hinges 144*a*, 144*b* and 124*a*, 124*b* to mate the folded table surfaces 116, 136 together in the single-table configuration. The number of pockets 125*a*, 125*b*, 145*a*, 145*b* is determined by the number of hinges 124*a*, 124*b*, 144*a*, 144*b*.

As shown in FIG. 13, the pockets 125*a*, 125*b*, 145*a*, 145*b* are shaped to receive therein masking table surface inserts 126*a*, 126*b*, 146*a*, 146*b*, respectively, when the table 110 is in the double-table configuration. The inserts are 126*a*, 126*b*, 146*a*, 146*b* are in an exemplary embodiment solid blocks made of the same material as the table surfaces 116, 136 so that, when inserted into the pockets 125*a*, 125*b*, 145*a*, 145*b* formed therein, the pockets 125*a*, 125*b*, 145*a*, 145*b* are disguised and the table surfaces 116, 136 have a flush, continuous surface.

In this embodiment, the table bases 114, 134 are movable between a nested arrangement (in the single-table configuration) and a non-nested arrangement (in the double-table configuration). As depicted in FIGS. 14 to 17, each table base 114, 134 includes a respective first base portion 114*a*, 134*a* and a respective second base portion 114*b*, 134*b* connected thereto. The second base portions 114*b*, 134*b* are movable relative to the respective first base portions 114*a*, 134*a* between a first position in the nested arrangement and a second position in the non-nested arrangement. The first position is defined when the second base portions 114*b*, 134*b* are adjacent to the respective first base portions 114*a*, 134*a*, where the most contact is made between respective first and second base portions 114*a*-to-114*b* and 134*a*-to-134*b*. The second position is defined when the second base portions

114*b*, 134*b* are rotated from the respective first base portions 114*a*, 134*a* through an angle α (see, e.g., FIG. 15), wherein the least amount of contact is made between respective first and second base portions 114*a*, 114*b* and 134*a*, 134*b*. The angle α may be between about 45 and about 90 degrees and, most particularly, is a 90 degree angle. The second base portions 114*b*, 134*b* are connected and movable relative to the respective first base portions 114*a*, 134*a* by respective hinges 164, 184 or any other suitable mechanical attachment mechanism known by one of ordinary skill in the art. The hinge 164, for example, as best depicted in FIG. 18, rotatably connects table base portions 114*a*, 114*b* and hinge 184, for example, as best depicted in FIG. 18, rotatably connects table base portions 134*a*, 134*b*.

In the nested arrangement, the first base portions 114*a*, 134*a* of respective table bases 114, 134 support both surface portions 116*a*, 116*b* and 136*a*, 136*b* of respective folded table surfaces 116, 136. However, it is also within the scope of the present invention for the folded table surfaces 116, 136 to be supported by both respective base portions 114*a*, 114*b* and 134*a*, 134*b*, similar to the embodiment of FIGS. 1 to 11. In the non-nested arrangement, however, the second base portions 114*b*, 134*b* rotate from the first position (i.e., adjacent the respective first base portions 114*a*, 134*a*) to the second position (i.e., disposed at an angle α from the respective first base portions 114*a*, 134*a*) to support the second surface portions 116*b*, 136*b* of respective unfolded table surfaces 116, 136.

In this embodiment, each of the table bases 114, 134 is formed from a plurality of respective table leg members 121*a*, 121*b*, 121*c* and 141*a*, 141*b*, 141*c*. In this embodiment, the leg members 121*a*, 121*b* make up the first base portion 114*a* of the table base 114 and the leg member 121*c* makes up the second base portion 114*b*. The leg member 121*c* is movable relative to the leg members 121*a*, 121*b*. Similarly, the leg members 141*a*, 141*b* make up the first base portion 134*a* of the table base 134 and the leg member 141*c* makes up the second base portion 134*b*. The leg member 141*c* is movable relative to the respective leg members 141*a*, 141*b*.

As shown in FIGS. 14 to 17, each of the leg members 121*a*, 141*a* is a planar square shaped bar having a bottom portion, which sits on a ground surface, a top portion parallel to the bottom portion, and which supports the respective table surfaces 116, 136 thereon, and two side portions connecting the bottom and top portions. Each of the leg members 121*b*, 121*c* and 141*b*, 141*c* are U-shaped bars having a bottom portion, which sits on a ground surface, a top portion parallel to the bottom portion, and which supports the respective table surfaces 116, 136 thereon, and a side portion connecting the bottom and top portions. Each U-shaped leg member 121*b*, 121*c*, 141*b*, 141*c* has its own plane defined by its respective bottom, top and side portions. The U-shaped leg members 121*b*, 121*c* and 141*b*, 141*c* are, in the exemplary embodiment, the same or substantially the same in shape and size and each of the square shaped leg members 121*a*, 141*a* is preferably shaped and dimensioned as if it was comprised of two combined U-shaped leg members. In fact, alternate embodiments may use two separate, but attached, U-shaped leg members in place of a square shaped leg member. The leg members 121*a*, 121*b*, 121*c* and 141*a*, 141*b*, 141*c* may be made from any material suitable for table legs known in the art, e.g., wood, plastic, or aluminum, to name a few.

Figure 20:
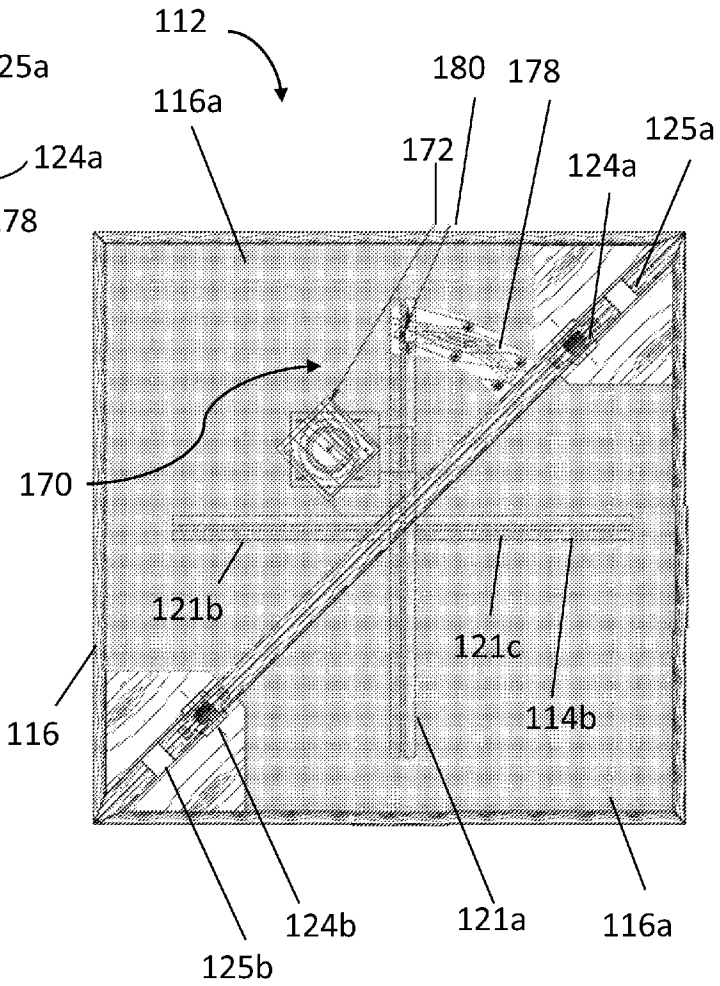
FIG. 20 is a top plan view of the table portion of FIG. 19 in the double-table configuration.

In an exemplary embodiment, the U-shaped leg members 121*b*, 141*b* are fixedly connected to the respective square shaped leg members 121*a*, 141*a*, at about midway between the two side portions of the respective leg members 121*a*, 141*a*, and are perpendicular to the plane defined by each of the respective leg members 121*a*, 141*a*. The U-shaped leg members 121*c*, 141*c*, however, are movably connected to the respective square shaped leg members 121*a*, 141*a*. The point of connection between the leg members 121*c*, 141*c* and leg members 121*a*, 141*a*, respectively, is at about midway between the two side portions of the leg members 121*a*, 141*a* so that the leg members 121*c*, 141*c* are substantially aligned with respective leg members 121*b*, 141*b*. The leg members 121*c*, 141*c* are operable to rotate about the point of connection between the first and second positions of the respective second base portions 114*b*, 134*b*. As shown in FIGS. 18 and 20 the hinges 164, 184 are the points of connection between the leg members 121*c*, 141*c* and the respective leg members 121*a*, 141*a*. They are disposed about midway between the two side portions of the leg members 121*a*, 141*a*, and substantially aligned with the leg members 121*b*, 141*b*. Accordingly, the leg members 121*c*, 141*c* are operable to rotate via the respective hinges 164, 184 between the first and second positions of the second base portions 114*b*, 134*b*.

As depicted in FIGS. 14, 18, 19, and 23, the leg members 121*c*, 141*c* are side-by-side with the leg members 121*a*, 141*a* and perpendicular relative to the leg member 121*b*, 141*b* in the first position of the respective second base portions 114*b*, 134*b*. As shown in FIGS. 15 to 17, 20, 22, and 24 to 25, the leg members 121*c*, 141*c* are perpendicular to the leg members 121*a*, 141*a* and aligned with the leg members 121*b*, 141*b* in the second position of the respective second base portions 114*b*, 134*b*. Thus, the bottom, top, and side portions of each of the leg members 121*b*, 121*c* defines a common shared plane perpendicular to that defined by the leg member 121*a*, and the bottom, top, and side portions of each of the leg members 141*b*, 141*c* defines a common shared plane perpendicular to that defined by the leg member 141*a*.

In this exemplary embodiment, each table portion 112, 132 has a table surface rotation assembly 170 for rotatably attaching the table surfaces 116, 136 to the respective table bases 114, 134. As illustrated in FIGS. 18 and 26 to 31, the rotation assembly 170 includes a turntable bearing 172 rotatably coupled to the leg members 121*a*, 141*a* by a connection plate 174 and a linear bearing 176, which is operable to slide the turntable bearing 172 linearly. Each leg member 121*a*, 141*a* has a respective channel 131, 151 formed therein and shaped to slidably receive the linear bearing 176. As shown in FIG. 18, each table surface 116, 136 has a cutout 190 formed in the underside surface of the respective first surface portion 116*a*, 136*a* for receiving and rotating with the turntable bearing 172.

The rotation assembly 170 further includes a curved guide track 178 slidably coupled to the leg members 121*a*, 141*a* by a connector 180. The connector head 181 is received within the guide groove 179 of the guide track 178 and the connector tip 182 is disposed within the channels 131, 151 of respective legs 121*a*, 141*a* and held in place by a fastener 183. In this embodiment, the connector 180 is a socket head cap screw that serves as a fixed pin for the guide track 178 and the fastener 183 is a T-nut. However, other mechanical connectors and fasteners known by one of ordinary skill in the art may be used without falling beyond the scope of the present invention. A linear insert 188 is preferably disposed between the leg member 121*a*, 141*a* and the guide track 178 to allow for rotation and sliding of the respective table surface 116, 136. The linear insert 188 is received within the channel 131, 151 of the respective leg member 121*a*, 141*a* and has an opening 189 for receiving the connector 180. The opening 189 is operable to adjust the location of the connector 180. As shown in FIG. 18, each table surface 116, 136 has a second cutout 192 formed in the underside surface of the respective first surface portion 116*a*, 136*a* for receiving and moving with the guide track 178.

Referring back to FIGS. 14 to 17, a method of configuring the table 110 between a single-table configuration and a double configuration is described hereinbelow. If the table 110 is initially in the single-table configuration (FIG. 12), and configuring the table 110 into the double configuration (FIG. 13) is desired, the integrated table surface 150 and the integrated table base 160 are separated into two table portions 112, 132. They are separated by pulling the table surfaces 116, 136 and, thus, the table bases 114, 134 apart from one another. The hinges 124*a*, 124*b*, 144*a*, 144*b* are thereby removed from the respective pockets 145*a*, 145*b*, 125*a*, 125*b*.

Figure 16:
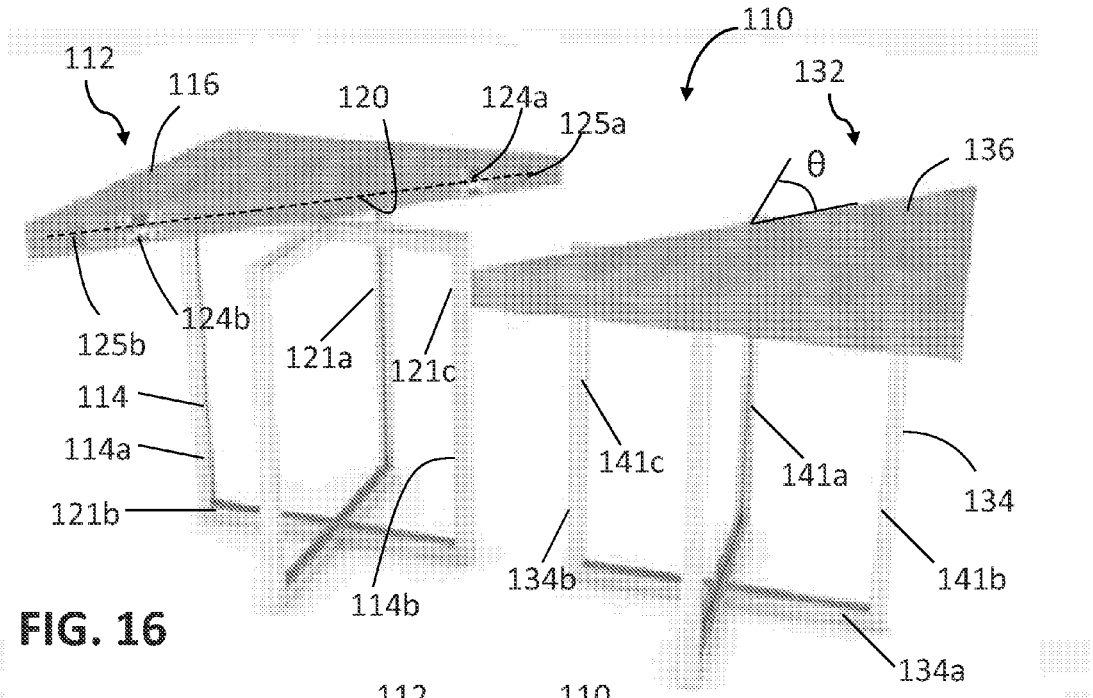
Figure 25:
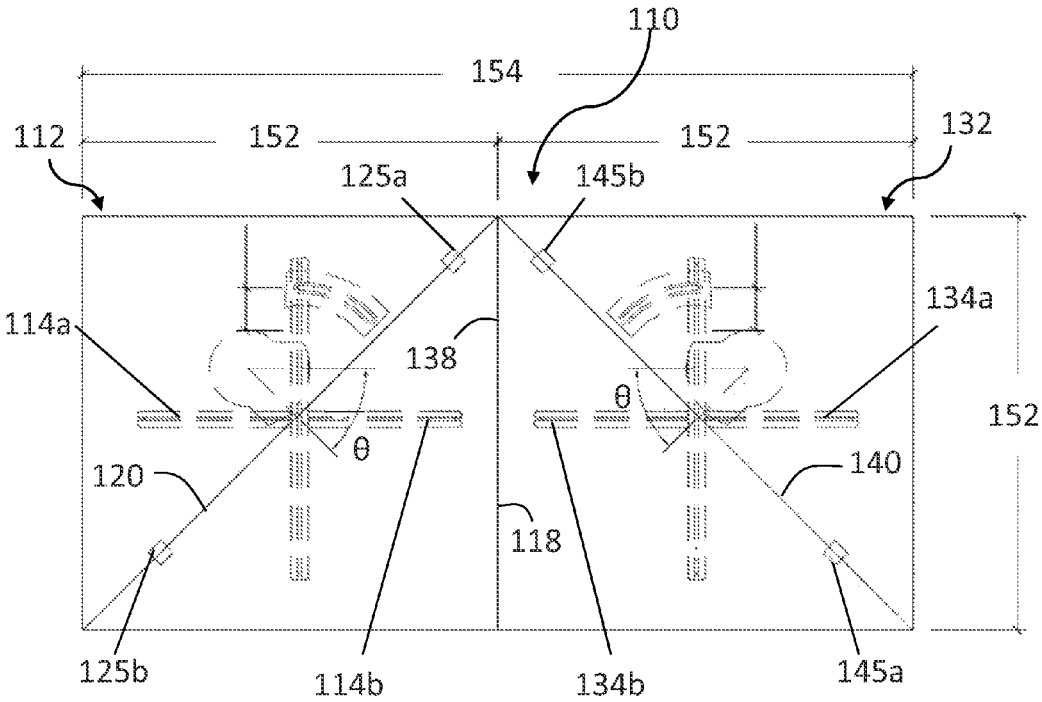
FIG. 25 is a top plan and partially hidden view of the configurable table of FIG. 12 in the double-table configuration.
Figure 26:
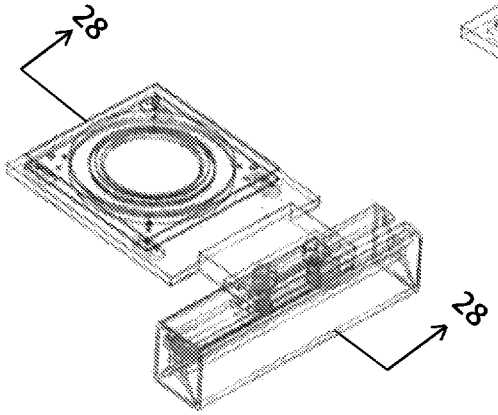
FIG. 26 is a perspective and hidden view of part of a table rotation assembly of the configurable table of FIG. 12.
Figure 27:
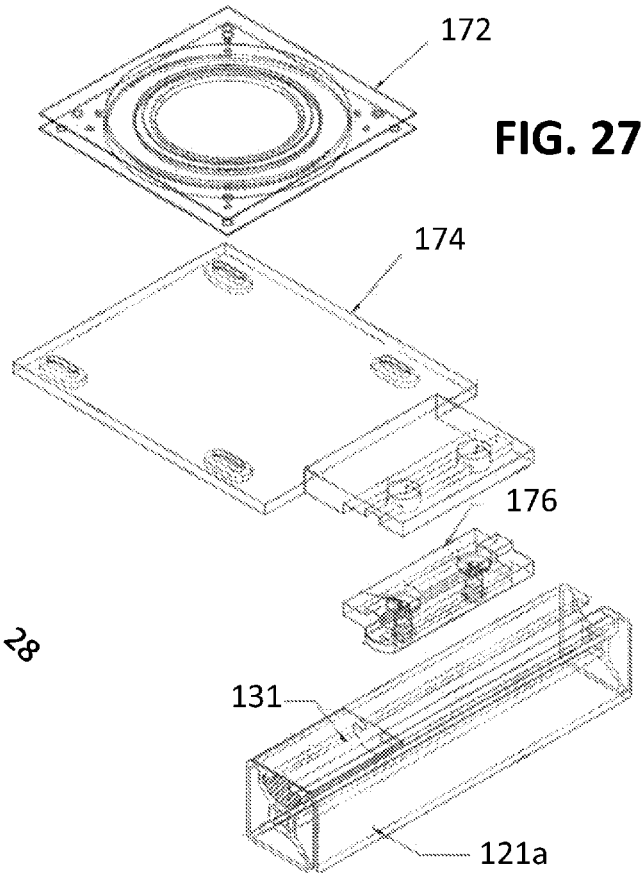
FIG. 27 is an exploded view of the part of FIG. 26.
Figure 28:
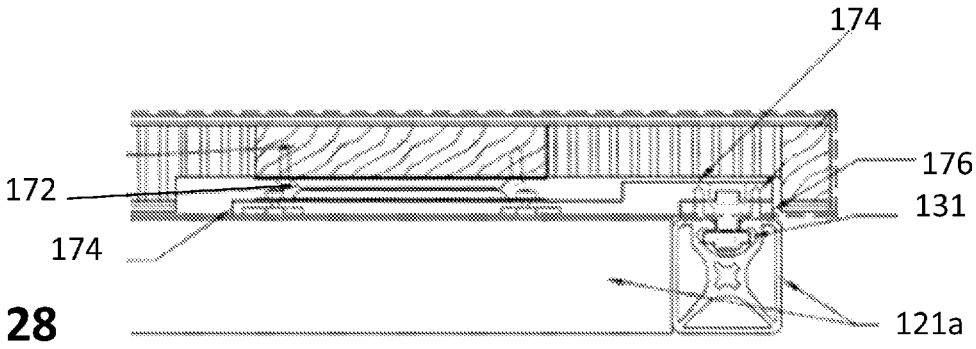
FIG. 28 is a fragmentary, cross-sectional view of the part of FIG. 26 taken along section line 28-28 in FIG. 26.
Figure 32:
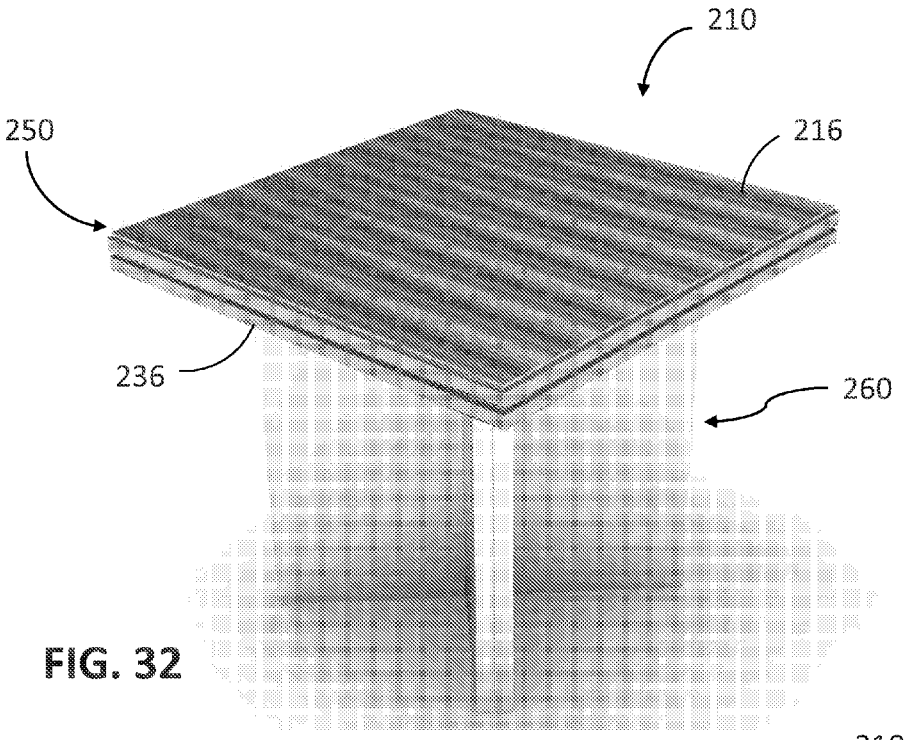
FIG. 32 is a perspective view of a configurable table in a single-table configuration, according to another exemplary embodiment of the present invention.

As illustrated in FIG. 14, the table surfaces 116, 136 of the separated table portions 112, 132 are initially in the folded state and the table bases 114, 134 are initially in the nested arrangement when pulled apart from one another. In FIG. 15, the table bases 114, 134 are moved from the nested arrangement to the non-nested arrangement by rotating the second base portions 114*b*, 134*b* (i.e., the leg members 121*c*, 141*c*) away from the respective first base portions 114*a*, 134*a*. As shown in FIG. 15, the folded table surfaces 116, 136 are initially only supported by the respective first base portions 114*a*, 134*a*, i.e., only leg members 121*a*, 121*b* and 141*a*, 141*b* of respective first base portions 114*a*, 134*a*. Referring next to FIG. 16, the folded table surfaces 116, 136 are rotated relative to the respective table bases 114, 134 so that they are supported by only a portion of the respective first base portions 114*a*, 134*a*. As shown in FIG. 16, the rotated folded table surfaces 116, 136 are supported by respective leg members 121*b*, 141*b* and only a portion of respective leg members 121*a*, 141*b*. The table surfaces 116, 136 are rotated through an angle θ, as illustrated in FIGS. 16 and 25. Angle θ is up to approximately 45 degrees but, in particular, is at 45 degrees. As the table surfaces 116, 136 are rotated, the connector 180 acts in conjunction with the guide track 178 and turntable and linear bearings 172, 176 to pull the table surfaces 116, 136 along the axis of one of the leg members and center the table surfaces 116, 136 on the leg members.

Figure 19:
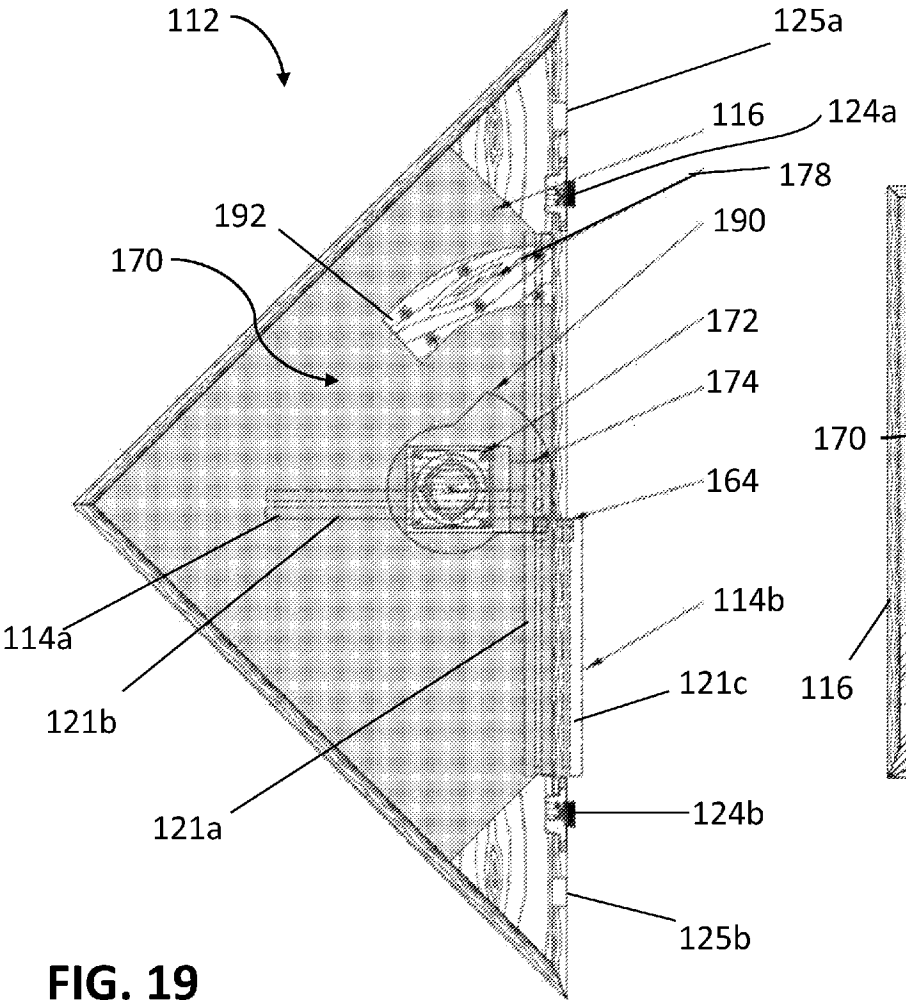
FIG. 19 is a top plan view of one table portion of the configurable table of FIG. 12, shown in an intermediate step between the single configuration and the double configuration.
Figure 21:
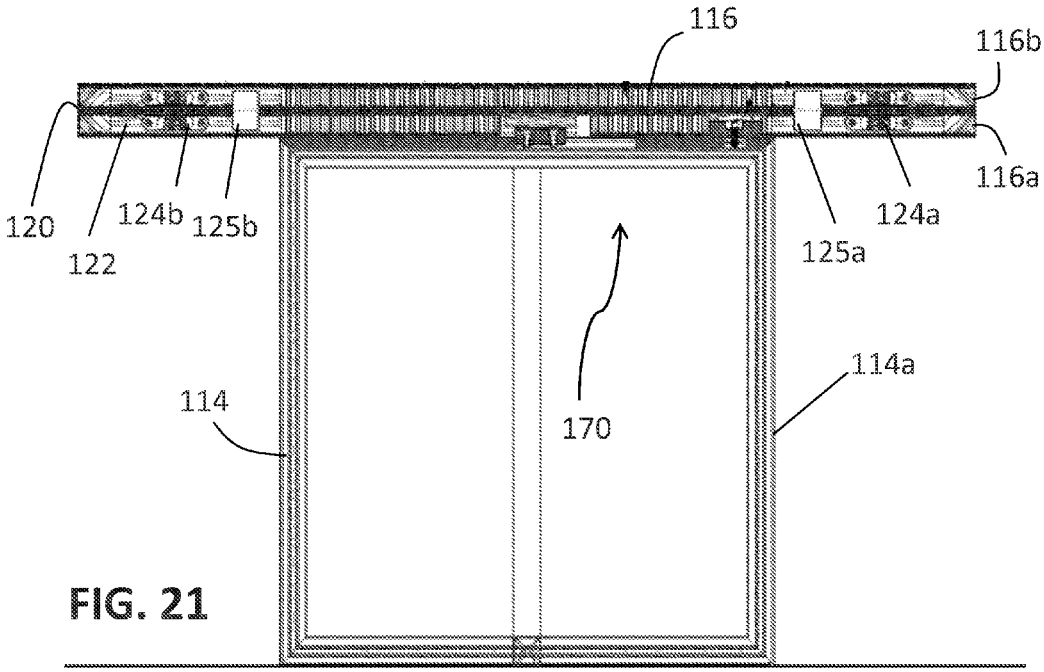
FIG. 21 is a side elevational view of FIG. 19.
Figure 22:
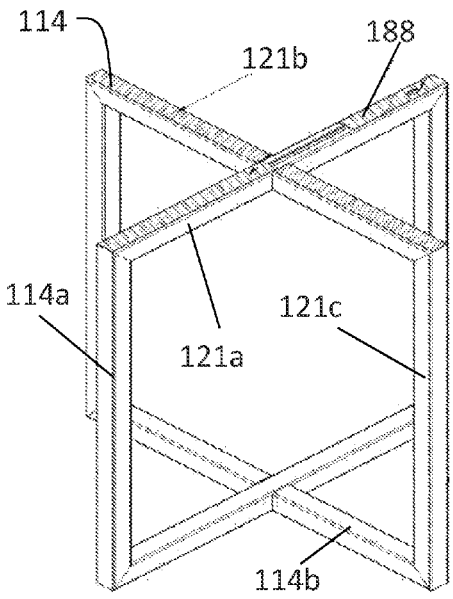
FIG. 22 is a perspective view of the table base of the table portion of FIG. 21 in the double-table configuration.
Figure 23:
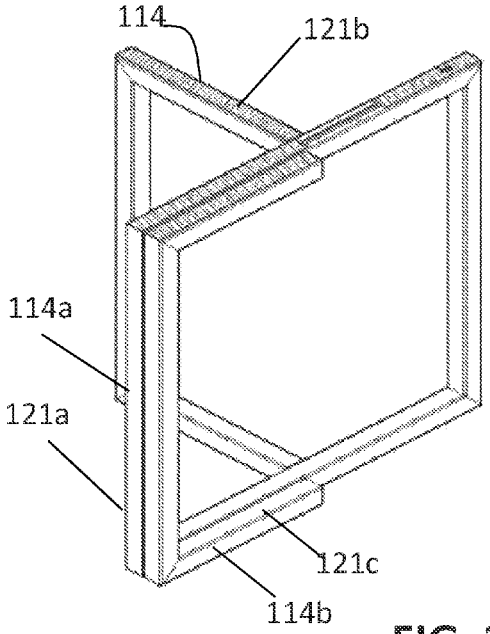
FIG. 23 is a perspective view of the table base of the table portion of FIG. 21 in the single-table configuration.

FIGS. 19 and 20 illustrate the mechanics of the table surface rotation with respect to the first table portion 112, which has been separated from the second table portion 132, and which description also applies to the second table portion 132 (not shown). In FIG. 19, the folded table surface 116 is initially supported by the first base portion 114*a* in the nested arrangement. As shown, the folded table surface 116 is supported by leg member 121*a* and leg member 121*b*. In FIG. 20, the table base 114 has been moved to the non-nested arrangement and the table surface 116 has been rotated and unfolded. As shown, the turntable bearing 172 has rotated and the guide track 178 has moved from the first position in FIG. 19 to the second position in FIG. 20.

Figure 17:
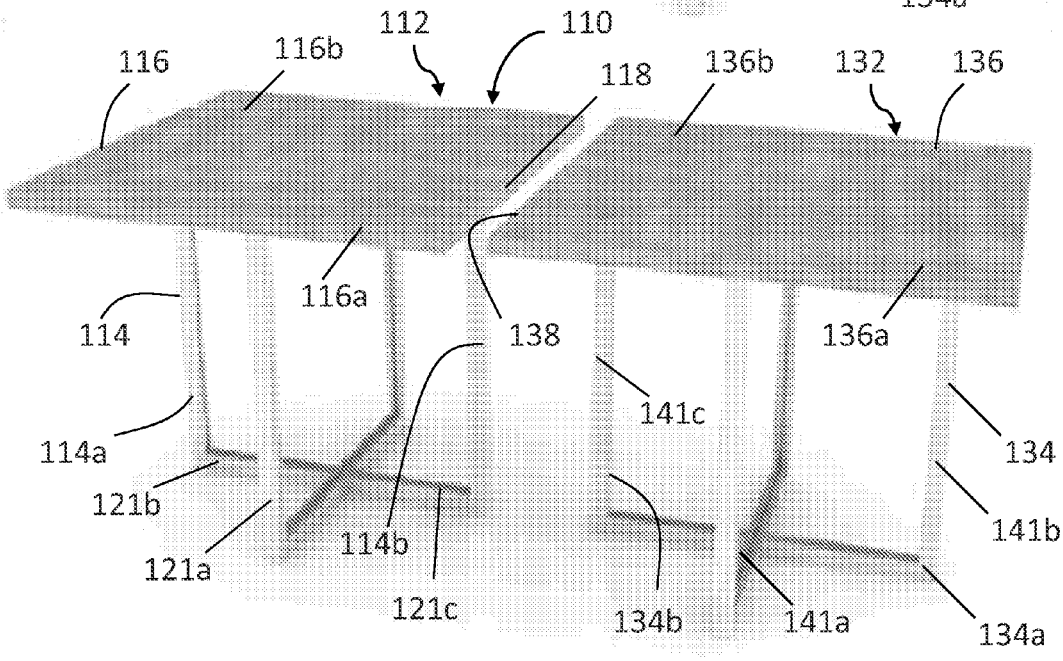
Figure 18:
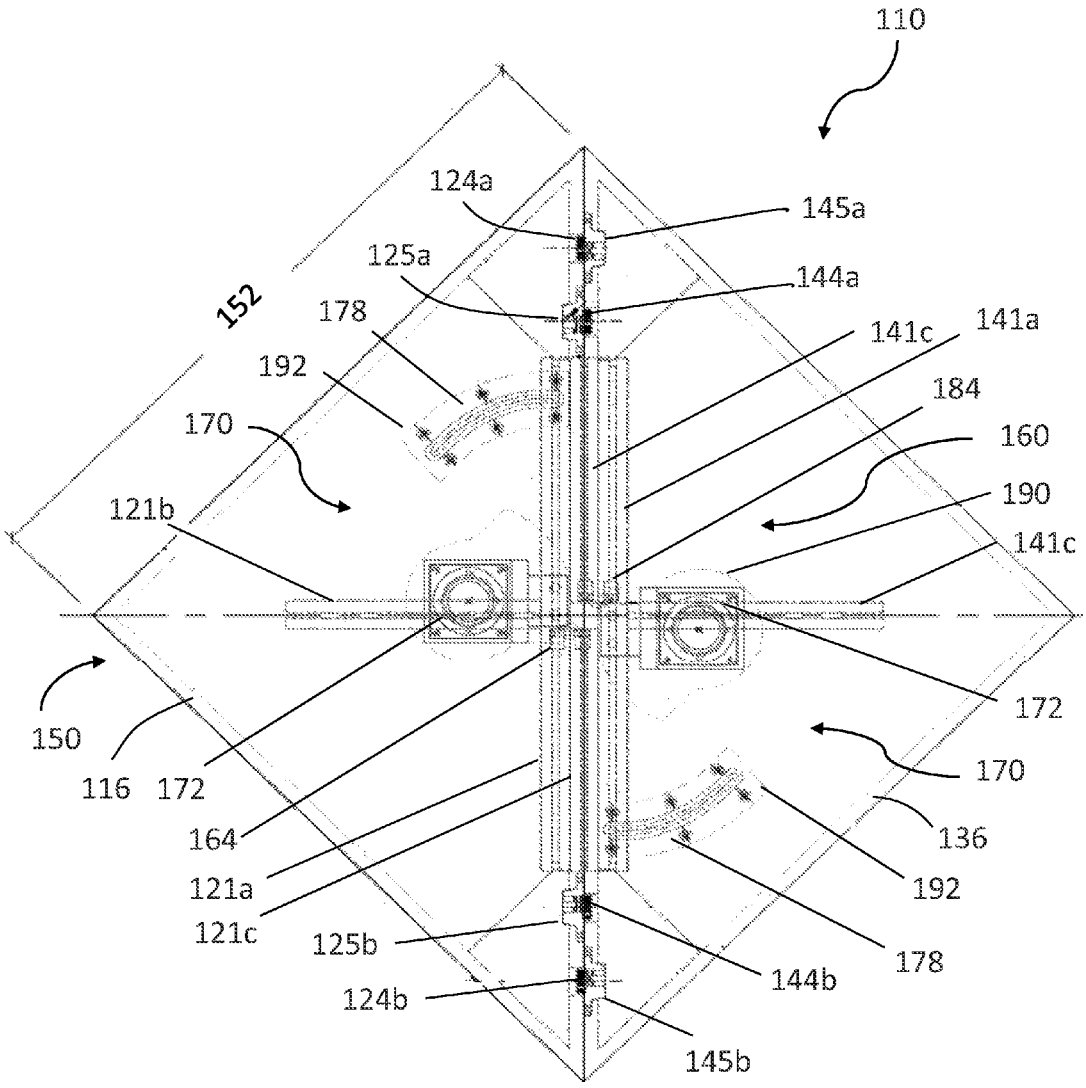
FIG. 18 is a top plan and partially hidden view of the configurable table of FIG. 12 in the single-table configuration.
Figure 24:
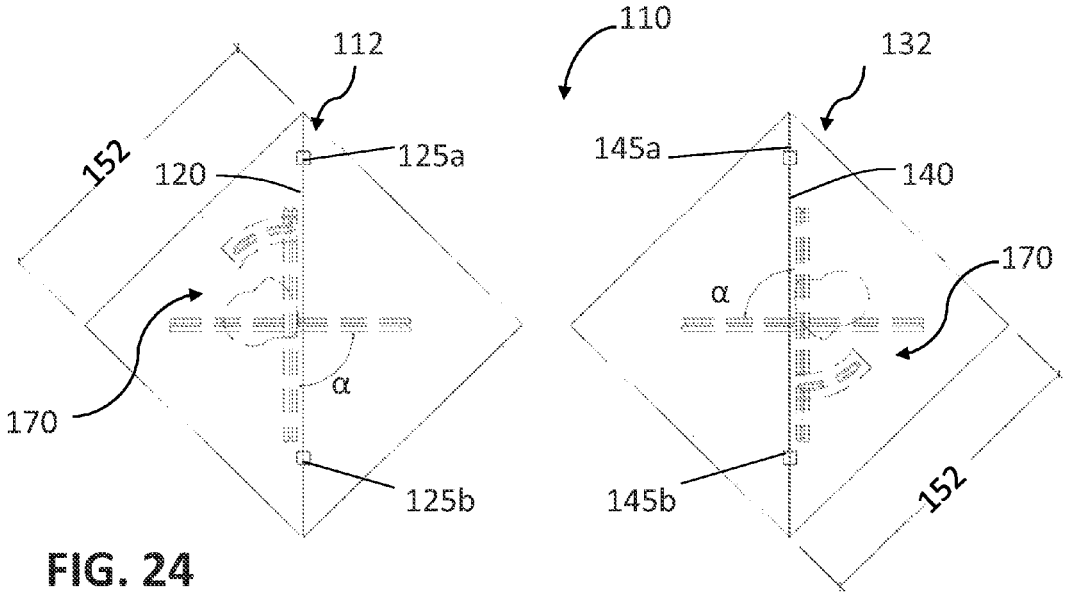
FIG. 24 is a top plan and partially hidden view of the configurable table of FIG. 12 in a separated double-table configuration.

After rotation of the table surfaces 116, 136 relative to the respective bases 114, 134, the table surfaces 116, 136 are moved from the folded state to the unfolded state by unfolding the second surface portions 116*b*, 136*b* from the respective first surface portions 116*a*, 136*a*, as depicted in FIGS. 17 and 24 to 25. It is also within the scope of the present invention to first unfold the table surfaces 116, 136 before rotating the table surfaces 116, 136 relative to the table bases 114, 134, for example, as shown in FIG. 24.

FIGS. 13, 17, and 25 depict the configurable table 110 in the double-table configuration, in which the separate table portions 112, 132 include unfolded table surfaces 116, 136 supported by respective non-nested table bases 114, 134. The first surface portions 116*a*, 136*a* are supported by only a portion of the respective first base portions 114*a*, 134*a* (i.e., leg members 121*b*, 141*b* and a portion of leg members 121*a*, 141*a*) and the second surface portions 116*b*, 136*b* are supported by a portion of the respective first base portions 114*a*, 134*a* and by the second base portions 114*b*, 134*b* (i.e., leg members 121*c*, 141*c* and a portion of leg members 121*a*, 141*a*). The table portions 112, 132 may be positioned separately, for example, as depicted in FIGS. 17, for individual use. Alternatively, as shown in FIGS. 13 and 25, the table portions 112, 132 may be positioned in a side-by-side arrangement, wherein a side edge 118 of the first table surface 116 is positioned immediately adjacent to and engages a side edge 138 of the second table surface 136.

In this embodiment, the table 110 has a first length 152 in the single-table configuration (FIG. 12) and a second length 154 in the side-by-side double-table configuration (FIG. 25). The first length 152 is defined by the length of the integrated table surface 150 in the single-table configuration, wherein the second length 154 is defined by the combined lengths 152 of the table surfaces 116, 136 of each respective table portion 112, 132. In this particular embodiment, the length 152 of each table surface 116, 136 is the same as the first length 152 of the integrated table surface 150. This is because the table surfaces 116, 136 are square-shaped (the respective fold lines 120, 140 being the lines of symmetry for each square table surface 116, 136) and have substantially the same dimensions. This is not necessarily the case for table surfaces 116, 136 having different shapes and dimensions. For example, the table surfaces 116, 136 may be circular, ovular, rectangular, or triangular in shape. The table surfaces 116, 136 may take on other alternative shapes, but preferably one that is substantially symmetrical (wherein the fold line is the line of symmetry of the table surface) to provide ease in configuring the table surfaces 116, 136 between the folded and unfolded states, i.e., between the single and double-table configurations.

To configure the table 110 from the double-table configuration back into the single-table configuration, the table surfaces 116, 136 are returned to their folded states by folding the second surface portions 116*b*, 136*b* back upon the respective first surface portions 116*a*, 136*a*. The table surfaces 116, 136 are, then, rotated back to their initial position, wherein each is entirely supported by the respective first base portions 114*a*, 134*a*. The table bases 114, 134 are then moved from the non-nested arrangement to the nested arrangement by rotating the second base portions 114*b*, 134*b* back towards the respective first base portions 114*a*, 134*a* to place the leg members 121*c*, 141*c* in a side-by-side arrangement with a portion of the respective leg members 121*a*, 141*a*. The first and second table portions 112, 132 are, then, with the table bases 114, 134 in the nested arrangement and the table surfaces 116, 136 in the folded state, moved toward one another to align the opposing fold edges 122, 142 of respective table surfaces 116, 136, to align a portion of the first base portion 114*a* of the table base 114 (i.e., a portion of leg member 121*a*) with the second base portion 134*b* of the opposing table base 134 (i.e., leg member 141*c*), and to align a portion of the first base portion 134*a* of the table base 134 (i.e., a portion of leg member 141*a*) with the second base portion 114*b* of the opposing table base 114 (i.e., leg member 121*c*). The hinges 124*a*, 124*b* and 144*a*, 144*b* of the table surfaces 116, 136 are respectively received within the pockets 125*a*, 125*b* and 145*a*, 145*b* of the opposing table surface 116 or 136 to mate the first and second table portions 112, 132 together to form the integrated table base 160 and the integrated table surface 150.

Figure 33:
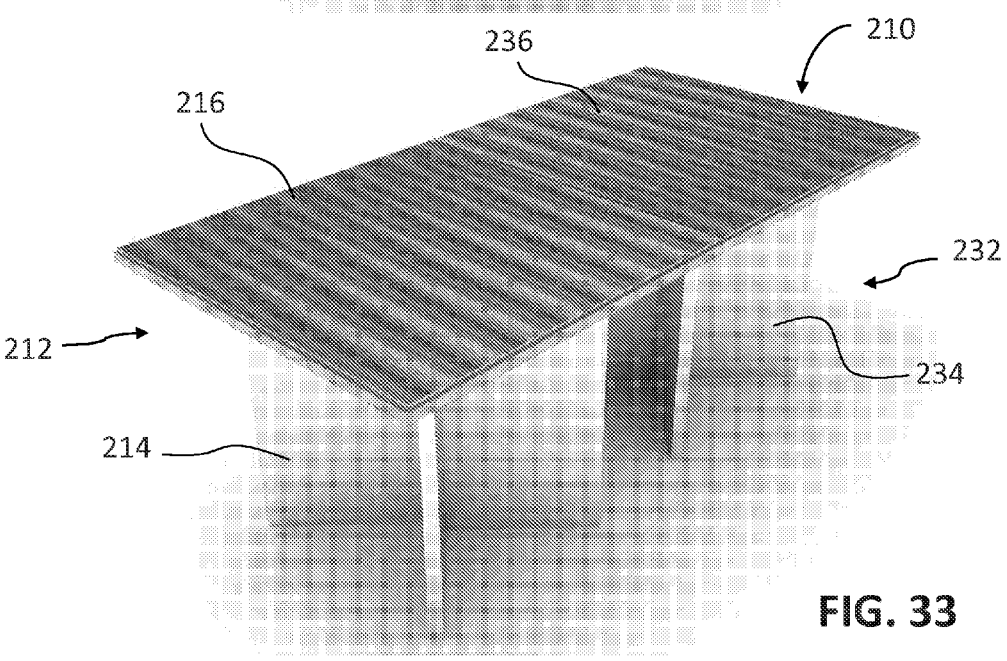
FIG. 33 is a perspective view of the configurable table of FIG. 32 in a double-table configuration.
Figure 37:
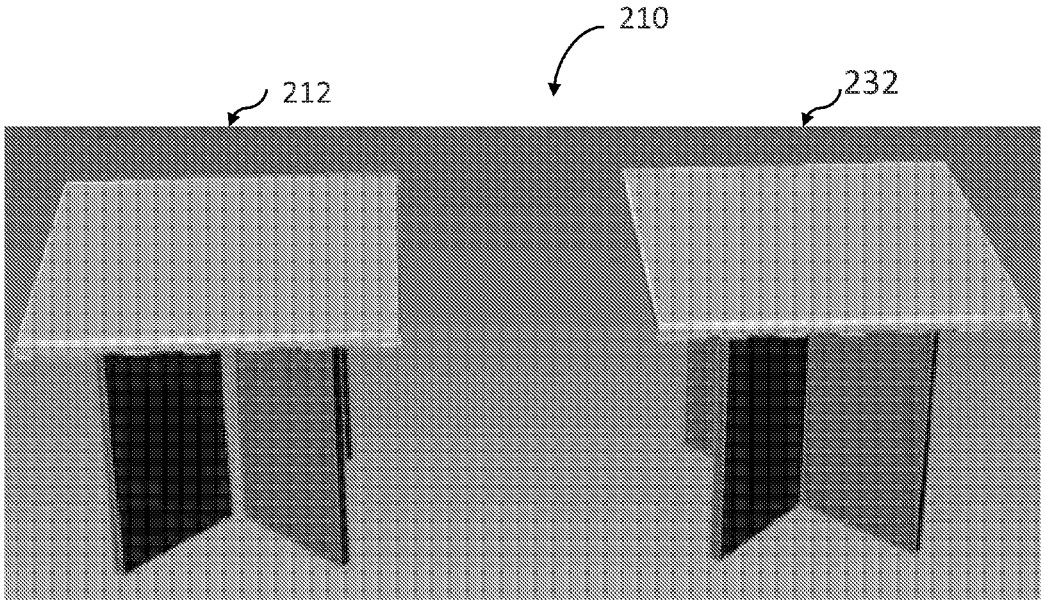
FIGS. 37 to 38 are additional perspective views of the configurable table of FIG. 32 in two different double-table configurations.
Figure 38:
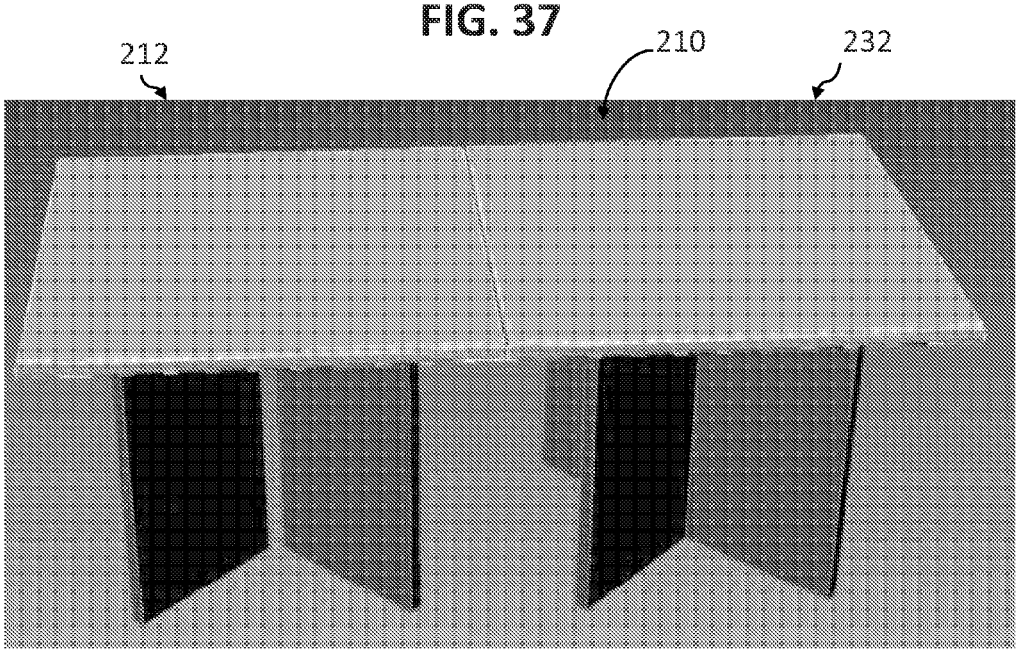
Figure 39:
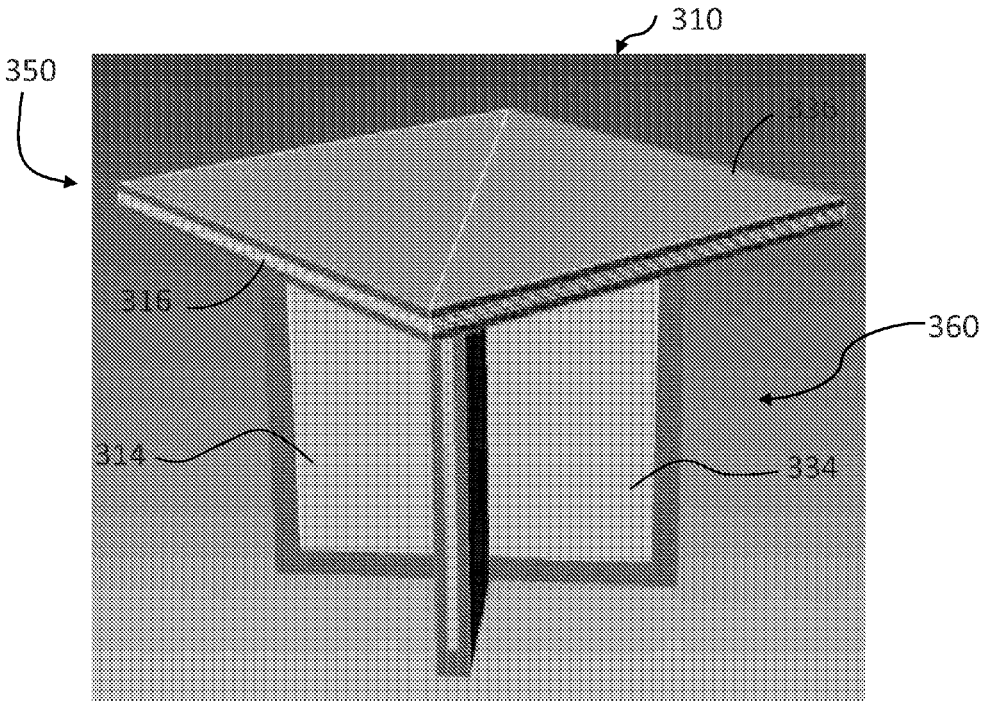
FIG. 39 is a perspective view of a configurable table in a single-table configuration, according to yet another exemplary embodiment of the present invention.

Referring to FIGS. 32 to 38, there is shown another exemplary embodiment of a configurable table 210 movable between a single-table configuration (FIG. 32) and a double-table configuration (FIGS. 33, 37, and 38). In the single-table configuration of FIG. 32, the configurable table 210 includes an integrated table surface 250 supported by an integrated table base 260. The integrated table base includes two table bases 214, 234 mated together and the integrated table surface 250 includes two table surfaces 216, 236, one table surface 216 on top of the other table surface 236. The table surface 216 may be held in place atop the table surface 236 by any suitable mechanical attachment mechanism known or contemplated in the art that does not impair either table surface 216, 236 when used in the double-table configuration. Alternatively, the table surface 216 may remain in place atop the table surface 236 in the single-table configuration merely by its own weight. In the double-table configuration of FIG. 33, the configurable table 210 includes two separate table portions 212, 232. Separation of the integrated table surface 250 (i.e., the two table surfaces 216, 236) and the integrated table base 260 (i.e., the two table bases 214, 234) into the two separate table portions 212, 232 is illustrated in the progression from FIGS. 34 to 38 and described in greater detail below.

Figure 34:
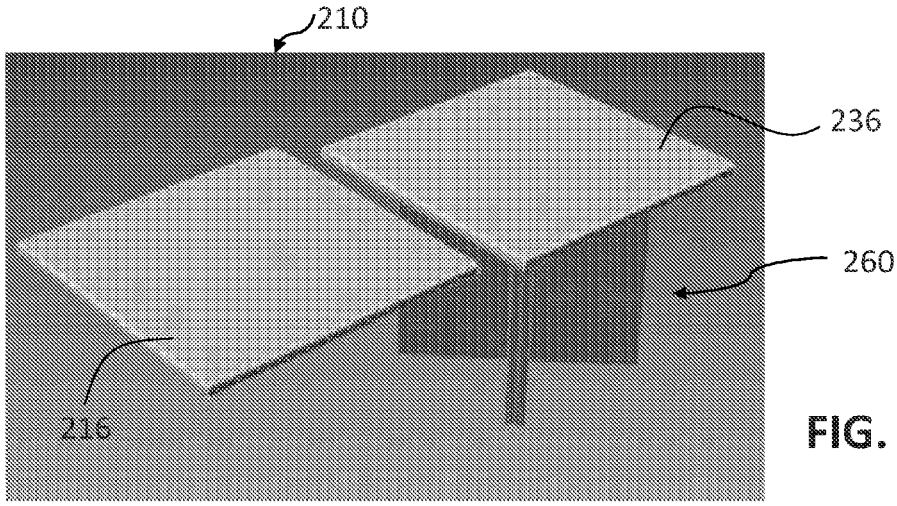
FIGS. 34 to 36 are perspective views of the configurable table of FIG. 32, each depicting a different stage in the configuration of the table between the single-table configuration and the double-table configuration.
Figure 35:
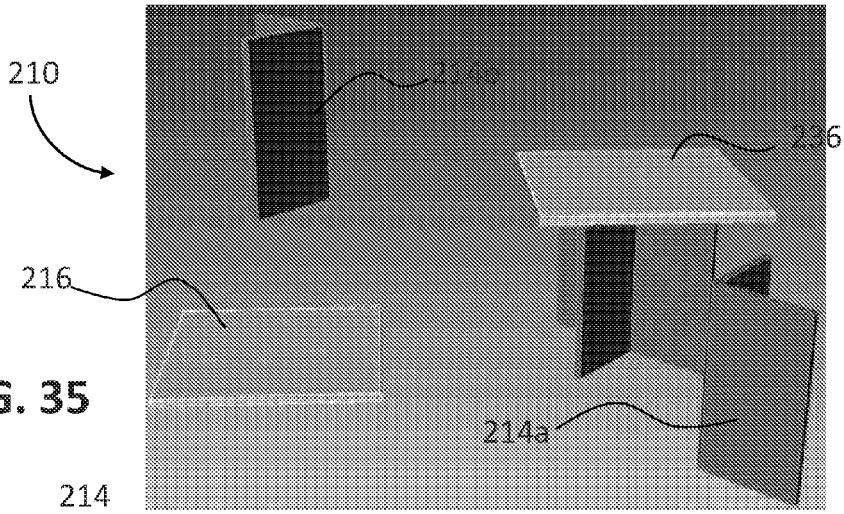
Figure 36:
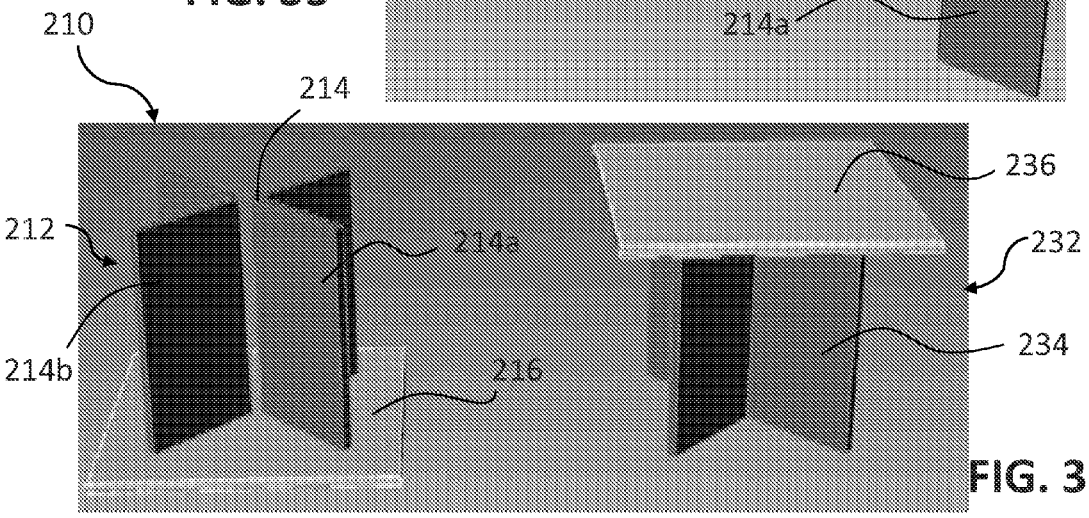

As shown in FIG. 34, the top table surface 216 is separated or removed from the bottom table surface 236 and the table base 214 is removed, in two separate portions 214*a*, 214*b* from the table base 234. In one exemplary embodiment, the table surface 216 merely rests upon the two separate table portions 214*a*, 214*b* of the table base 214 to form the separate table portion 212. In another exemplary embodiment, the table surface 216 may be mechanically, removably attached to the table portions 214*a*, 214*b* of the table base 214 by any conventional measures known or contemplated in the art. The remaining table surface 236 and table base 234 form the other separate table portion 232. These table portions 212, 232 may be used as separate tables, as shown in FIG. 37, or they may be pushed together to form a longer table 210. Since the table surfaces 216, 236 have the same size and shape, the configurable table 210 in the double-table configuration has a length two times the length of the configurable table 210 in the single-table configuration.

Figure 40:
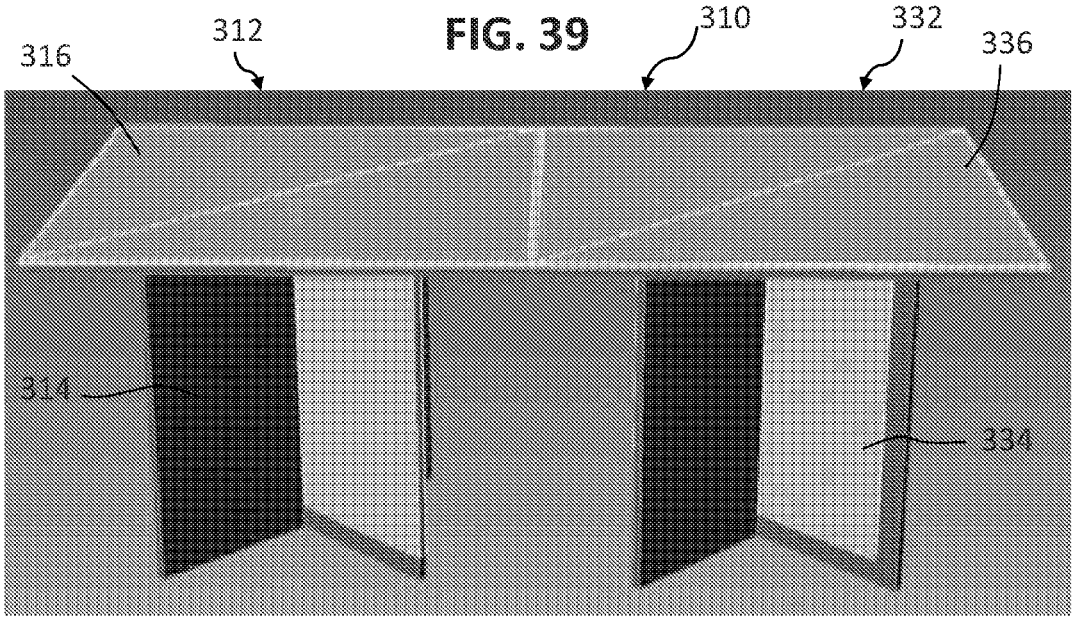
FIG. 40 is a perspective view of the configurable table of FIG. 39 in a double-table configuration.
Figure 41:
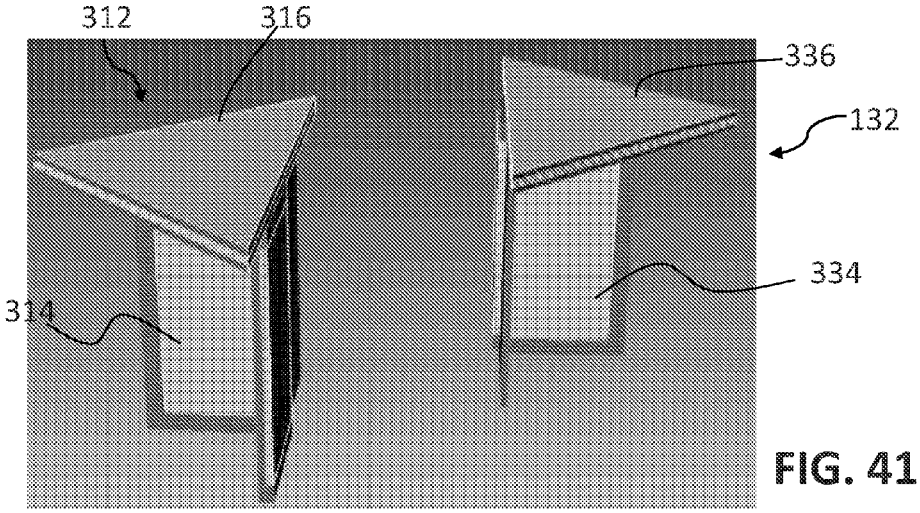
FIGS. 41 to 44 are perspective views of the configurable table of FIG. 39, each depicting a different stage in the configuration of the table between the single-table configuration and the double-table configuration.
Figure 42:
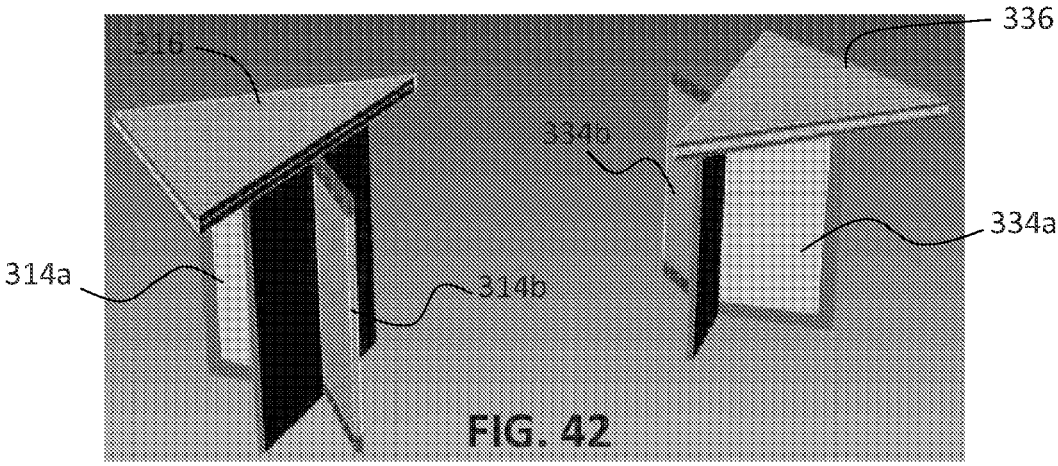
Figure 43:
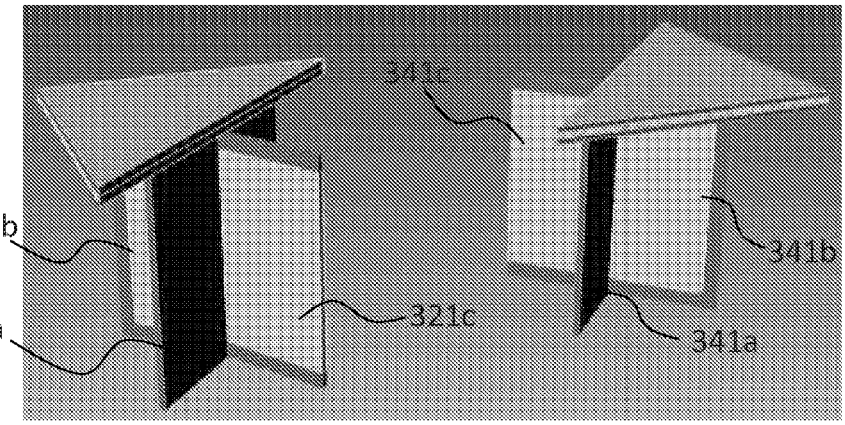
Figure 44:
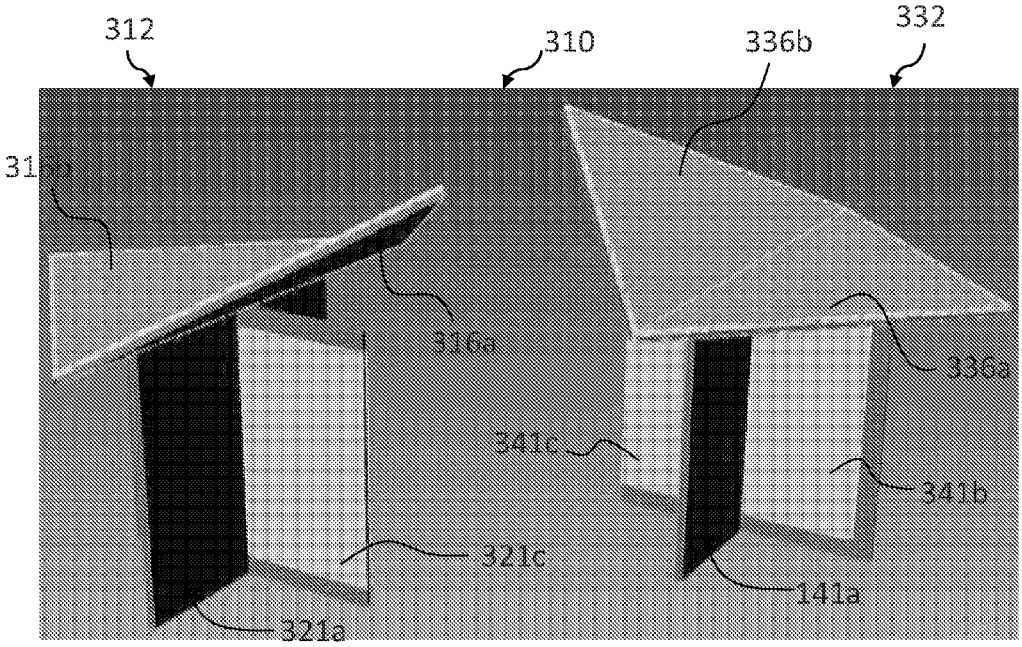
Figure 45:
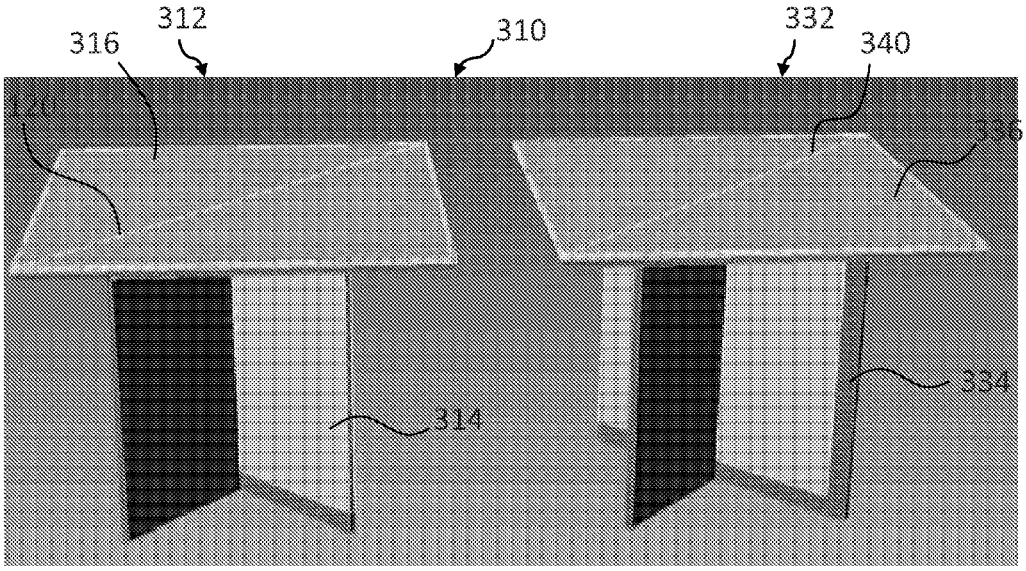
FIG. 45 is another perspective view of the configurable table of FIG. 39 in a different orientation of the double-table configuration.
Figure 46:
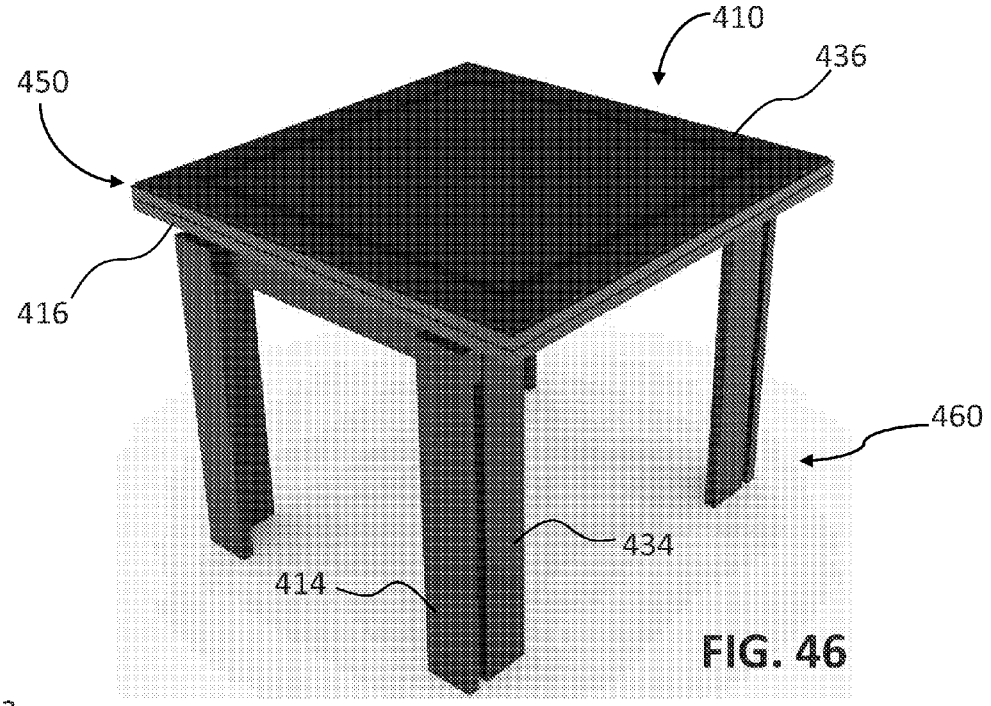
FIG. 46 is a perspective view of a configurable table in a single-table configuration, according to a further exemplary embodiment of the present invention.

Referring to FIGS. 39 to 45, there is shown another exemplary embodiment of a configurable table 310 movable between a single-table configuration (FIG. 39) and a double-table configuration (FIGS. 40 and 45). The configurable table 310 is similar to the configurable table 110 of FIGS. 12 to 25, wherein similar reference numbers increased by 200 refer to similar parts. However, the table leg members 321*a*, 321*b*, 321*c* and 341*a*, 341*b*, 341*c* in this exemplary embodiment are planar panels rather than U-shaped bars. Another difference between the configurable tables 110 and 310 is that the configurable table 310 does not have a table surface rotation assembly and, thus, the table surfaces 316, 336 do not rotate relative to the table bases 314, 334. The table surfaces 316, 336 merely unfold, as shown in FIG. 44, during configuration to the double-table configuration.

Referring to FIGS. 46 to 54, there is shown another exemplary embodiment of a configurable table 410 movable between a single-table configuration (FIG. 46) and a double-table configuration (FIGS. 47 and 52 to 54). In the single-table configuration of FIG. 46, the configurable table 410 includes an integrated table surface 450 supported by an integrated table base 460. The integrated table base 460 includes two table bases 414, 434 mated together and the integrated table surface 450 includes two table surfaces 416, 436, one table surface 436 on top of the other table surface 416. The table surface 436 may be held in place atop the table surface 416 by any suitable mechanical attachment mechanism known or contemplated in the art that does not impair either table surface 416, 436 when used in the double-table configuration. Alternatively, the table surface 436 may remain in place atop the table surface 416 in the single-table configuration merely by its own weight. In the double-table configuration of FIG. 47, the configurable table 410 includes two separate table portions 412, 432. The separation of the integrated table surface 450 (i.e., the two table surfaces 416, 436) and the integrated table base 460 (i.e., the two table bases 414, 434) into the two separate table portions 412, 432, is illustrated in the progression from FIGS. 48 to 51 and described in greater detail below.

Figure 47:
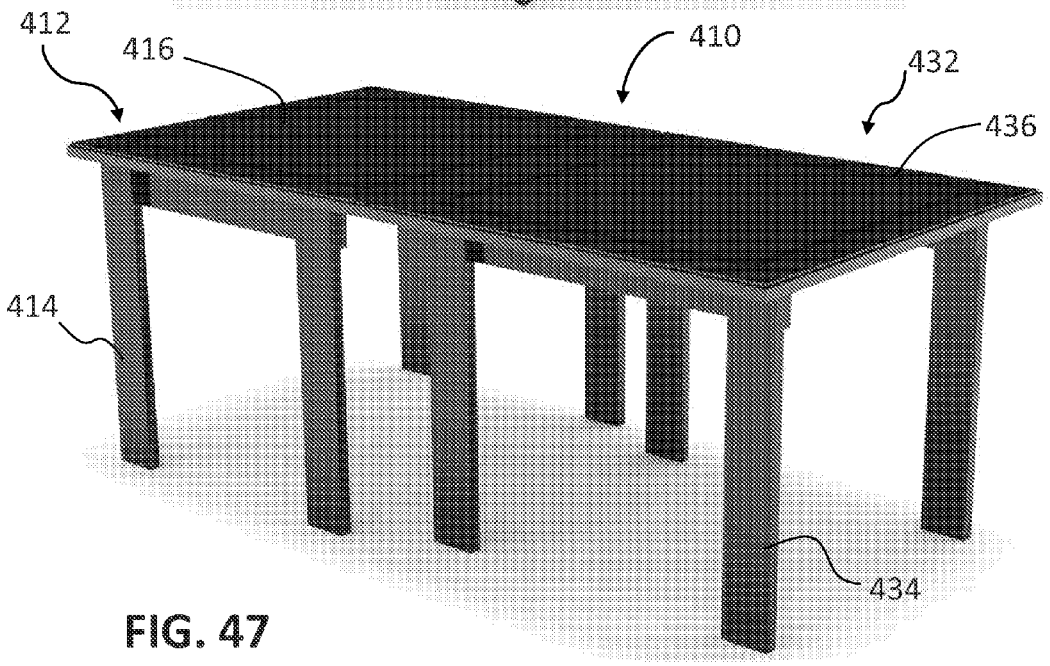
FIG. 47 a perspective view of the configurable table of FIG. 46 in a double-table configuration.
Figure 48:
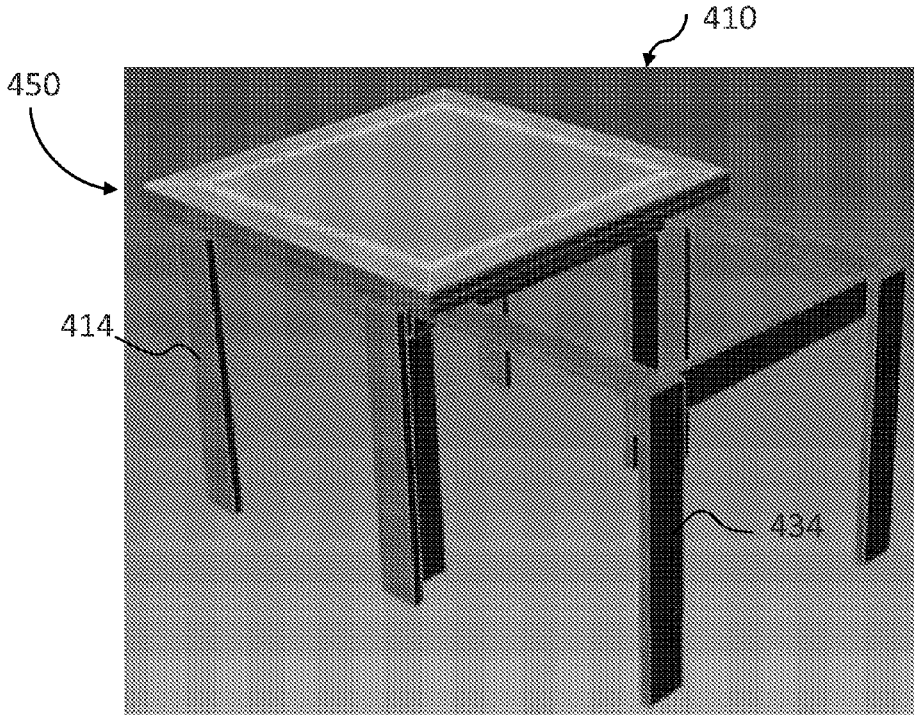
FIGS. 48 to 51 are perspective views of the configurable table of FIG. 46, each depicting a different stage in the configuration of the table between the single-table configuration and the double-table configuration.
Figure 49:
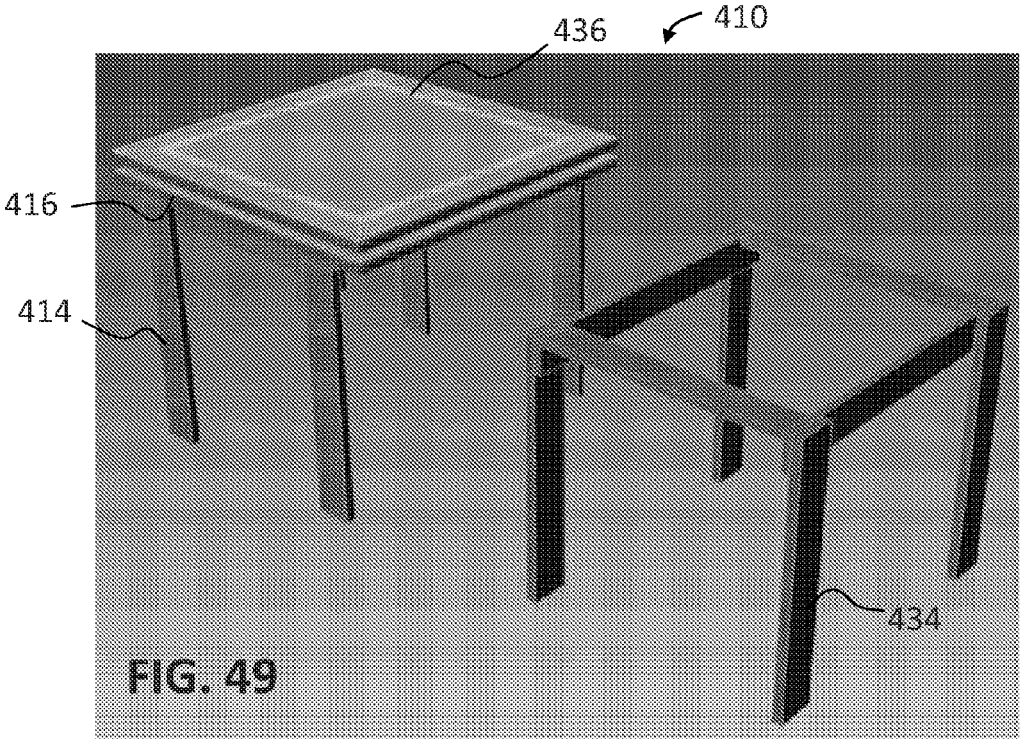
Figure 50:
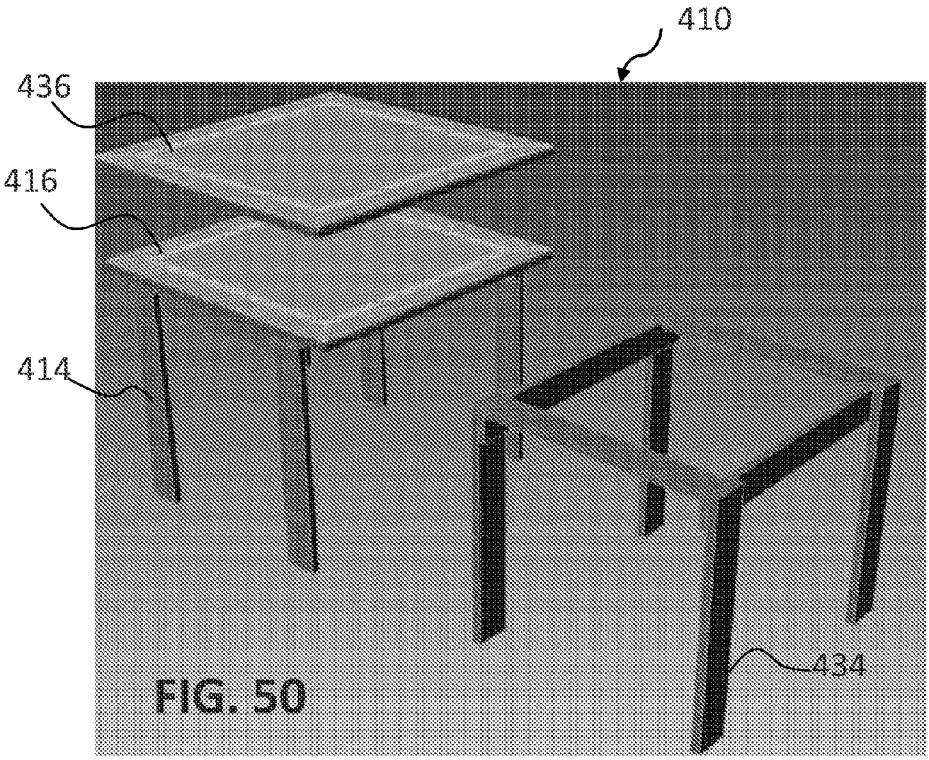
Figure 51:
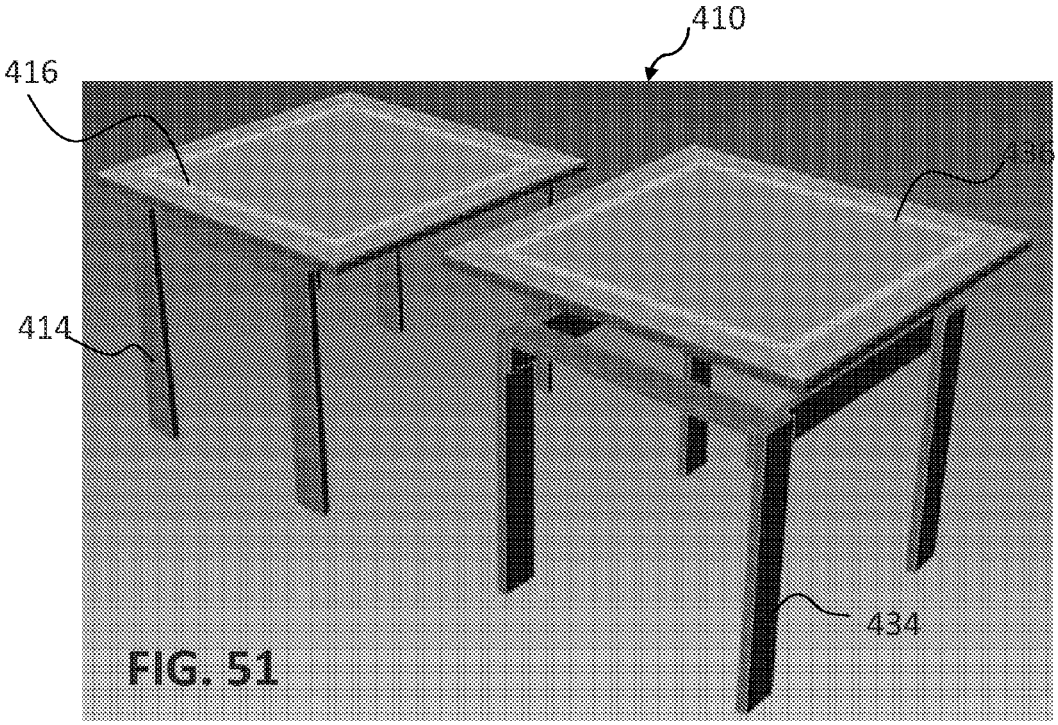
Figure 52:
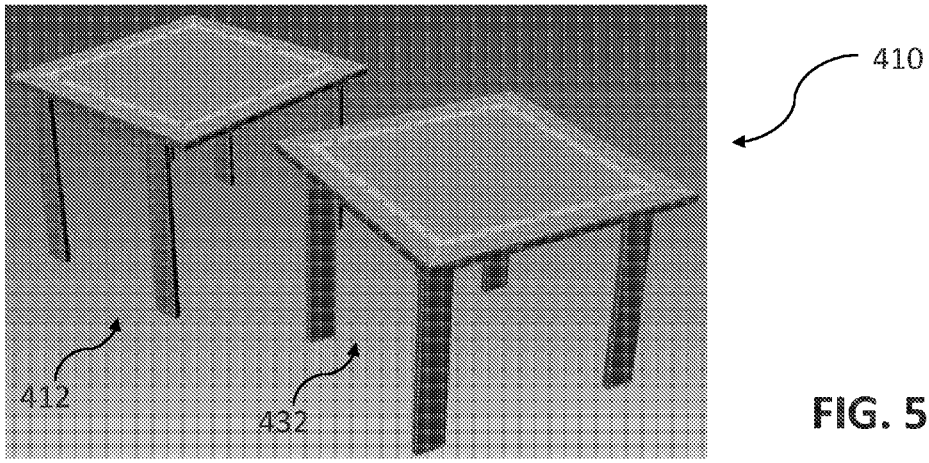
FIGS. 52 to 54 are additional perspective views of the configurable table of FIG. 46 in various different double-table configurations.
Figure 53:
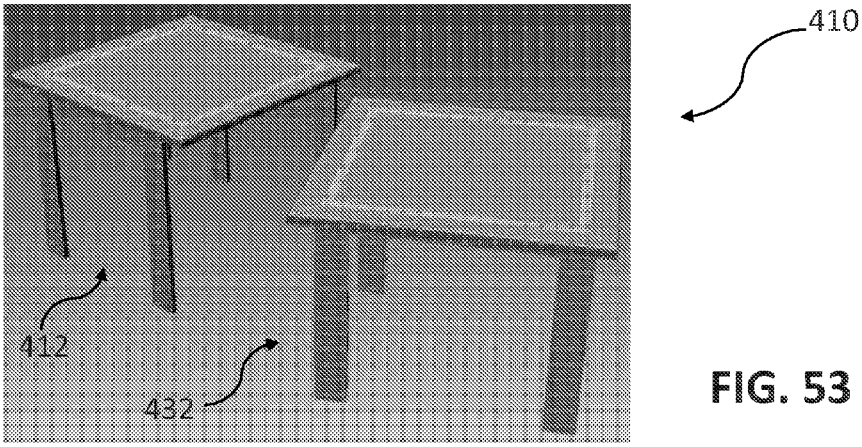
Figure 54:
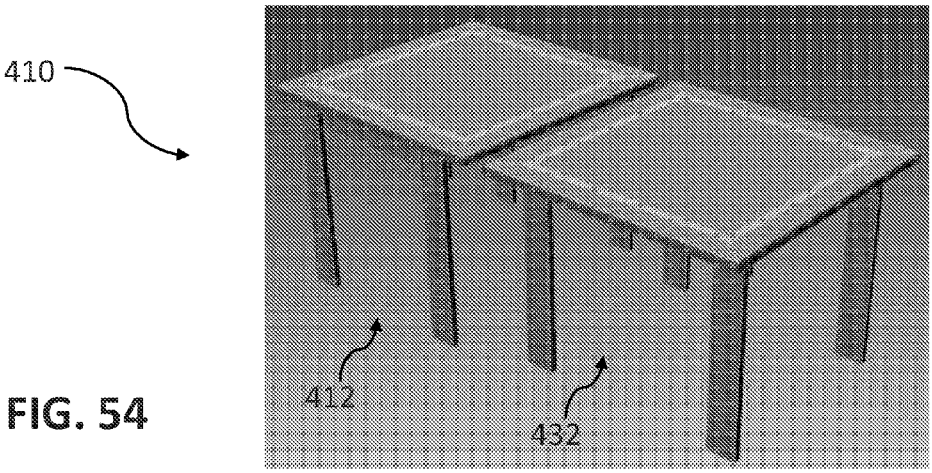
Figure 55:
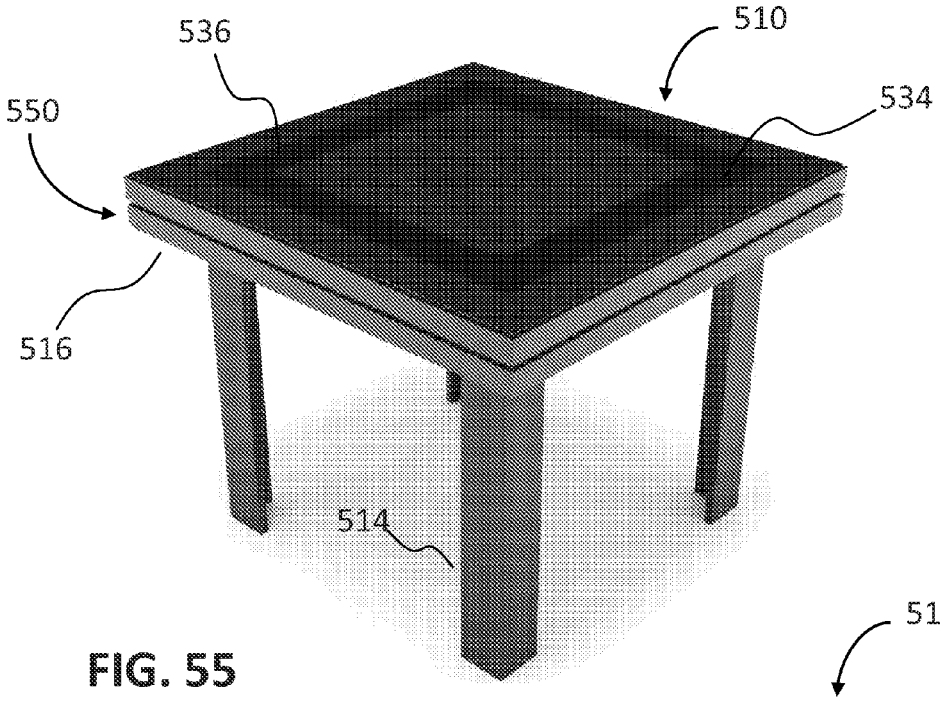
FIG. 55 is a perspective view of a configurable table in a single-table configuration, according to an even further exemplary embodiment of the present invention.

As shown in FIG. 48, the table base 434 is pulled away from the table base 414, and out from underneath the integrated table surface 450. Thereafter, as shown in FIGS. 49 to 50, the top table surface 436 is separated or removed from the bottom table surface 416. In one exemplary embodiment, each of the table surfaces 416, 436 merely rest upon a respective one of the table bases 414, 434, and remains in place thereon by its own weight, to form the separate table portions 412, 432. In another exemplary embodiment, each of the table surfaces 416, 436 may be mechanically, removably attached to a respective one of the table bases 414, 434 by any measures known or contemplated in the art. The separate table portions 412, 432 may be used as separate tables, as shown in FIGS. 52 to 54, or they may be pushed together to form a longer table 410, as shown in FIG. 47. Since the table surfaces 416, 436 have the same size and shape, the configurable table 410 in the double-table configuration has a length two times the length of the configurable table 410 in the single-table configuration.

Figure 56:
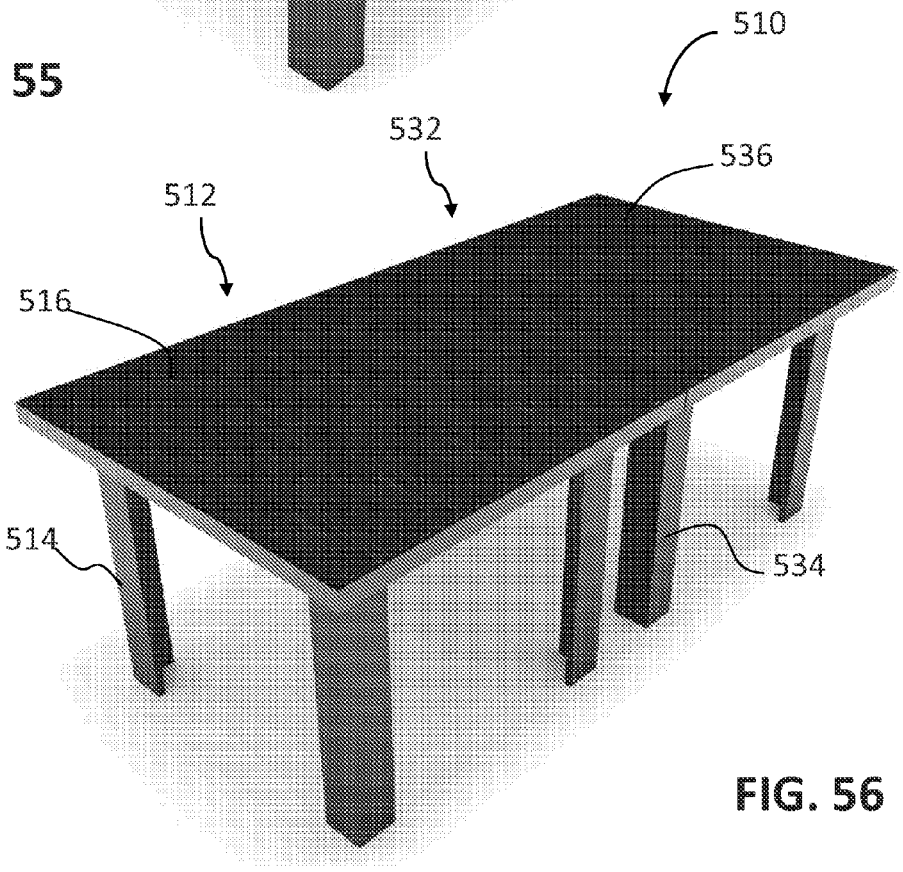
FIG. 56 a perspective view of the configurable table of FIG. 55 in a double-table configuration.
Figure 58:
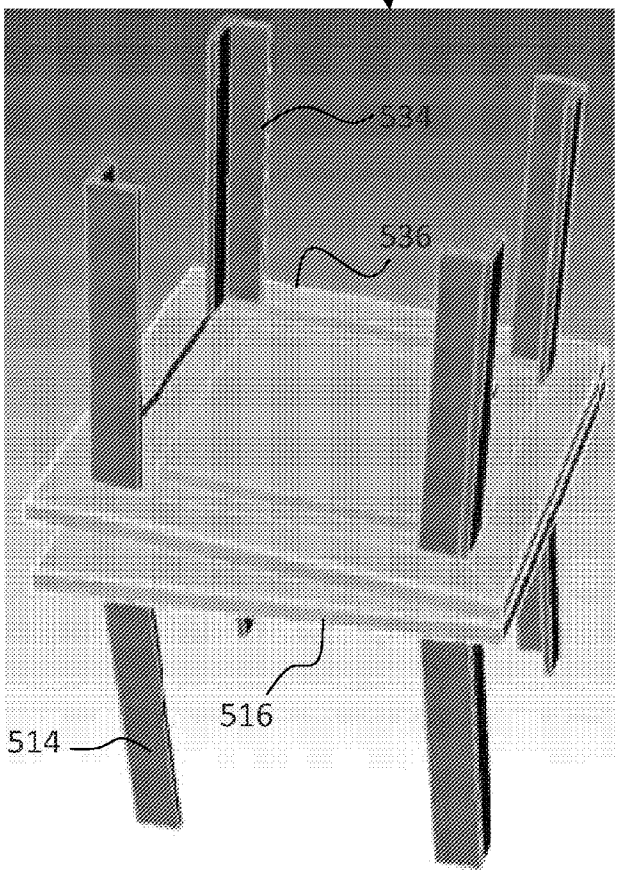
FIGS. 57 to 58 are perspective views of the configurable table of FIG. 55, each depicting a different stage in the configuration of the table between the single-table configuration and the double-table configuration.
Figure 59:
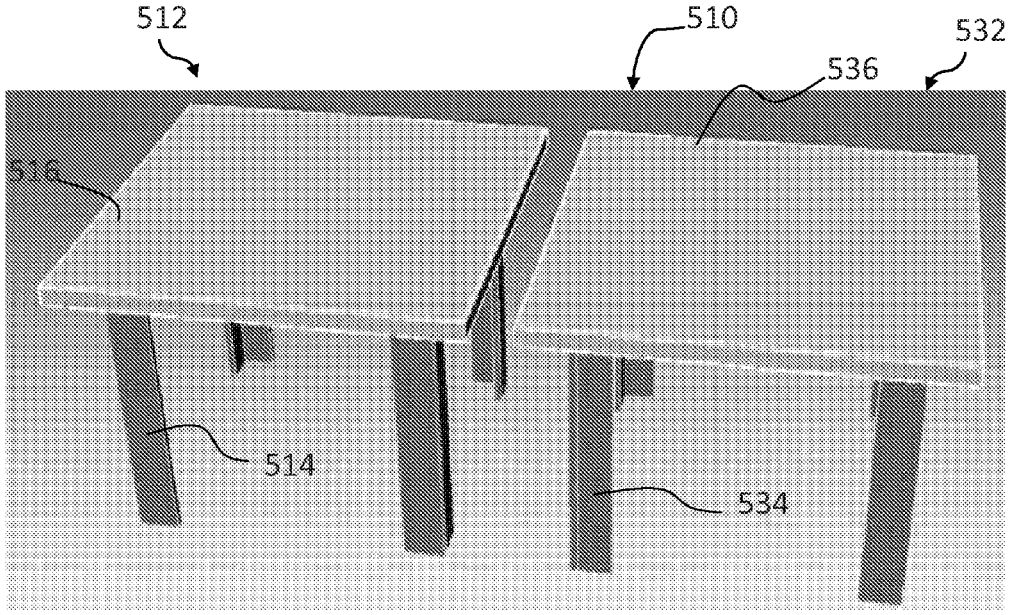
FIGS. 59 to 60 are additional perspective views of the configurable table of FIG. 55 in various different double-table configurations.
Figure 60:
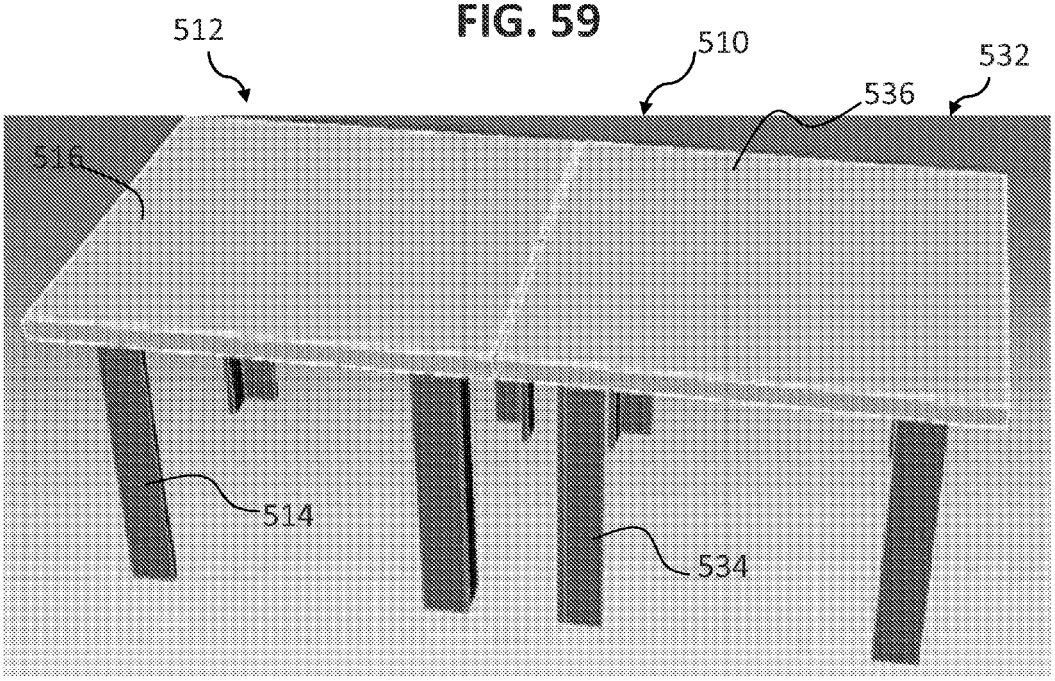
Figure 61:
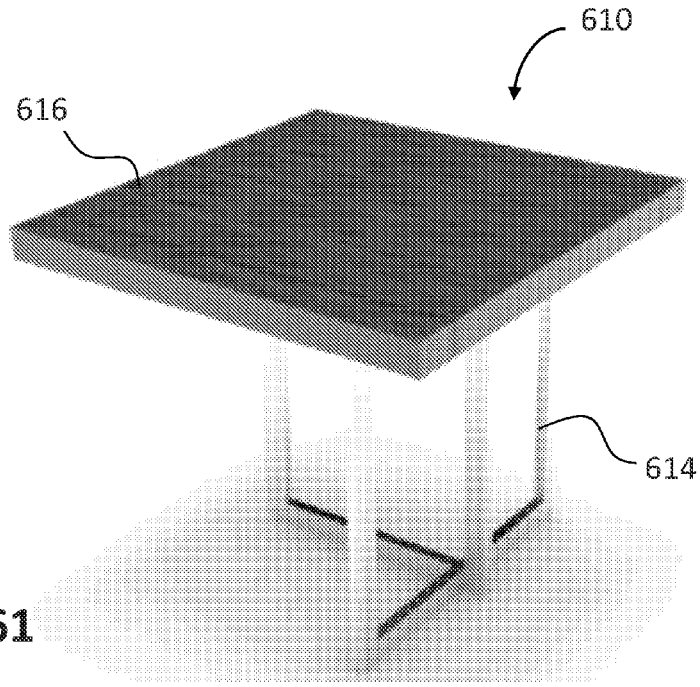
FIG. 61 is a perspective view of a configurable table in a single-table configuration, according to again another exemplary embodiment of the present invention.

Referring to FIGS. 55 to 60, there is shown another exemplary embodiment of a configurable table 510 movable between a single-table configuration (FIG. 55) and a double-table configuration (FIGS. 56, 59, and 60). In the single-table configuration of FIG. 55, the configurable table 510 includes an integrated table surface 550 supported by a table base 514 having four legs 521*a-d*. The integrated table surface 550 includes two table surfaces 516, 536, one table surface 536 on top of the other table surface 516. The table surface 536 may be held in place atop the table surface 516 by any suitable mechanical attachment mechanism known or contemplated in the art that does not impair either table surface 516, 536 when used in the double-table configuration. Alternatively, the table surface 536 may remain in place atop the table surface 516 in the single-table configuration merely by its own weight. In the double-table configuration of FIG. 56, the configurable table 510 includes two separate table portions 512, 532. The separation of the integrated table surface 550 (i.e., the two table surfaces 516, 536) and the formation of the two separate table portions 512, 532, is illustrated in the progression from FIGS. 57 to 59 and described in greater detail below.

Figure 57:
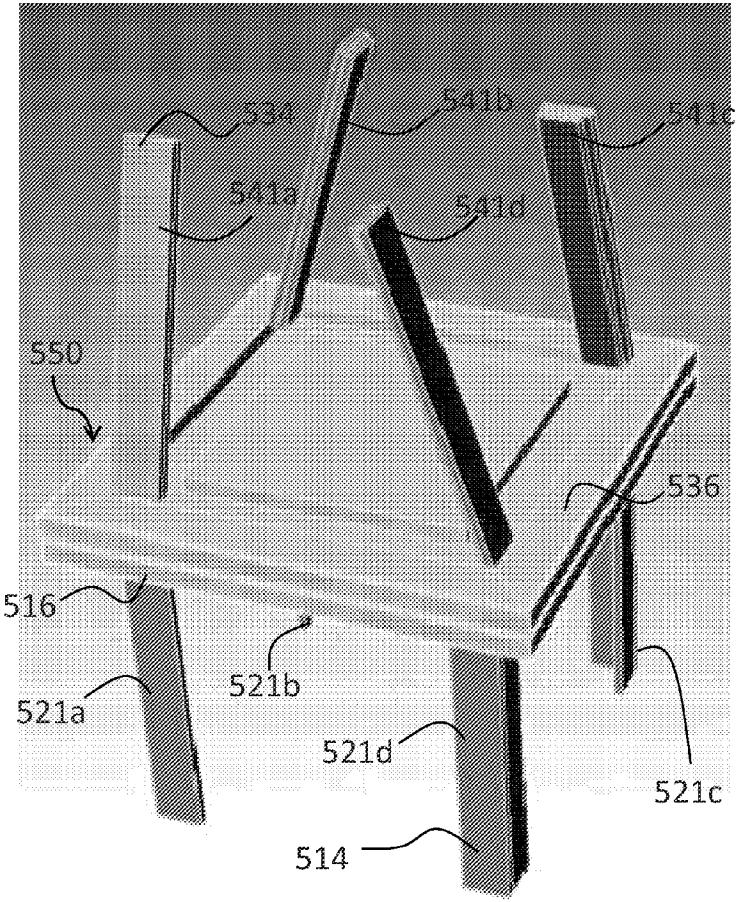

In this exemplary embodiment, the second table base 534 is actually part of the integrated table surface 550, disguised as a decoration in the top table surface 536. As best shown in FIG. 57, the top of the integrated table surface 550 is actually the underside surface of the top table surface 536, which has a recessed slot formed therein for receiving the four table legs 541*a-d* of the second table base 534. During configuration of the configurable table 510 into the double-table configuration, each of the table legs 541*a-d* of the table base 534 is rotated out from within the receiving slot of the table surface 536. The legs 541*a-d* are connected to the underside of the table surface 536 by a hinge or any other suitable attachment mechanism known in the art. After each of the legs 541*a-d* is moved to an upright position and locked in place, perpendicular to the table surface 536, the table portion 532 (i.e., the table surface 536 and table base 534) is ready to be removed or separated from the table portion 512 (i.e., the table surface 516 and table base 514). In the exemplary embodiment illustrated in FIG. 57, each of the legs 541*a-d* has two columnar parts movably connected to one another. When the two parts, together, are moved to an upright position, one of the two parts is rotated, in this case ninety degrees as shown in the progression of FIG. 57 to FIG. 58. At the end of the opening movement, the one part can be locked open in place so that the legs 541*a-d* each do not move (or collapse) until the user desires such movement.

FIG. 58 shows the table surface 536 being separated (i.e., lifted) from the table surface 516. In FIG. 59, the table portion 532 has been removed from the table portion 512 and flipped over with the table base 534 positioned on the ground and the table surface 536 resting thereon. The separate table portions 512, 532 may be used as separate tables, as shown in FIG. 59, or they may be pushed together to form a longer table 510, as shown in FIG. 60. Since the table surfaces 516, 536 have the same size and shape, the configurable table 510 in the double-table configuration has a length two times the length of the configurable table 510 in the single-table configuration.

Figure 62:
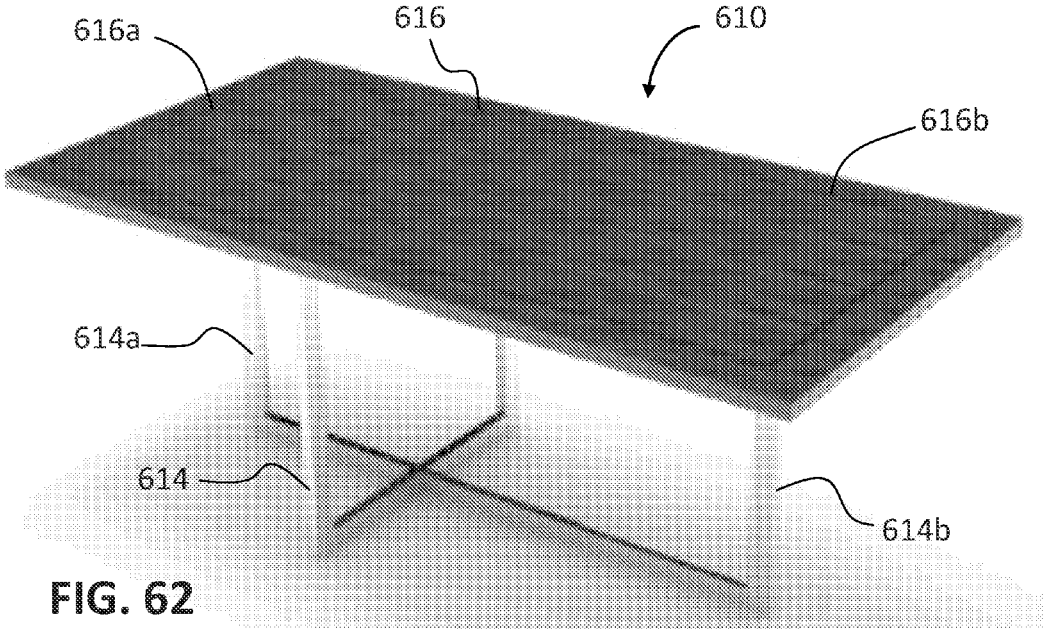
FIG. 62 a perspective view of the configurable table of FIG. 61 in a double-table configuration.
Figure 63:
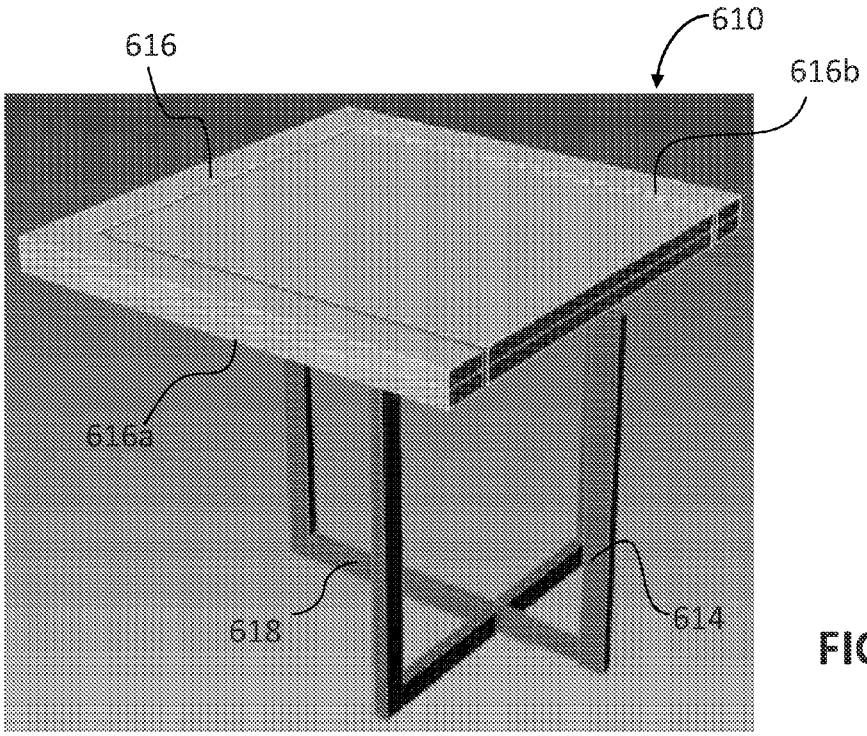
FIGS. 63 to 66 are perspective views of the configurable table of FIG. 61, each depicting a different stage in the configuration of the table between the single-table configuration and the double-table configuration.
Figure 64:
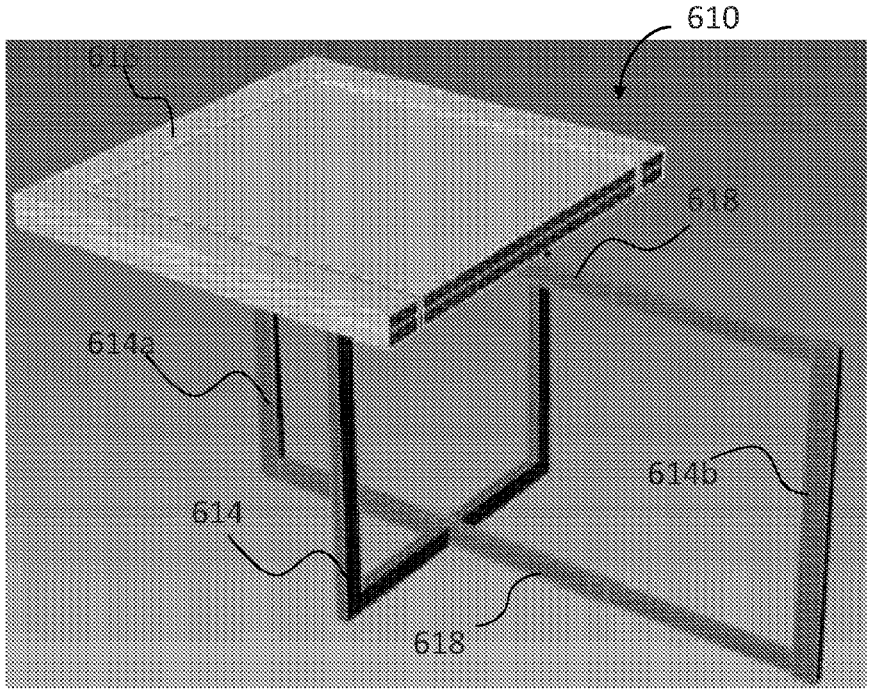
Figure 66:
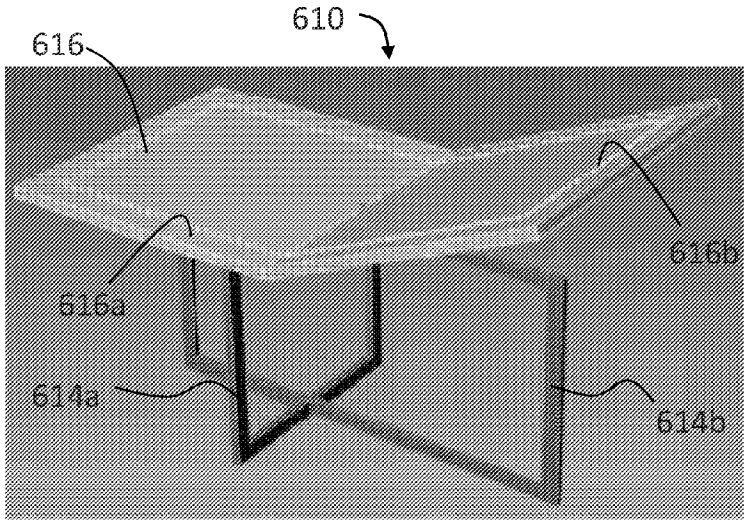
Figure 67:
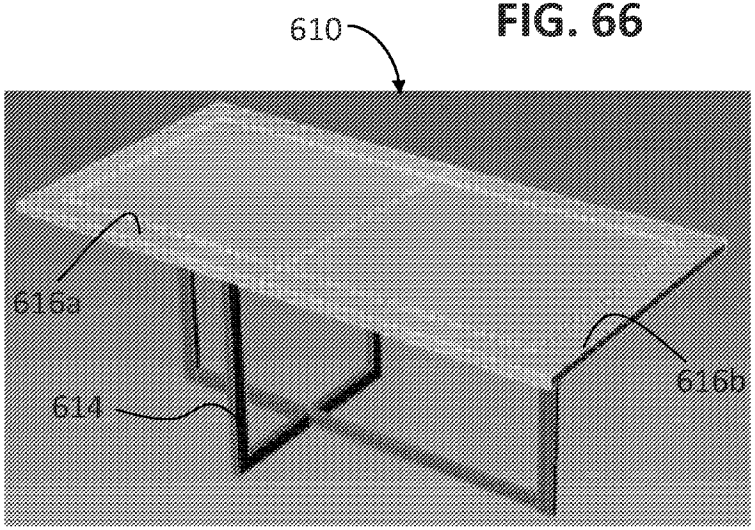
FIG. 67 is another perspective view of the configurable table of FIG. 61 in the double-table configuration.

Referring to FIGS. 61 to 67, there is shown another exemplary embodiment of a configurable table 610 movable between a single-table configuration (FIG. 61) and a double-table configuration (FIGS. 62 and 67). In the single-table configuration of FIG. 61, the configurable table 610 includes a table surface 616 supported by a table base 614. The table surface 616 includes two table surface portions 616*a*, 616*b* movable between a folded state (in the single-table configuration of, for example, FIG. 61) and an unfolded state (in the double-table configuration of, for example, FIG. 62). The table base 614 includes two table base portions 614*a*, 614*b*. The table base portion 614*b* is movable relative to the table portion 614*a* between a shortened state (in the single-table configuration) and an extended state (in the double-table configuration).

Figure 65:
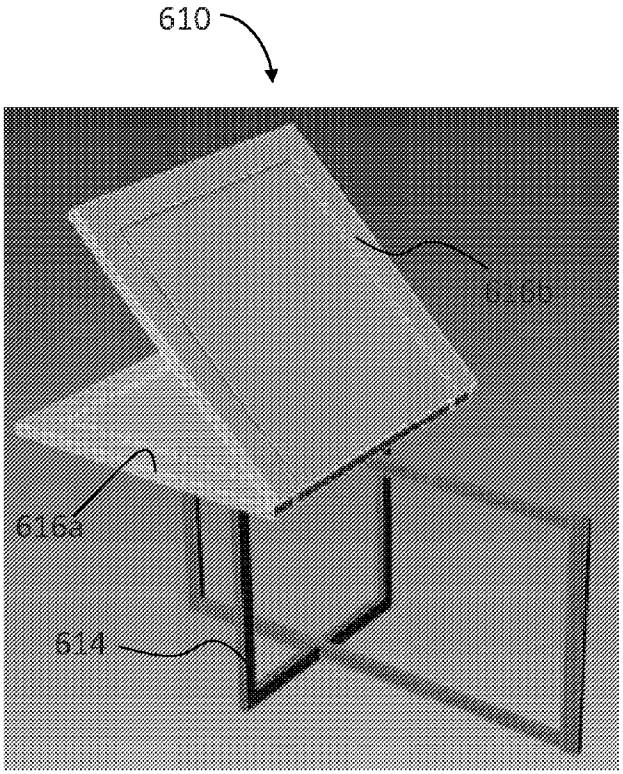

In this exemplary embodiment, the table base portion 614*b* has top and bottom extension members 618 (FIG. 64) operable to slide away from and towards the base portion 614*b*. To move the configurable table 610 between the single-table and double-table configurations, the table base portion 614*b* is pulled away from the table base portion 614*a* and thereby extending the extension members 618 away from the table base portion 614*a*. Once the table base 614 is in the fully extended position (e.g., FIG. 65), the table surface 616 is moved from the folded state to the unfolded state. As shown in FIGS. 65 to 66, the table surface portion 616*b* is unfolded from the table surface portion 616*a* and is supported by the extended table base portion 614*b* in the double-table configuration. Since the table surface portions 616*a*, 616*b* have the same size and shape, the configurable table 610 in the double-table configuration has a length two times the length of the configurable table 610 in the single-table configuration.

Figure 68:
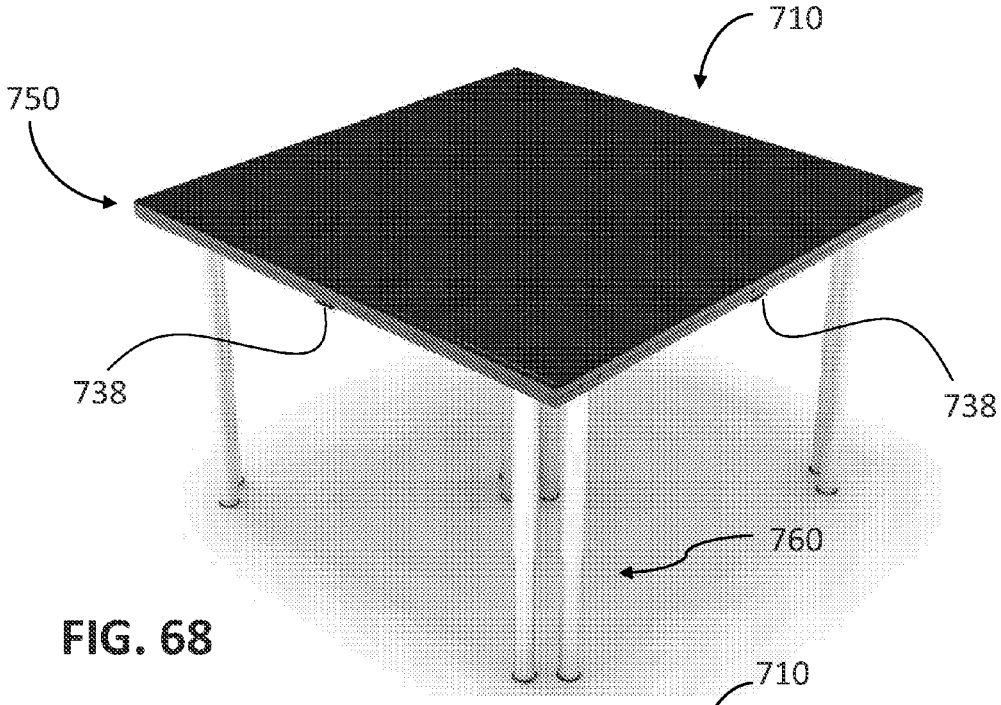
FIG. 68 is a perspective view of a configurable table in a single-table configuration, according to still another exemplary embodiment of the present invention.
Figure 69:
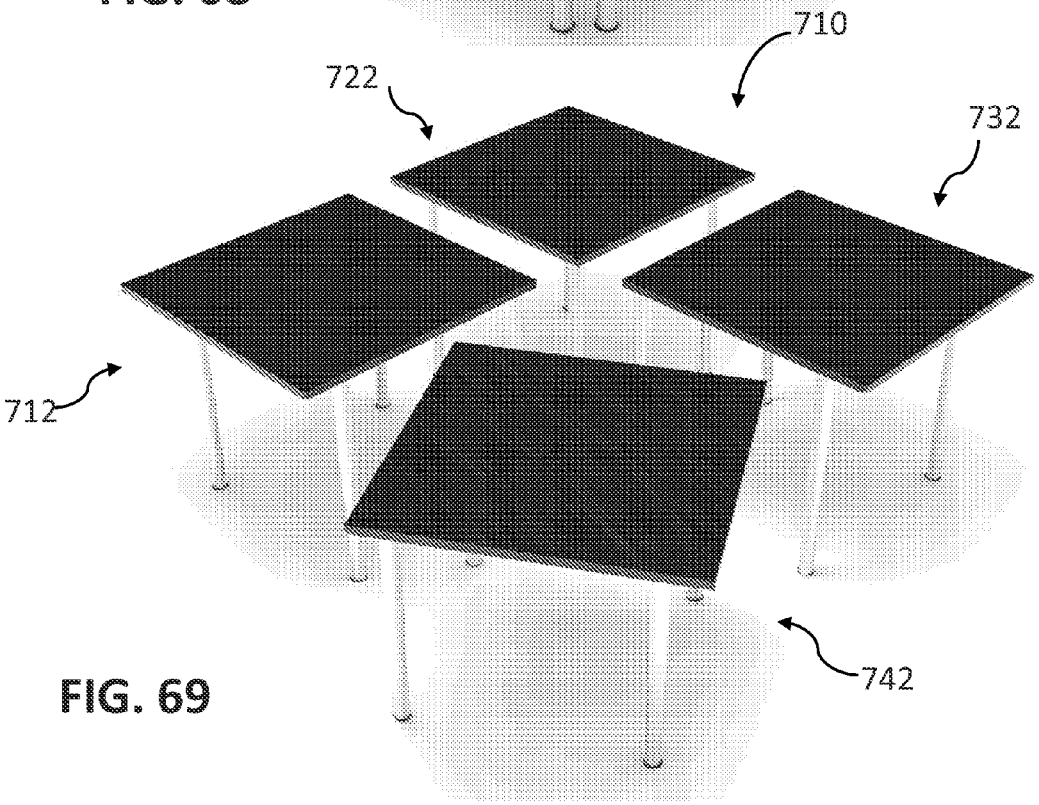
FIG. 69 a perspective view of the configurable table of FIG. 68 in a multiple-table configuration.
Figure 73:
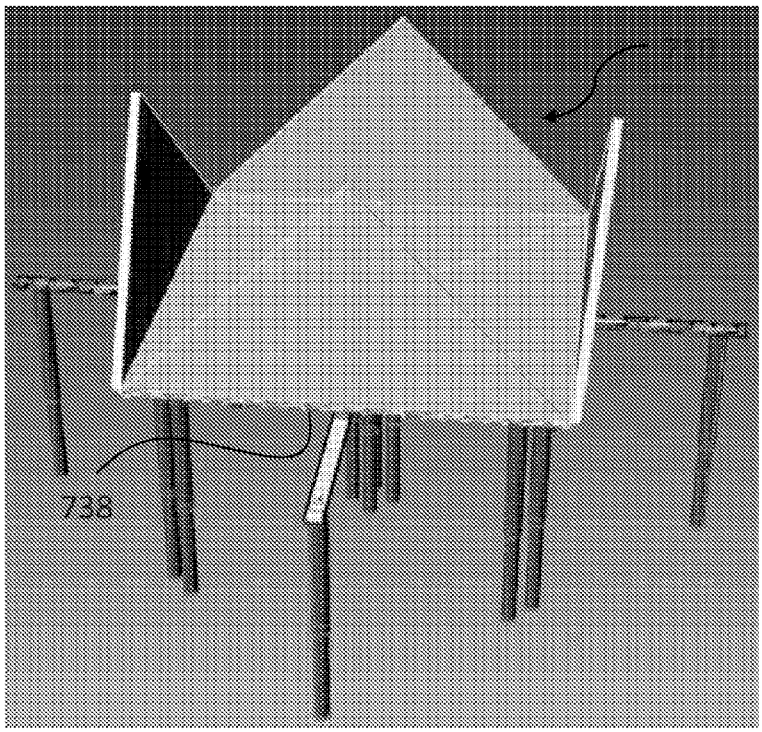
Figure 74:
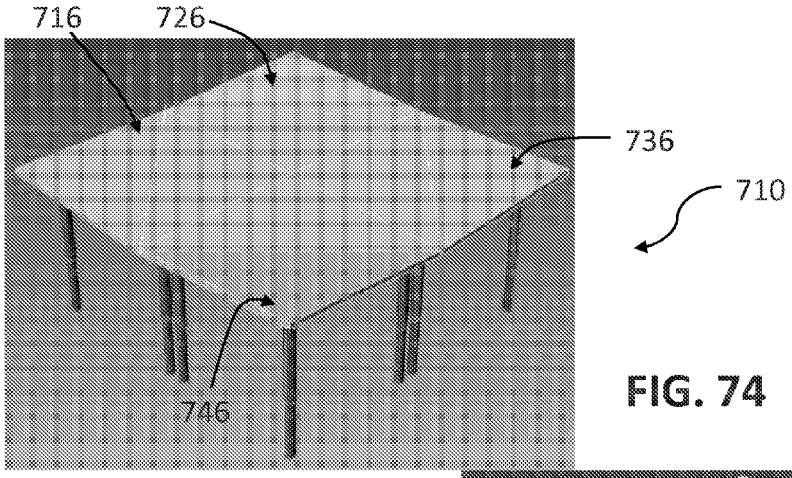
Figure 75:
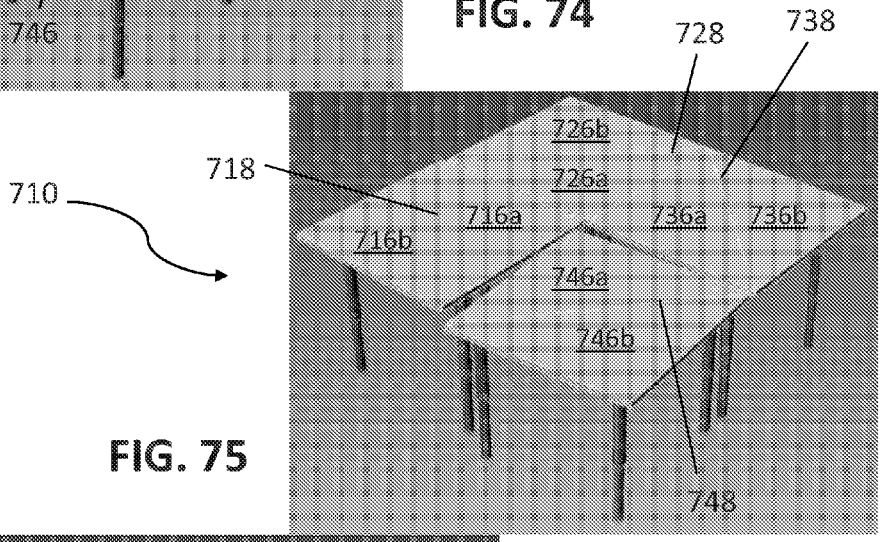
FIGS. 75 to 76 are additional perspective views of the configurable table of FIG. 68 in various different multiple-table configurations.
Figure 76:
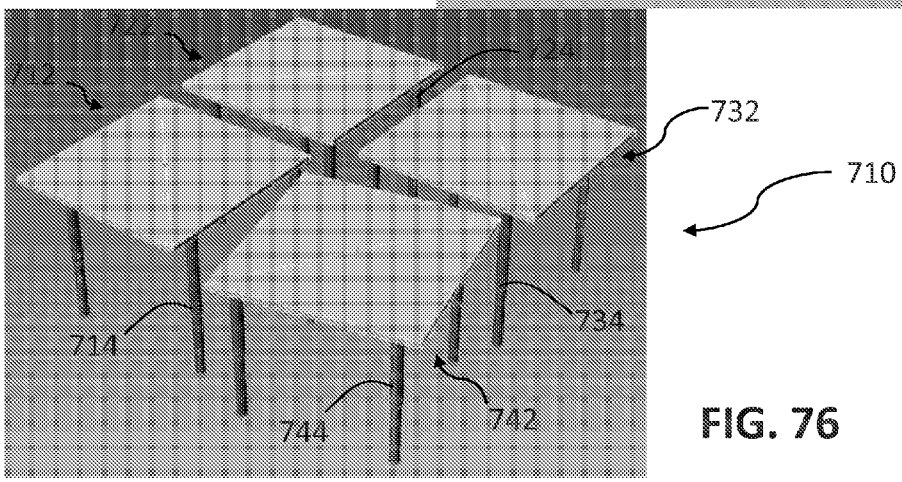
Figure 77:
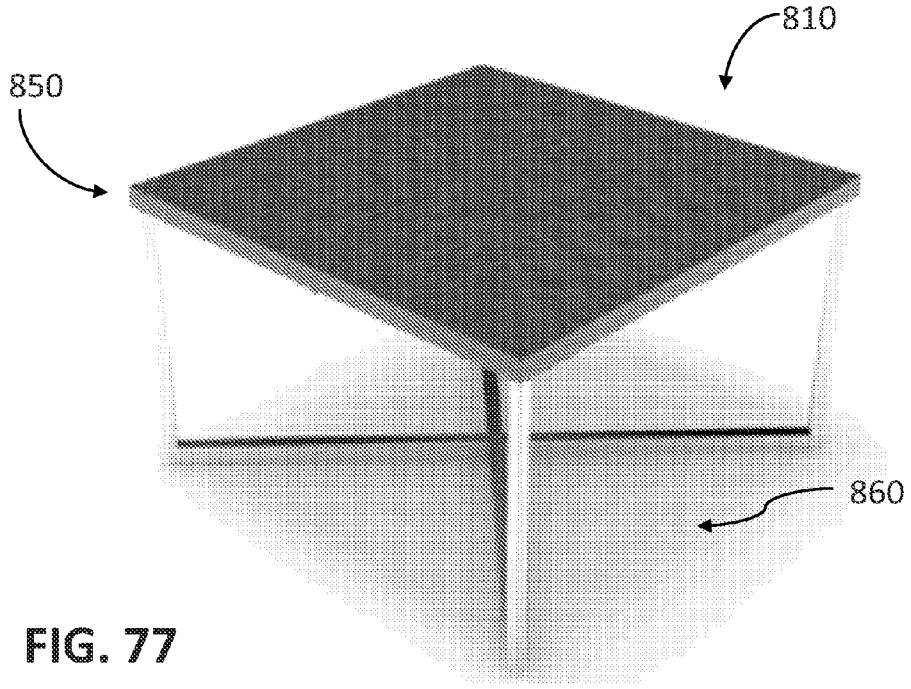
FIG. 77 is a perspective view of a configurable table in a single-table configuration, according to yet another exemplary embodiment of the present invention.

Referring to FIGS. 68 to 76, there is shown another exemplary embodiment of a configurable table 710 movable between a single-table configuration (FIG. 68) and a multiple-table configuration (FIGS. 69, 75, and 76). In the single-table configuration of FIG. 68, the configurable table 710 includes an integrated table surface 750 supported by an integrated table base 760. In this exemplary embodiment, the integrated table surface 750 includes four table surface sub-assemblies 716, 726, 736, 746 mated together and the integrated table base 760 includes portions of the table bases 714, 724, 734, 744 (i.e., three out of four of the table legs). Each of the table surfaces 716, 726, 736, 746 is movable between a folded state (in the single-table configuration of, for example, FIG. 68) and an unfolded state (in the multiple-table configuration of, for example, FIG. 69). In this exemplary embodiment, the four table surface sub-assemblies 716, 726, 736, 746 are mated together in a similar fashion as the folded table surfaces 16, 36, 116, 136 of the embodiments in FIGS. 1 to 31. That is, with reference to FIG. 75, each first table surface portion 716*b*, 726*b*, 736*b*, 746*b* is foldable along respective fold lines 718, 728, 738, 748 onto each respective second table surface portion 716*a*, 726*a*, 736*a*, 746*a* (FIGS. 74 and 75) by at least one folding sub-assembly, e.g., a hinge 738 (FIG. 68).

In the multiple-table configuration of FIG. 69, the configurable table 710 includes four separate table portions 712, 722, 732, 742. The separation of the integrated table surface 750 (i.e., the four table surfaces 716, 726, 736, 746) and the integrated table base 760 (i.e., the four table bases 714, 724, 734, 744) into the four separate table portions 712, 722, 732, 742 is illustrated in the progression from FIGS. 70 to 74 and described in greater detail below.

Figure 70:
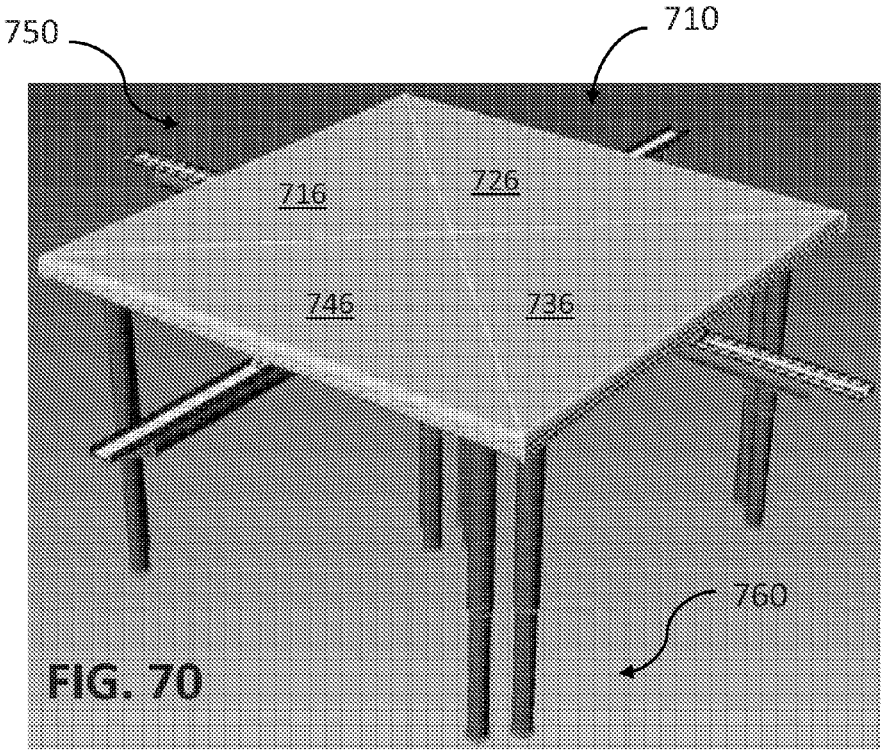
FIGS. 70 to 74 are perspective views of the configurable table of FIG. 68, each depicting a different stage in the configuration of the table between the single-table configuration and the multiple-table configuration.
Figure 71:
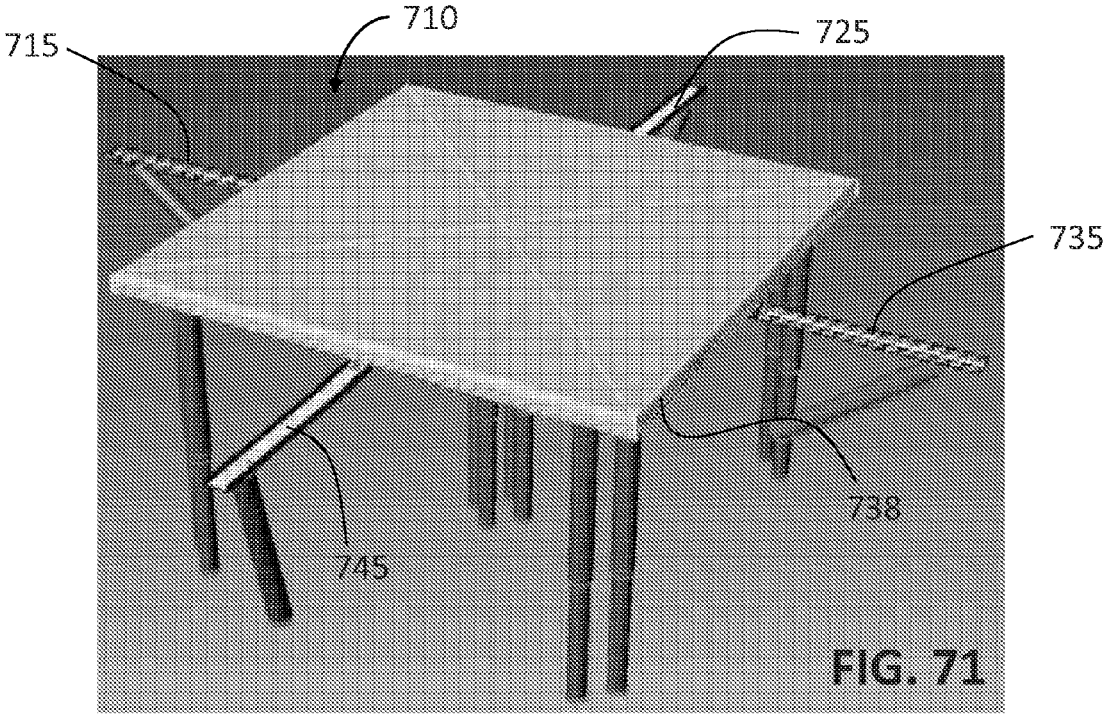
Figure 72:
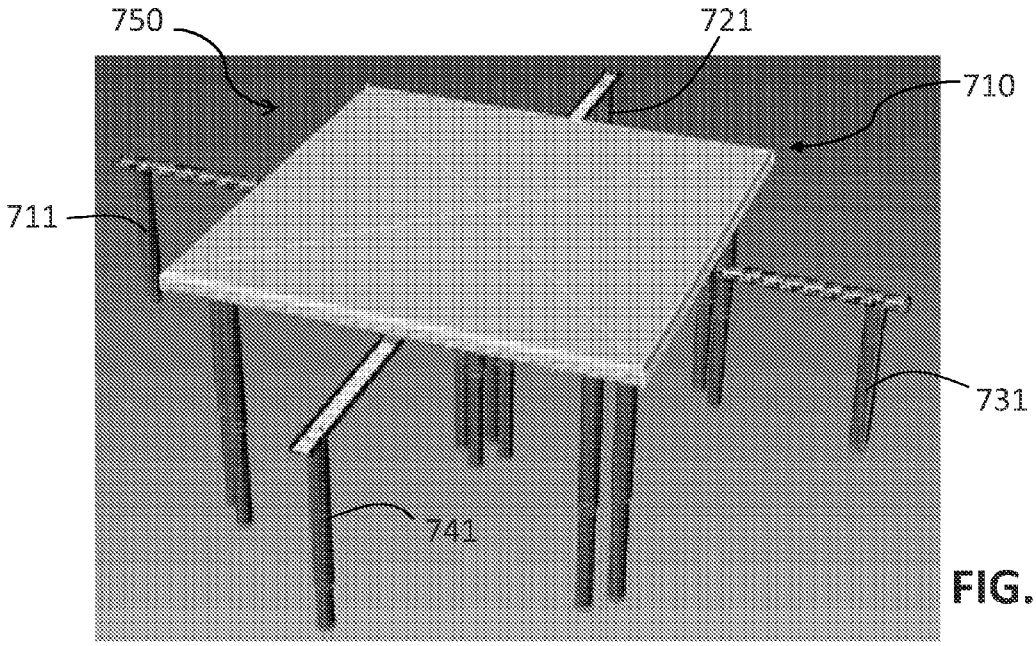

As shown in FIGS. 70 to 71, the configurable table 710 includes extension members 715, 725, 735, 745 slidably coupled to the underside of respective table surfaces 716, 726, 736, 746. To move the configurable table 710 into the multiple-table configuration, the extension members 715, 725, 735, 745 are pulled away, i.e., extended, from the outer fold edge of the respective folded table surfaces 716, 726, 736, 746. The fourth leg members 711, 721, 731, 741 of respective table bases 714, 724, 734, 744 are then unfolded from the extension members 715, 725, 735, 745 to be positioned on the ground, perpendicular to the table surfaces 716, 726, 736, 746. The first table surface portions 716*b*, 726*b*, 736*b*, 746*b* are then unfolded from the respective second table surface portions 716*a*, 726*a*, 736*a*, 746*a*, each being supported by the fourth leg members 711, 721, 731, 741, as depicted in FIGS. 73 to 74.

In the multiple-table configuration, the configurable table 710 can be split up and used as four separate tables 712, 722, 732, 742 (FIGS. 69 and 76). Alternatively, the four separate tables 712, 722, 732, 742 can be pushed together to form a much larger configurable table 710 (FIG. 74), about four-times the size as the configurable table 710 in the single-table configuration.

Figure 78:
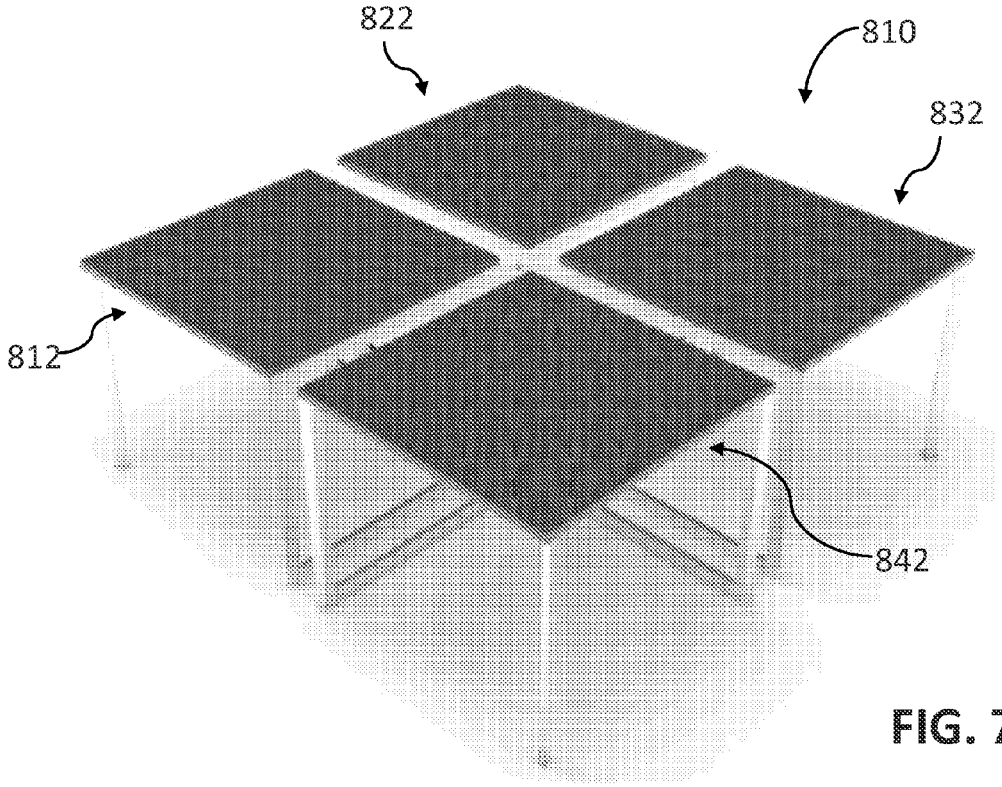
FIG. 78 a perspective view of the configurable table of FIG. 77 in a multiple-table configuration.
Figure 79:
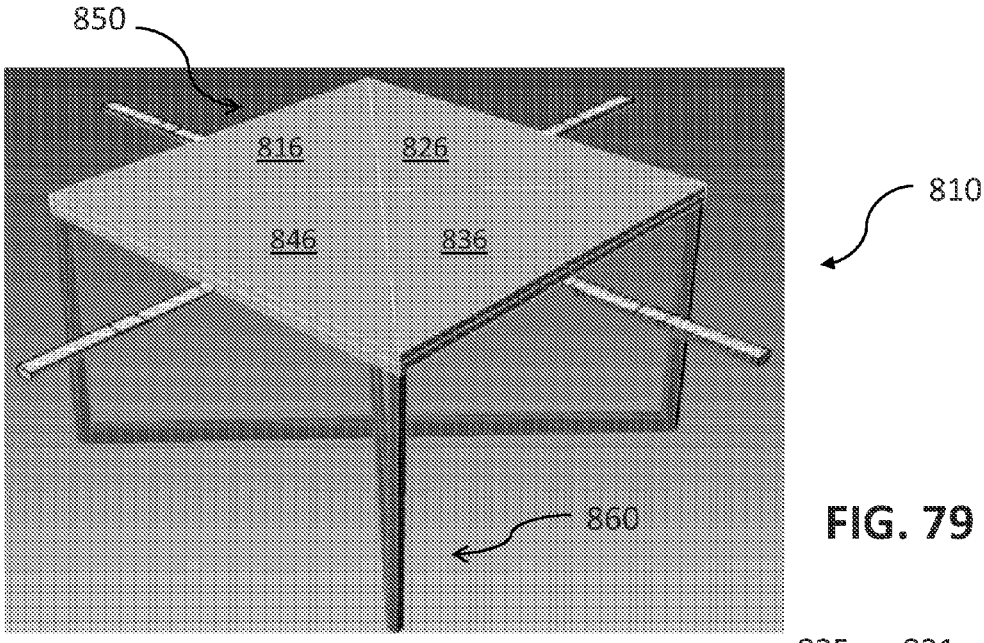
FIGS. 79 to 82 are perspective views of the configurable table of FIG. 77, each depicting a different stage in the configuration of the table between the single-table configuration and the multiple-table configuration.
Figure 80:
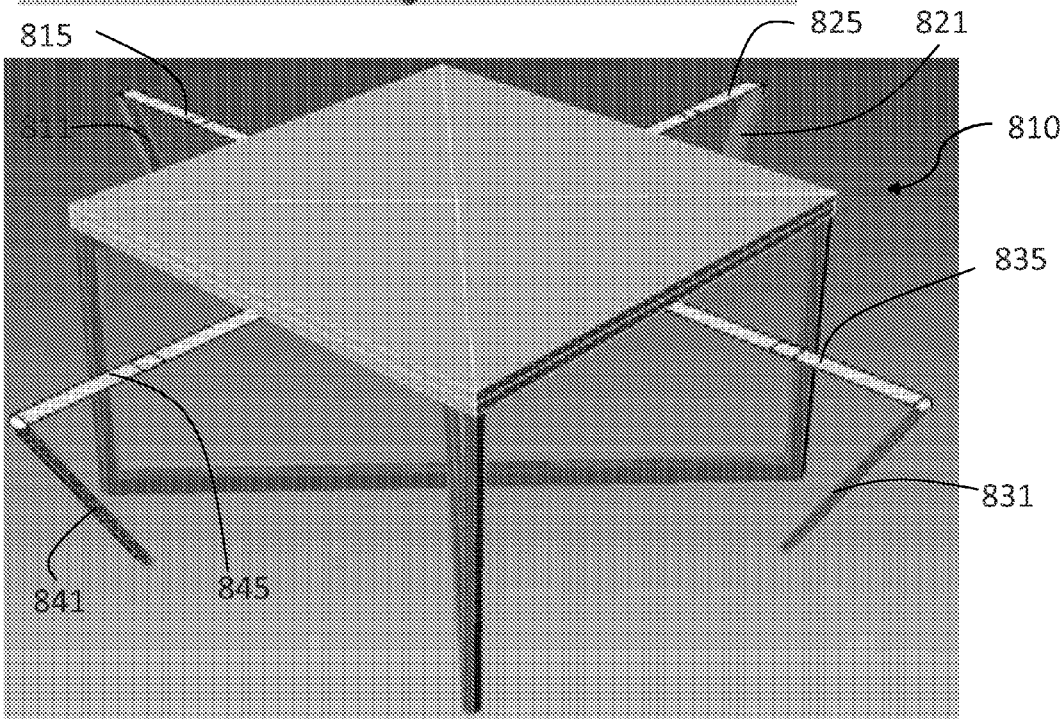
Figure 81:
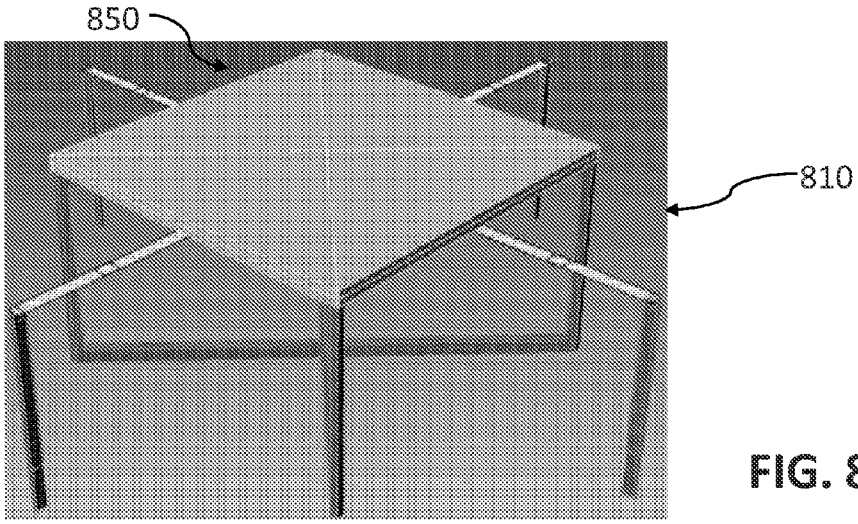
Figure 82:
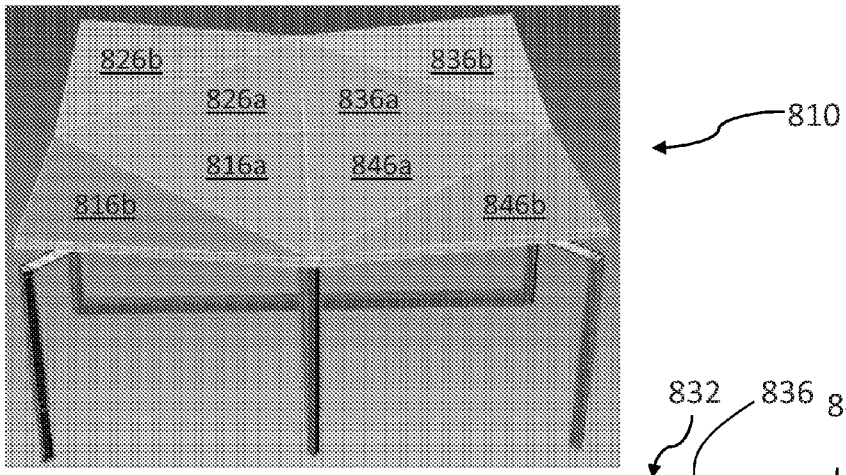
Figure 83:
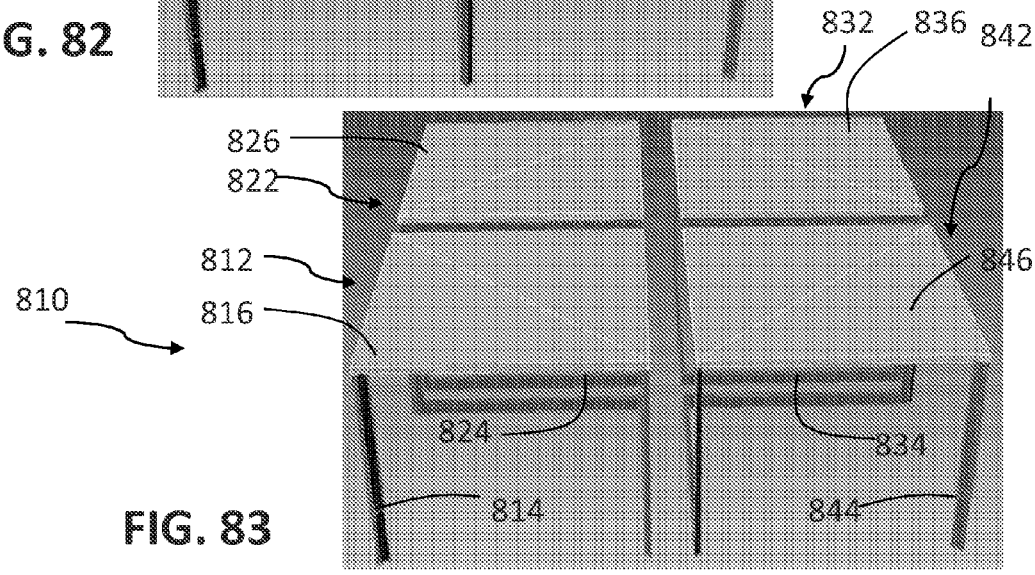
FIG. 83 is another perspective view of the configurable table of FIG. 77 in the multiple-table configuration.

Referring to FIGS. 77 to 83, there is shown another exemplary embodiment of a configurable table 810 movable between a single-table configuration (FIG. 77) and a multiple-table configuration (FIGS. 78 and 83). The configurable table 810 is similar to the configurable table 710 of FIGS. 68 to 76, wherein similar reference numbers increased by 100 refer to similar parts. The difference between the configurable tables 710 and 810 is in the configuration of the table bases. The table bases 714, 724, 734, 744 of the configurable table 710 have four individual leg members, only three of which form part of the integrated table base 760, the fourth leg member 711, 721, 731, 741 extending from the extension members 715, 725, 735, 745 when in the multiple-table configuration. In comparison, the table bases 814, 824, 834, 844 of the configurable table 810 have bar-shaped supporting leg members, both perpendicular and parallel to the ground, and table leg members 811, 821, 831, 841, which extend from the extension members 815, 825, 835, 845 and are perpendicular to the ground in the multiple-table configuration.

Figure 85:
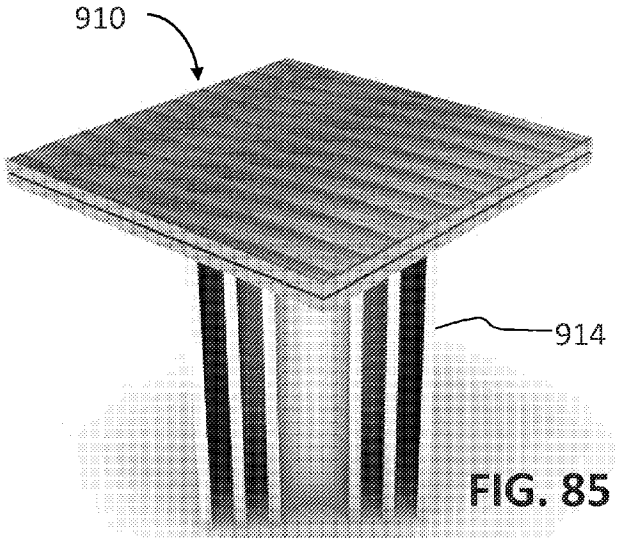
FIG. 85 is another perspective view of the configurable table of FIG. 84, rotated about 90 degrees.
Figure 84:
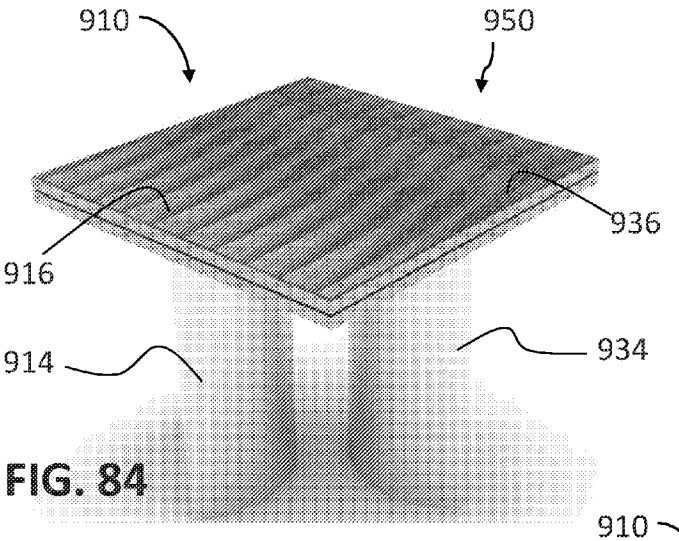
FIG. 84 is a perspective view of a configurable table in a single-table configuration, according to again another exemplary embodiment of the present invention.
Figure 86:
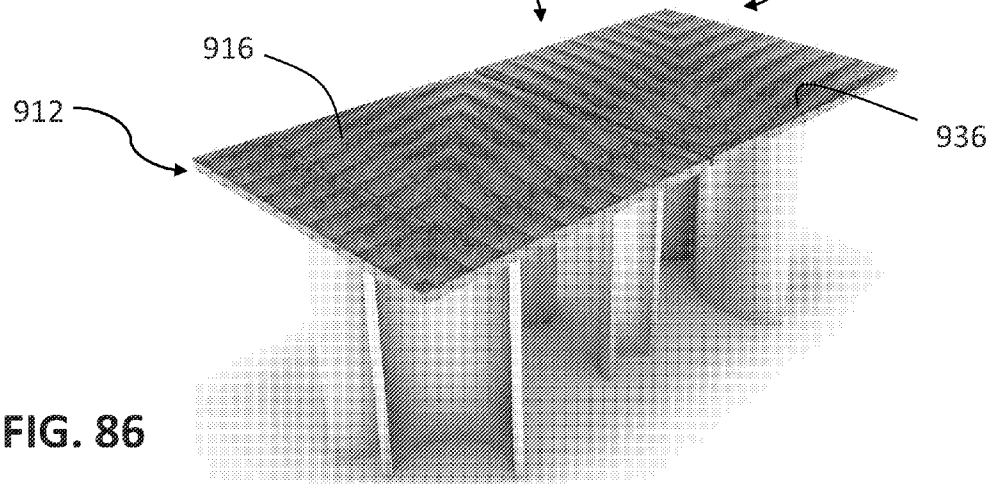
FIG. 86 a perspective view of the configurable table of FIG. 84 in a double-table configuration.
Figure 87:
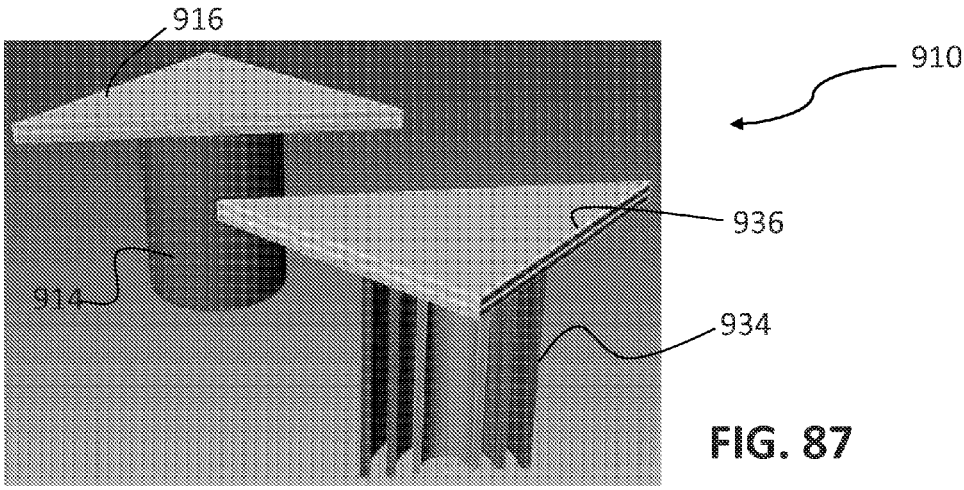
FIGS. 87 to 90 are perspective views of the configurable table of FIG. 84, each depicting a different stage in the configuration of the table between the single-table configuration and the double-table configuration.
Figure 89:
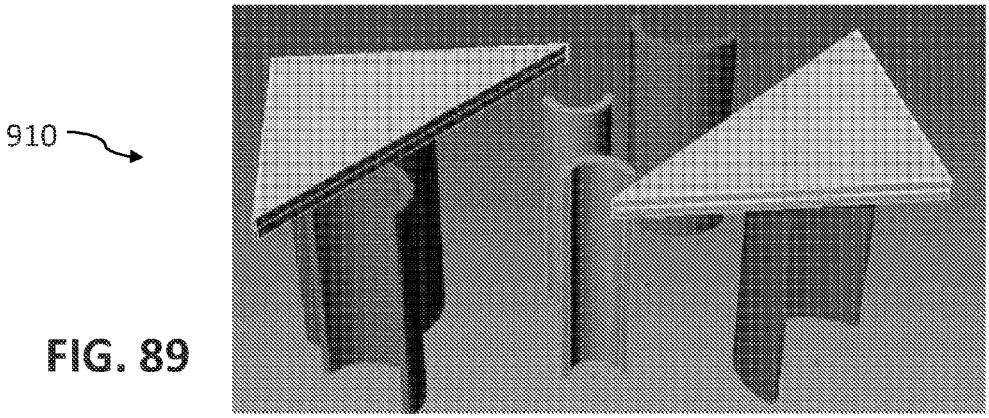
Figure 90:
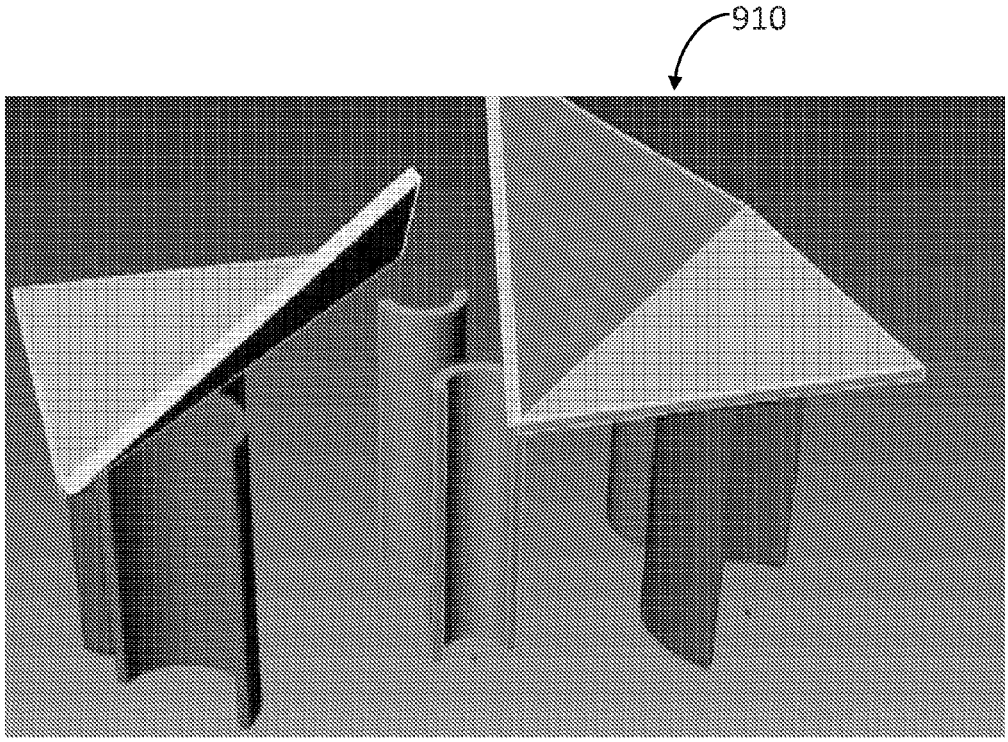
Figure 91:
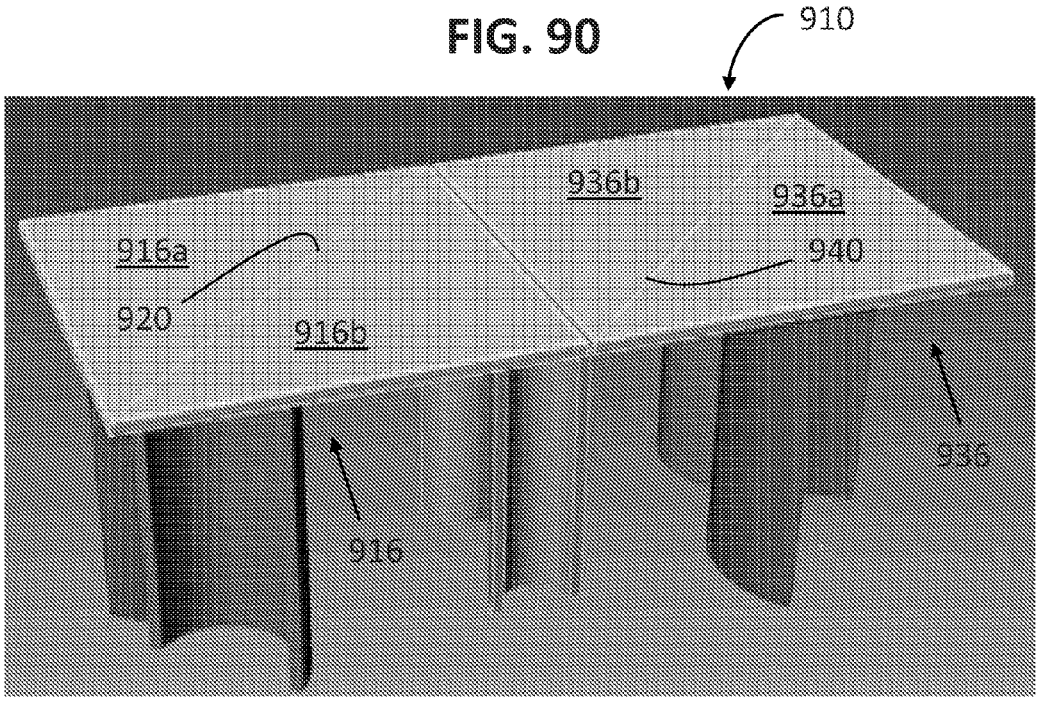
FIG. 91 is another perspective view of the configurable table of FIG. 84 in the double-table configuration.
Figure 92:
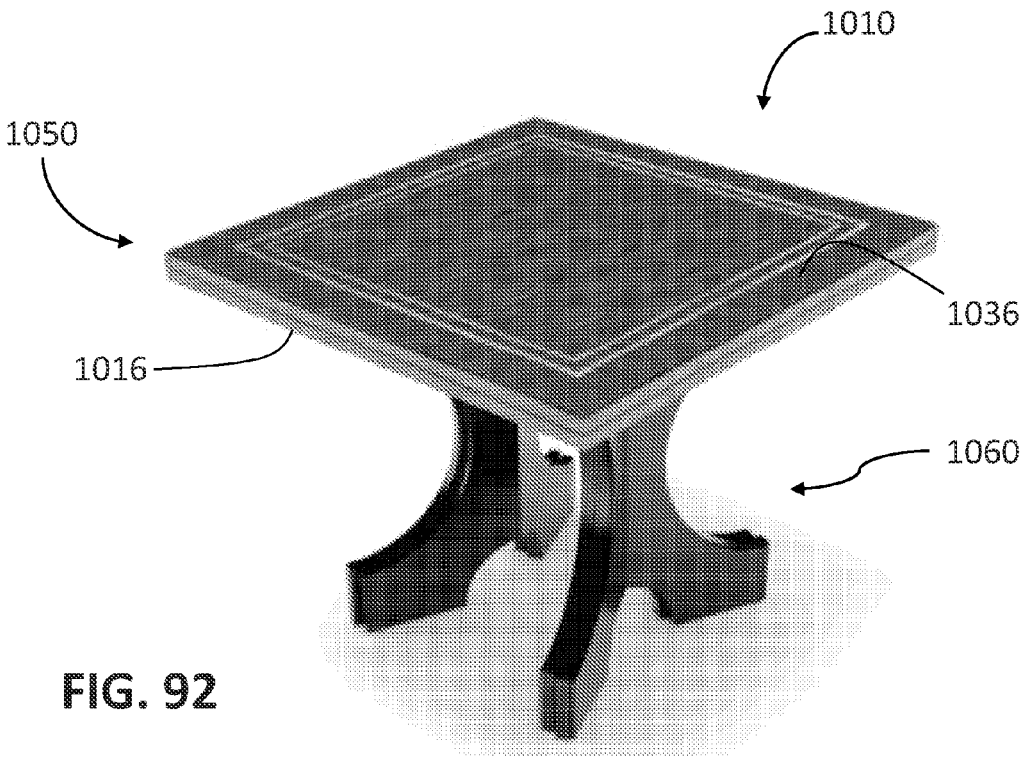
FIG. 92 is a perspective view of a configurable table in a single-table configuration, according to still another exemplary embodiment of the present invention.

Referring to FIGS. 84 to 91, there is shown another exemplary embodiment of a configurable table 910 movable between a single-table configuration (FIG. 84) and a double-table configuration (FIGS. 86 and 91). In the single-table configuration of FIG. 84, the configurable table 910 includes an integrated table surface 950 supported by table bases 914, 934. The integrated table surface 950 includes two table surfaces 916, 936 mated together. Each of the table bases 914, 934 includes a plurality of nested base portions in the single-table configuration (FIGS. 85 and 87). In the double-table configuration of FIG. 86, the configurable table 910 includes two separate table portions 912 and 932. The separation of the integrated table surface 950 (i.e., the two table surfaces 916, 936) and the formation of the two separate table portions 912, 932, is illustrated in the progression from FIGS. 87 to 90 and described in greater detail below.

In this exemplary embodiment, the table surfaces 916 and 936 are movable between a folded state (in the single-table configuration of, for example, FIG. 84) and an unfolded state (in the double-table configuration of, for example, FIG. 86). With regard to FIG. 91, each table surface 916, 936 includes a first surface portion 916*a*, 936*a* and a second surface portion 916*b*, 936*b* connected thereto and foldable thereon (see, e.g., FIG. 91). The table surfaces 916, 936 are foldable along respective fold lines 920, 940 to define respective fold edges (see, e.g., FIG. 91). In this exemplary embodiment, the table surfaces 916, 936 are foldable and operable to mate with each other in the same fashion as the table surfaces 16, 36, 116, 136 of the configurable tables 10, 110 of FIGS. 1 to 31.

Figure 88:
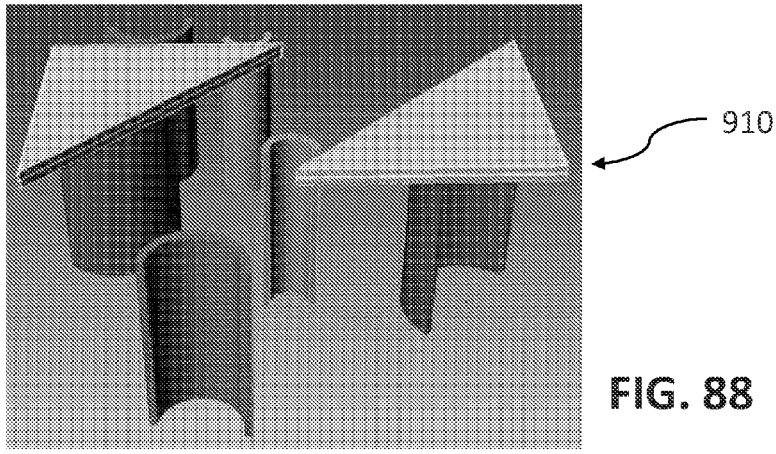

FIG. 87 shows the initial movement of the configurable table 910 where the table bases 914, 934 are separated. The table bases 914, 934, and, thus, the folded table surfaces 916, 936 supported thereon, are moved away from each other. In this exemplary embodiment, each table base 914, 934 includes three nested base portions, all in the shape of a half-cylinder. The number and shape of the base portions is merely exemplary, as there may be only two or more than three base portions and each may comprise a variety of different shapes as long as they are capable of being nested inside one another. In FIGS. 88 to 89, the base portions of each table base 914, 934 are moved relative to one another out from their nested configuration and, in doing so, they are operable to support different portions of the unfolded table surfaces 916, 936 thereon. After the repositioning of the base portions as shown, for example, in FIG. 89, the first table surface portions 916*b*, 936*b* are unfolded (see, e.g., FIG. 90) from the second table surface portions 916*a*, 936*a*. When completely unfolded, the first table surface portions 916*b*, 936*b* are supported by the two smaller base portions of each respective table base 914, 934 and the second table surface portions 916*a*, 936*a* remain supported by the largest of the base portions.

As shown in FIGS. 90 and 91, the smallest base portion of each table base 914, 934 can support a portion of both table surface portions 916*b*, 936*b* in the double configuration. Alternatively, in another exemplary embodiment, if it is desired to have two separate table portions 912, 932, each table surface 916, 936 may be supported by only the base portions of its respective table base 914, 934. Since the table surfaces 916, 936 have the same size and shape, the configurable table 910 in the double-table configuration has a length two times the length of the configurable table 910 in the single-table configuration.

Figure 93:
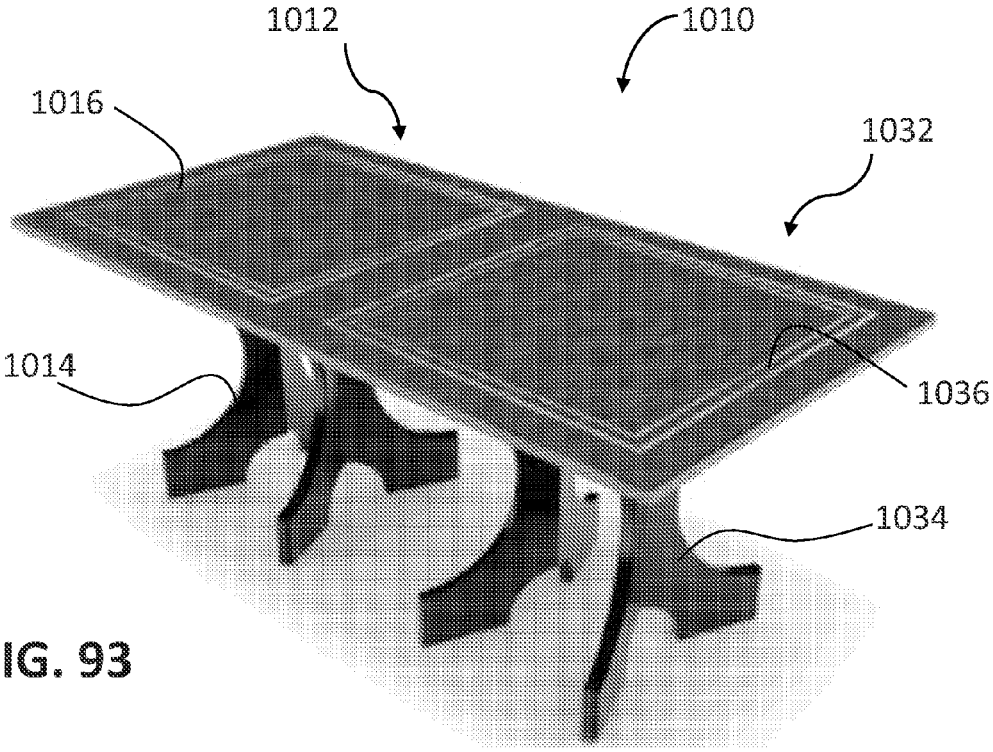
FIG. 93 a perspective view of the configurable table of FIG. 92 in a double-table configuration.
Figure 95:
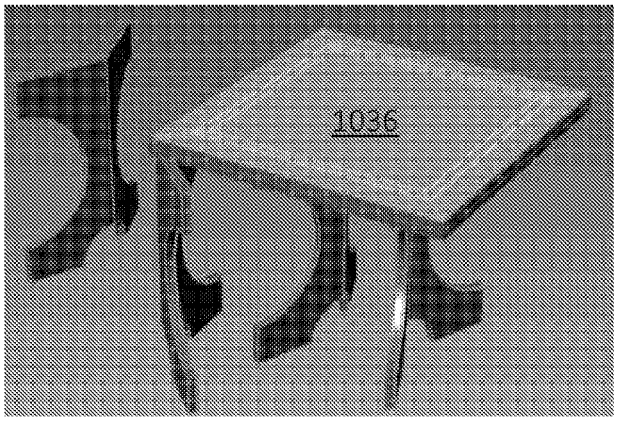
Figure 96:
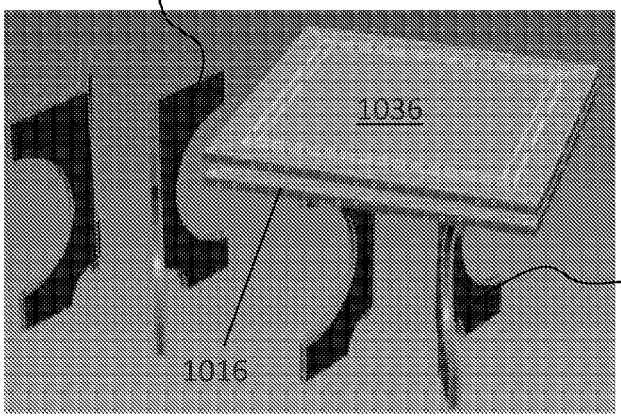
Figure 97:
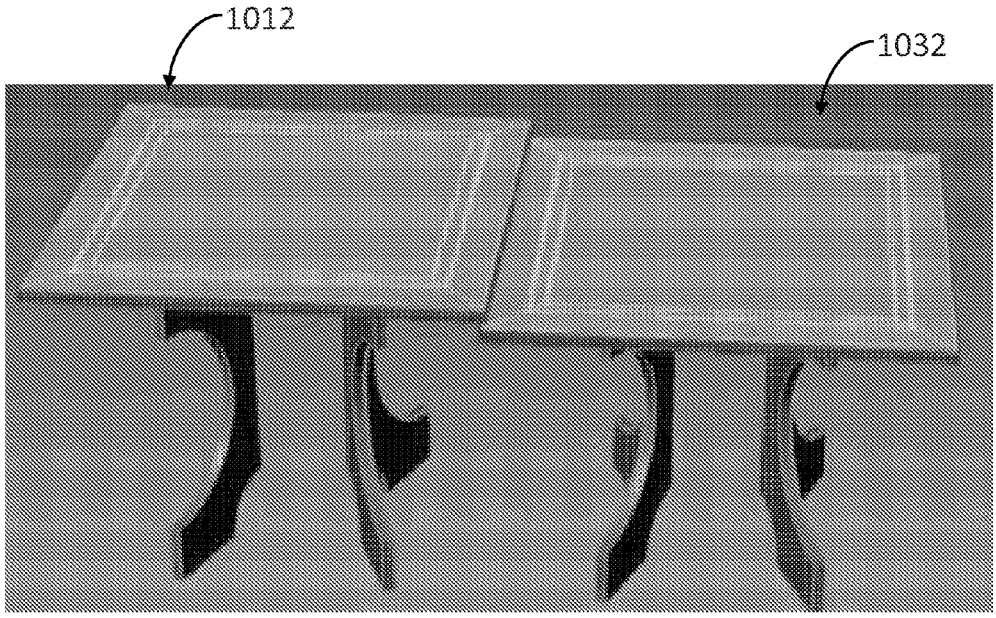
FIGS. 97 to 98 are additional perspective views of the configurable table of FIG. 92 in various different double-table configurations.
Figure 98:
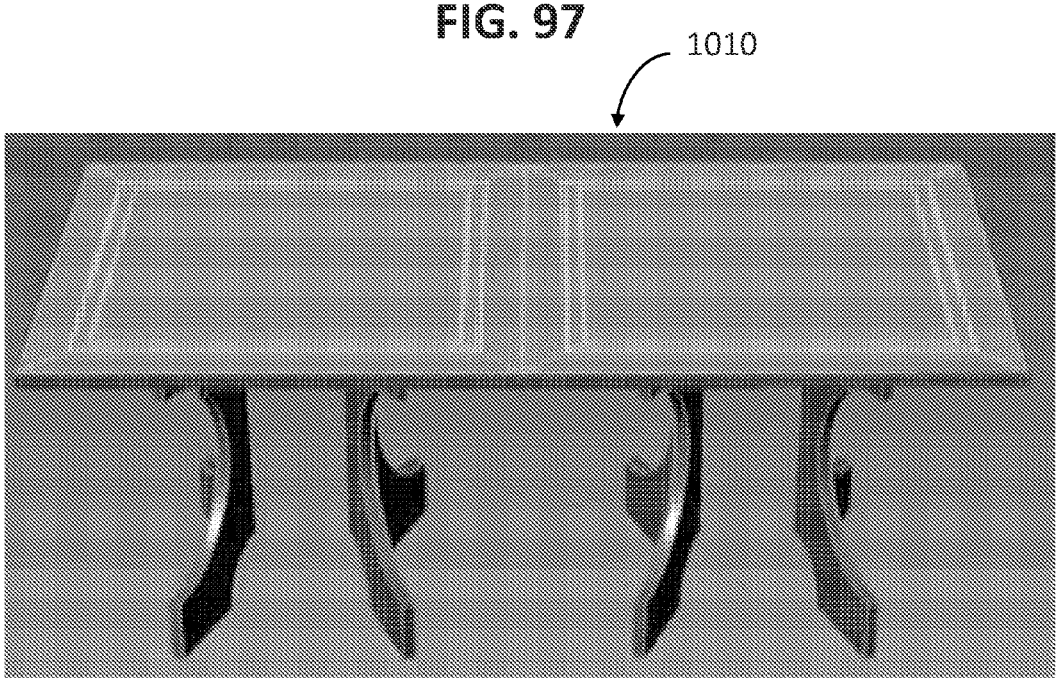

Referring to FIGS. 92 to 98, there is shown another exemplary embodiment of a configurable table 1010 movable between a single-table configuration (FIG. 92) and a double-table configuration (FIGS. 93, 97, and 98). In the single-table configuration of FIG. 92, the configurable table 1010 includes an integrated table surface 1050 supported by an integrated table base 1060. The integrated table base 1060 includes two table bases 1014, 1034 mated together and the integrated table surface 1050 includes two table surfaces 1016, 1036, one table surface 1036 disposed on top of the other table surface 1016. The table surface 1036 may be held in place atop the table surface 1016 by any suitable mechanical attachment mechanism known or contemplated in the art that does not impair either table surface 1016, 1036 when used in the double-table configuration. Alternatively, the table surface 1036 may remain in place atop the table surface 1016 in the single-table configuration merely by its own weight. In the double-table configuration of FIG. 93, the configurable table 1010 includes two separate table portions 1012, 1032. The separation of the integrated table surface 1050 (i.e., the two table surfaces 1016, 1036) and the integrated table base 1060 (i.e., the two table bases 1014, 1034) into the two separate table portions 1012, 1032, is illustrated in the progression from FIGS. 94 to 96 and described in greater detail below.

Figure 94:
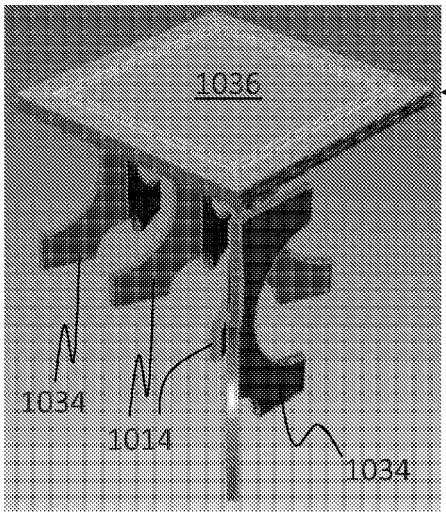
FIGS. 94 to 96 are perspective views of the configurable table of FIG. 92, each depicting a different stage in the configuration of the table between the single-table configuration and the double-table configuration.

As shown in FIGS. 94 to 96, the table base 1034 is pulled away from the table base 1014, and out from underneath the integrated table surface 1050. Thereafter, as shown in FIGS. 96 to 97, the top table surface 1036 is separated or removed from the bottom table surface 1016. In one exemplary embodiment of the double-table configuration, each of the table surfaces 1016, 1036 merely rests upon a respective one of the table bases 1014, 1034, and remains in place thereon by its own weight, to form the separate table portions 1012, 1032. In another exemplary embodiment, the each of the table surfaces 1016, 1036 may be mechanically, removably attached to a respective one of the table bases 1014, 1034 by any measures known or contemplated in the art. The separate table portions 1012, 1032 may be used as separate tables, or they may be pushed together to form a longer table 1010, as shown in FIGS. 93 and 98. Since the table surfaces 1016, 1036 have the same size and shape, the configurable table 1010 in the double-table configuration has a length two times the length of the configurable table 1010 in the single-table configuration.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A configurable table assembly, comprising:

two separate table-base sub-assemblies shaped to connect together removably; and two separate table-surface sub-assemblies each supported by a respective one of the two table-base sub-assemblies and each having first and second surface portions, the second surface portion being operable to rest upon the first surface portion and selectively unfold away from the first surface portion, the table-base sub-assemblies and the table-surface sub-assemblies together having at least a single-table configuration and a double-table configuration in which:

in the single-table configuration:

the two table-base sub-assemblies are mated together separably to form an integrated table base; and the two table-surface sub-assemblies are mated together separably to form an integrated table surface having a substantially planar upper table surface; and in the double-table configuration:

the two table-base sub-assemblies are separated from one another to form two separate tables each supporting thereon a respective one of the table-surface sub-assemblies; and each of the table-surface sub-assemblies has the second surface portion unfolded away from the first surface portion and onto at least a portion of the respective one of the table-base sub-assemblies, each pair of first and second surface portions forming, together, a substantially planar upper table surface;

the integrated table base comprising one of:

two generally cylindrical bases nested together, each having a curved outer surface correspondingly shaped to mate with each other; and two sets of table leg members, each set having at least one table leg member movable relative to the other table leg members.

2. The configurable table assembly according to claim 1, wherein the two separate table-base sub-assemblies are shaped to nest together removably as one table base in the single-table configuration.

3. The configurable table assembly according to claim 1, wherein, in the double-table configuration:

each of the table-surface sub-assemblies defines an adjoining edge; and the two tables are spaced from one another to position each adjoining edge adjacent one another such that the substantially planar upper table surface of each of the two tables are at the same height and, together, form a single, adjoining, substantially planar upper table surface.

4. The configurable table assembly according to claim 1, wherein, when the second surface portion is folded over the first surface portion:

the first and second surface portions define a fold edge; and each fold edge is operable to mate removably with the other fold edge to removably join the two table-base sub-assemblies and the two table-surface sub-assemblies together.

5. A configurable table assembly, comprising:

a single-table configuration including:

an integrated table base comprised of two table bases mated together and separable from one another; and an integrated table surface:

supported by the integrated table base; and comprised of two table surfaces mated together and separable from one another, each of the two table surfaces having a first surface portion and a second surface portion folded over the first surface portion defining a fold edge, the two table surfaces mated together at the fold edges;

a double-table configuration including:

two separate table portions, each of the two table portions comprised of one of the two table surfaces supported by one of the two table bases, the second surface portion of each table surface being unfolded from the first surface portion; and masking surface inserts, each of the fold edges comprising:

at least one hinge; and at least one pocket operable to:

receive therein the at least one hinge of an opposing fold edge to mate the two table surfaces together in the single-table configuration; and receive therein one of the masking surface inserts in the double-table configuration.

6. The configurable table assembly according to claim 5, wherein:

the integrated table surface of the single-table configuration defines a first table length;

each of the two table surfaces includes a side edge; and the side edges are operable to engage one another to join the two separate table portions in a side-by-side arrangement in the double-table configuration to define a second table length longer than the first table length.

7. The configurable table assembly according to claim 5, wherein one of the first and second surface portions of each table surface is rotatable relative to one of the table bases.

8. A configurable table assembly, comprising:

a single-table configuration including:

an integrated table base comprised of two table bases mated together and separable from one another; and an integrated table surface:

supported by the integrated table base; and comprised of two table surfaces mated together and separable from one another, each of the two table surfaces having a first surface portion and a second surface portion folded over the first surface portion defining a fold edge, the two table surfaces mated together at the fold edges;

a double-table configuration including:

two separate table portions, each of the two table portions comprised of one of the two table surfaces supported by one of the two table bases, the second surface portion of each table surface being unfolded from the first surface portion;

each of the table bases includes a first base portion and a second base portion rotatable relative to the first base portion;

the first and second surface portions of each table surface:

overlap in the single-table configuration and are both substantially supported by both the first and second base portions of one of the table bases in the single-table configuration; and do not overlap in the double-table configuration, each surface portion being substantially supported by only one of the base portions in the double-table configuration.

9. A configurable table assembly, comprising:

a single-table configuration including:

an integrated table base comprised of two table bases mated together and separable from one another; and an integrated table surface:

supported by the integrated table base; and comprised of two table surfaces mated together and separable from one another, each of the two table surfaces having a first surface portion and a second surface portion folded over the first surface portion defining a fold edge, the two table surfaces mated together at the fold edges;

a double-table configuration including:

two separate table portions, each of the two table portions comprised of one of the two table surfaces supported by one of the two table bases, the second surface portion of each table surface being unfolded from the first surface portion;

the integrated table base comprising one of:

two generally cylindrical bases nested together, each having a curved outer surface correspondingly shaped to mate with each other; and two sets of table legs members, each set having at least one table leg member movable relative to the other table leg members.

10. A configurable table, comprising:

a first table portion;

a second table portion movably associated with the first table portion to define a single-table configuration and a double-table configuration, each of the first and second table portions including:

a table base; and a table surface supported on the table base and movable between a folded state and an unfolded state, the table surfaces being operable to:

mate with one another in the folded state to provide an integrated table surface in the single-table configuration; and separate from one another to provide the first and second separate table portions in the double-table configuration;

each of the table surfaces being operable to fold along a fold line thereof to define a fold edge in the folded state, the fold edges being operable to mate with one another in the single-table configuration; and each of the fold edges comprises:

at least one hinge; and at least one pocket operable to receive therein the at least one hinge of an opposing fold edge to mate the first and second table surfaces together in the single-table configuration.

11. The configurable table according to claim 10, wherein the table bases are operable to:

mate with one another to provide an integrated table base in the single configuration; and separate from one another in the double-table configuration.

12. The configurable table according to claim 11, wherein each table base is comprised of a plurality of table leg members, at least one table leg member being movable relative to the other table leg members.

13. The configurable table according to claim 10, wherein:

the integrated table surface in the single-table configuration defines a first length;

the first table portion comprises a first table surface having a first side edge; and the second table portion comprises a second table surface having a second side edge operable to engage the first side edge to join the first and second table portions side-by-side in the double-table configuration that defines a combined second length longer than the first length.

14. The configurable table according to claim 10, further comprising masking surface inserts, the at least one pocket being operable to receive therein one of the masking surface inserts in the double-table configuration.

15. The configurable table according to claim 10, further comprising rotation assemblies each respectively rotatably coupling the table surfaces to the table bases.

16. A configurable table, comprising:

a first table portion;

a second table portion movably associated with the first table portion to define a single-table configuration and a double-table configuration, each of the first and second table portions including:

a table base; and a table surface supported on the table base and movable between a folded state and an unfolded state, the table surfaces being operable to:

mate with one another in the folded state to provide an integrated table surface in the single-table configuration; and separate from one another to provide the first and second separate table portions in the double-table configuration;

each table surface comprising a first surface half and a second surface half;

each table base comprising a first base portion and a second base portion movable relative to the first base portion;

the first and second surface halves of each table surface overlapping each other and being both supported by the first and second base portions of one of the table bases in the single-table configuration; and each of the first and second surface halves of each table surface being substantially only supported by one of the first and second base portions of one of the table bases in the double configuration.

17. A configurable table comprising:

a first table portion;

a second table portion movably associated with the first table portion to define a single-table configuration and a double-table configuration, each of the first and second table portions including:

a table base; and a table surface supported on the table base and movable between a folded state and an unfolded state, the table surfaces being operable to:

mate with one another in the folded state to provide an integrated table surface in the single-table configuration; and separate from one another to provide the first and second separate table portions in the double-table configuration;

each of the table surfaces being operable to fold along a fold line thereof to define a fold edge in the folded state, the fold edges being operable to mate with one another in the single-table configuration; and each of the fold edges comprises:

at least one hinge; and at least one pocket operable to receive therein the at least one hinge of an opposing fold edge to mate the first and second table surfaces together in the single-table configuration;

the table bases being operable to:

mate with one another to provide an integrated table base in the single configuration; and separate from one another in the double-table configuration; and the table bases being generally cylindrical and each including a curved outer surface correspondingly shaped to mate with each other such that the integrated table base is generally comprised of two adjacent generally cylindrical table bases nested together.

* * * * *